US011480909B2

(12) United States Patent
Mori et al.

(10) Patent No.: US 11,480,909 B2
(45) Date of Patent: Oct. 25, 2022

(54) DRUM UNIT, CARTRIDGE, ELECTROPHOTOGRAPHIC IMAGE FORMING APPARATUS AND COUPLING MEMBER

(71) Applicant: CANON KABUSHIKI KAISHA, Tokyo (JP)

(72) Inventors: Tomonori Mori, Numazu (JP); Tetsuo Uesugi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/372,635

(22) Filed: Jul. 12, 2021

(65) Prior Publication Data

US 2021/0341870 A1 Nov. 4, 2021

Related U.S. Application Data

(60) Division of application No. 17/036,376, filed on Sep. 29, 2020, now Pat. No. 11,150,591, which is a division of application No. 16/733,560, filed on Jan. 3, 2020, now Pat. No. 10,824,106, which is a division of application No. 16/275,692, filed on Feb. 14, 2019, (Continued)

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.

CPC ..... *G03G 15/751* (2013.01); *G03G 15/757* (2013.01); *G03G 21/1647* (2013.01); *G03G 21/186* (2013.01); *G03G 21/16* (2013.01); *G03G 21/18* (2013.01)

(58) Field of Classification Search

CPC .... G03G 15/00; G03G 15/751; G03G 15/757; G03G 15/0216; G03G 15/5008; G03G 21/16; G03G 21/1647; G03G 21/1671; G03G 21/18; G03G 21/1814; G03G 21/186

See application file for complete search history.

(56) References Cited

U.S. PATENT DOCUMENTS

| | | | |
|---|---|---|---|
| 6,131,011 | A | 10/2000 | Kojima et al. |
| 6,157,792 | A | 12/2000 | Mori et al. |

(Continued)

FOREIGN PATENT DOCUMENTS

| | | | |
|---|---|---|---|
| AU | 2001361000 | A1 | 5/2000 |
| CA | 2 372 419 | A | 2/2002 |

(Continued)

OTHER PUBLICATIONS

English translation of Japanese Patent Application Pub. No. H05-19550 A (publication date Jan. 29, 1993).

(Continued)

*Primary Examiner* — Sophia S Chen
(74) *Attorney, Agent, or Firm* — Venable LLP

(57) ABSTRACT

A drum unit includes a photosensitive drum in a coupling member. The coupling member includes an engageable member having a driving force receiving portion which is capable of entering a recess of a driving shaft to receive a driving force for rotating photosensitive drum. The coupling member includes a holding member configured to hold said engageable member so as to be slidable at least in a radial direction of said drum unit.

22 Claims, 53 Drawing Sheets

Related U.S. Application Data now Pat. No. 10,539,915, which is a continuation of application No. PCT/JP2016/075735, filed on Aug. 26, 2016.

(56) References Cited

U.S. PATENT DOCUMENTS

| | | | |
|---|---|---|---|
| 6,178,301 | B1 | 1/2001 | Kojima et al. |
| 6,266,503 | B1 | 7/2001 | Murayama et al. |
| 6,298,217 | B1 | 10/2001 | Murayama et al. |
| 6,314,266 | B1 | 11/2001 | Murayama et al. |
| 6,404,996 | B1 | 6/2002 | Mori et al. |
| 6,826,380 | B2 | 11/2004 | Karakama et al. |
| 6,915,092 | B2 | 7/2005 | Yamaguchi et al. |
| 6,980,759 | B2 | 12/2005 | Kanno et al. |
| 7,082,276 | B2 | 7/2006 | Karakama et al. |
| 7,231,164 | B2 | 6/2007 | Harada et al. |
| 7,386,241 | B2 | 6/2008 | Mori et al. |
| 7,660,550 | B2 | 2/2010 | Mori et al. |
| 7,890,025 | B2 | 2/2011 | Chadani et al. |
| 7,899,364 | B2 | 3/2011 | Chadani et al. |
| 7,983,589 | B2 | 7/2011 | Sato et al. |
| 8,116,661 | B2 | 2/2012 | Chadani et al. |
| 8,306,460 | B2 | 11/2012 | Chadani et al. |
| 8,335,454 | B2 | 12/2012 | Chadani et al. |
| 8,442,416 | B2 | 5/2013 | Chadani et al. |
| 8,447,209 | B2 | 5/2013 | Chadani et al. |
| 8,583,007 | B2 | 11/2013 | Chadani et al. |
| 8,588,647 | B2 | 11/2013 | Chadani et al. |
| 8,639,160 | B2 | 1/2014 | Chadani et al. |
| 9,063,464 | B2 | 6/2015 | Furutani et al. |
| 9,134,679 | B2 | 9/2015 | Mori |
| 9,134,688 | B2 | 9/2015 | Chadani et al. |
| 9,146,500 | B2 | 9/2015 | Uesugi et al. |
| 9,207,581 | B2 | 12/2015 | Wada et al. |
| 9,302,801 | B2 | 4/2016 | Matsumura et al. |
| 9,304,440 | B2 | 4/2016 | Yoshida et al. |
| 9,310,717 | B2 | 4/2016 | Matsunaga et al. |
| 9,354,553 | B2 | 5/2016 | Yoshida et al. |
| 9,529,304 | B2 | 12/2016 | Uesugi et al. |
| 9,581,958 | B2 | 2/2017 | Chadani et al. |
| 9,665,040 | B2 | 5/2017 | Matsuzaki et al. |
| 9,885,978 | B2 | 2/2018 | Matsuzaki et al. |
| 9,983,542 | B2 | 5/2018 | Chadani et al. |
| 10,175,609 | B2 | 1/2019 | Matsuzaki et al. |
| 10,671,013 | B2 | 6/2020 | Uesugi et al. |
| 2002/0106215 | A1 | 8/2002 | Ban et al. |
| 2002/0122676 | A1 | 9/2002 | Yamada et al. |
| 2002/0127029 | A1 | 9/2002 | Yamada et al. |
| 2005/0047821 | A1 | 3/2005 | Murayama et al. |
| 2008/0138114 | A1 | 6/2008 | Chadani et al. |
| 2008/0152388 | A1 | 6/2008 | Ueno et al. |
| 2009/0060578 | A1 | 3/2009 | Oohara et al. |
| 2009/0203494 | A1 | 8/2009 | Koizumi |
| 2009/0317129 | A1 | 12/2009 | Abe et al. |
| 2010/0189462 | A1 | 7/2010 | Kawashima et al. |
| 2010/0221036 | A1 | 9/2010 | Hara et al. |
| 2010/0034561 | A1 | 11/2010 | Batori et al. |
| 2010/0278559 | A1 | 11/2010 | Komatsu et al. |
| 2011/0020031 | A1 | 1/2011 | Sato et al. |
| 2011/0038649 | A1 | 2/2011 | Miyabe et al. |
| 2012/0195637 | A1 | 8/2012 | Huck et al. |
| 2013/0216275 | A1 | 8/2013 | Morioka et al. |
| 2014/0037336 | A1 | 2/2014 | Yan |
| 2015/0050048 | A1 | 2/2015 | Huang |
| 2015/0050050 | A1 | 2/2015 | Huang |
| 2015/0185693 | A1* | 7/2015 | Wang ..... G03G 15/757 399/111 |
| 2015/0277367 | A1 | 10/2015 | Maeshima et al. |
| 2016/0246250 | A1 | 8/2016 | Kamoshida et al. |
| 2017/0102640 | A1 | 4/2017 | Sato |
| 2017/0322512 | A1 | 11/2017 | Kamoshida et al. |
| 2017/0351214 | A1 | 12/2017 | Uesugi et al. |
| 2018/0284686 | A1 | 10/2018 | Matsuoka et al. |
| 2019/0179249 | A1 | 6/2019 | Mori et al. |
| 2020/0041953 | A1 | 2/2020 | Uesugi et al. |

FOREIGN PATENT DOCUMENTS

| | | | |
|---|---|---|---|
| CA | 2 975 984 | A | 8/2016 |
| CL | 201600526 | A | 3/2016 |
| CL | 201701970 | A | 8/2017 |
| CL | 201702162 | A | 4/2018 |
| CN | 101558361 | A | 10/2009 |
| CN | 101819400 | A | 9/2010 |
| CN | 101876808 | A | 11/2010 |
| CN | 102037417 | A | 4/2011 |
| CN | 102890441 | A | 1/2013 |
| CN | 103149824 | A | 6/2013 |
| CN | 203784139 | U | 8/2014 |
| CN | 104919374 | A | 9/2015 |
| CN | 105573082 | A | 5/2016 |
| DE | 11 2016 000 940 | T5 | 11/2017 |
| EP | 1 211 576 | A1 | 6/2002 |
| EP | 1 241 535 | A1 | 9/2002 |
| EP | 2 829 919 | A | 1/2015 |
| EP | 2 829 919 | A1 | 1/2015 |
| EP | 3 045 919 | A | 7/2016 |
| EP | 3 045 979 | A | 7/2016 |
| EP | 3 045 979 | A1 | 7/2016 |
| EP | 3 327 509 | A1 | 5/2018 |
| ES | 2369115 | T3 | 11/2011 |
| GB | 2 107 251 | A | 4/1983 |
| JP | 405-19550 | A | 1/1993 |
| JP | H08-87225 | A | 4/1996 |
| JP | 2002-318490 | A | 10/2002 |
| JP | 2003-231849 | A | 8/2003 |
| JP | 2006-243716 | A | 9/2006 |
| JP | 2008-233867 | A | 10/2008 |
| KR | 2010-0134130 | A | 12/2010 |
| KR | 10-2011-0086883 | A | 8/2011 |
| KR | 10-2014-0108332 | A | 9/2014 |
| KR | 10-2015-0018905 | A | 2/2015 |
| KR | 2017-0125887 | A | 11/2017 |
| RU | 2 289 835 | C2 | 12/2006 |
| RU | 2 518 220 | C2 | 6/2014 |
| RU | 2 568 045 | C1 | 11/2015 |
| RU | 2690046 | C1 | 5/2019 |
| RU | 2692107 | C2 | 6/2019 |
| RU | 2019-108099 | C2 | 9/2020 |

OTHER PUBLICATIONS

English translation of Japanese Patent Application Pub. No. 2002-318490 A (publication date Oct. 31, 2002).

English translation of Japanese Patent Application Pub. No. 08-087225 A (publication date Apr. 2, 1996).

Jul. 18, 2019 Office Action in Taiwanese Patent Application No. 107111954.

English translation of Japanese Patent Application Pub. No. 2003-343602 A (publication date Dec. 3, 2003).

English translation of Japanese Patent Application Pub. No. 2000-214727 A (publication date Aug. 4, 2000).

May 16, 2018 Office Action in Taiwanese Patent Application No. 105127509.

Jan. 6, 2019 Office Action in Taiwanese Patent Application No. 107111954.

Office Action in Russian Patent Application No. 2019108099, dated Oct. 22, 2019 (with English translation).

Examination Report in Australian Patent Application No. 2016420645, dated Aug. 20, 2019.

English translation of Jul. 18, 2019 Office Action in Taiwanese Patent Application No. 107111954.

International Search Report and Written Opinion for International Patent Application No. PCT/JP2016/075735, dated Dec. 6, 2016.

Mar. 2, 2020 Communication in European Patent Application No. 19 202 685.4.

Apr. 30, 2020 Communication in European Patent Application No. 16 914 247.8.

Jun. 15, 2020 Examination Report in Australian Patent Application No. 2016420645.

Jul. 9, 2020 Notice of Acceptance in Australian Patent Application No. 2016420645.

(56) References Cited

OTHER PUBLICATIONS

Jun. 30, 2020 Office Action in Chilean Patent Application No. 201900463.
Jul. 21, 2021 Notice of Allowance in Chinese Patent Application No. 201680088700.8.
Jul. 2, 2021 Decision to Grant in Russian Patent Application No. 2020143855 (with English translation).
Jul. 16, 2021 Office Action in Canadian Patent Application No. 3,080,757.
Jul. 20, 2021 Office Action in Canadian Patent Application No. 3,080,773.
Jul. 20, 2021 Office Action in Canadian Patent Application No. 3,080,790.
Aug. 11, 2020 Office Action in Brazilian Patent Application No. BR112019001593-0 (with English translation).
Nov. 23, 2020 Office Action in Indian Patent Application No. 201947009292.
Sep. 30, 2020 Office Action in Colombian Patent Application No. NC2019/0002093 (with English translation).
Nov. 9, 2020 Decision to Grant in Russian Patent Application No. 2019108099 (with English translation).
Jan. 12, 2021 Office Action in Chinese Patent Application No. 201680088700.8 (with English translation).
Apr. 28, 2021 Office Action in Australian Patent Application No. 2020203870.
May 12, 2021 Notice of Allowance in Korean Patent Application No. 10-2019-7008470.
Mar. 12, 2021 Office Action in Chilean Patent Application No. 201900463.
May 31, 2021 Notice of Allowance in Columbian Patent Application No. NC 2019/0002093.
Oct. 12, 2021 Office Action in Canadian Patent Application No. 3,024,218.
Mar. 9, 2022 Office Action in Chilean Patent Application No. 202003258.
Oct. 12, 2021 Office Action in Canadian Patent Applicaiton No. 3,034,218.
Jan. 26, 2022 Office Action in German Patent Application No. 11 2016 007 181.7 (with English translation).
Feb. 25, 2022 Office Action in Indian Patent Application No. 202148022525.
May 3, 2022 Notice of Accepatance in Australian Patent Application No. 2020203870.
Apr. 18, 2022 Notice of Allowance in Russian Patent Application No. 2021125551 (with English translation).
May 16, 2022 Office Action in Chilean Patent Application No. 202003529.
Jul. 28, 2022 Notice of Allowance in Korean Patent Application No. 10-2021-7039268.
Aug. 11, 2022 Office Action in Chilean Patent Applicatino No. 202003258.
Aug. 29, 2022 Office Action in Chilean Patent Application No. 202101319.

* cited by examiner (a)

(b)

(a)

(b)

(a)

(b)

(a)

(b)

(a)

(b)

(a)

(b)

(a)

(b)

DRUM UNIT, CARTRIDGE, ELECTROPHOTOGRAPHIC IMAGE FORMING APPARATUS AND COUPLING MEMBER

TECHNICAL FIELD

The present invention relates to an image forming apparatus using an electrophotographic process, a drum unit, a cartridge and a coupling which are usable with the image forming apparatus, or the like.

BACKGROUND ART

In an electrophotographic image forming apparatus, there is known a structure in which elements such as a photosensitive drum and a developing roller, which are rotatable members related to image formation, are integrated into a cartridge which is detachably mountable relative to a main assembly of an image forming apparatus (hereinafter, the apparatus main assembly). In such a structure, a structure for receiving a driving force from the apparatus main assembly to rotate the photosensitive drum in the cartridge is employed in many apparatuses. At this time, a structure is known in which a driving force is transmitted through engagement between a coupling member on a cartridge side and a driving force transmitting portion such as a drive pin on the apparatus main assembly side.

For example, Patent Document 1 discloses a cartridge having a coupling member provided at an end portion of a photosensitive drum so as to be tiltable with respect to a rotation axis of the photosensitive drum.

SUMMARY OF THE INVENTION

Problem to be Solved by the Invention

It is another object of the present invention to develop the above-mentioned conventional technique.

Means for Solving the Problem

Typical structure provides a drum unit detachably mountable to a main assembly of an electrophotographic image forming apparatus, the main assembly including a driving shaft provided with a recess, said drum unit comprising (1) a photosensitive drum; and (2) a coupling member provided on said photosensitive drum and including, (2-1) an engageable member having a driving force receiving portion configured to enter the recess to receive a driving force for rotating said photosensitive drum, (2-2) a holding member configured to hold said engageable member so as to be slidable at least in a radial direction of said drum unit, (2-3) an urging member configured to urge said engageable member.

Effects of the Invention

The above-mentioned conventional technique is further developed.

Figure 13:
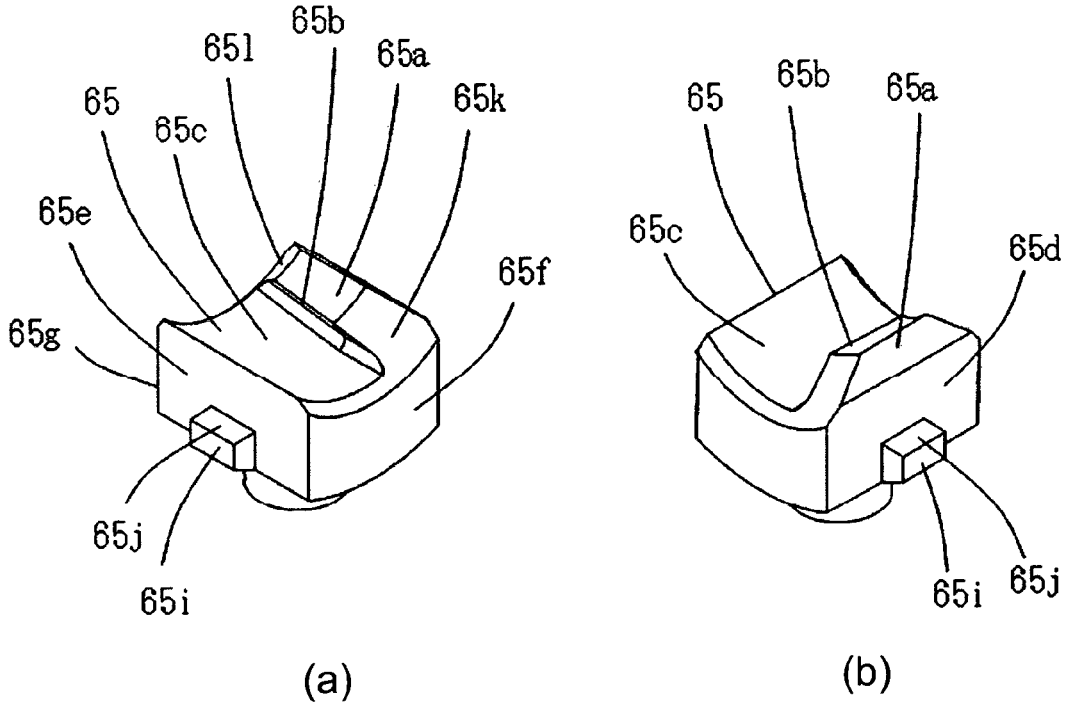

Parts (a) and (b) of FIG. 13 are perspective views of an engaging member 65.

Figure 14:
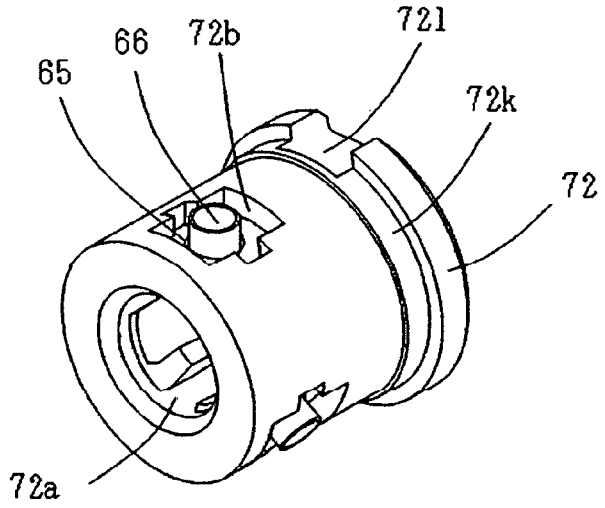
Figure 14:
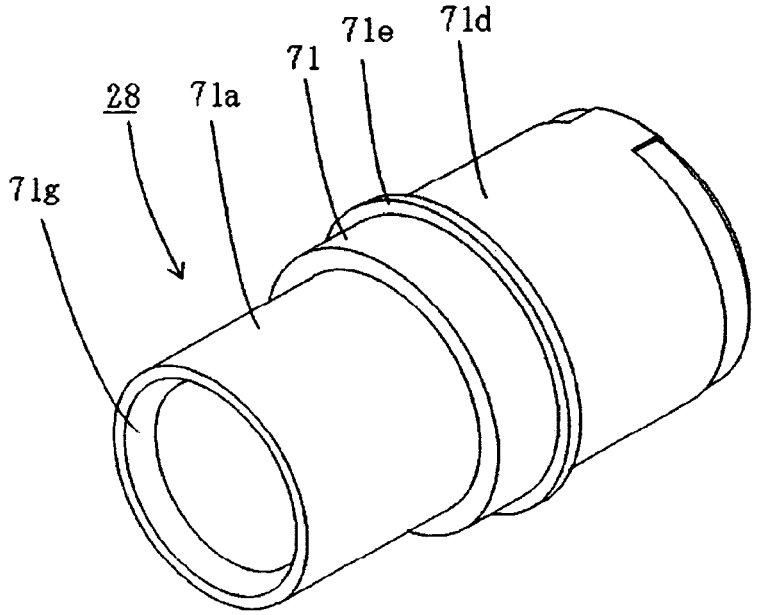

Parts (a) and (b) of FIG. 14 are perspective views of a member of the coupling unit 28.

Figure 15:
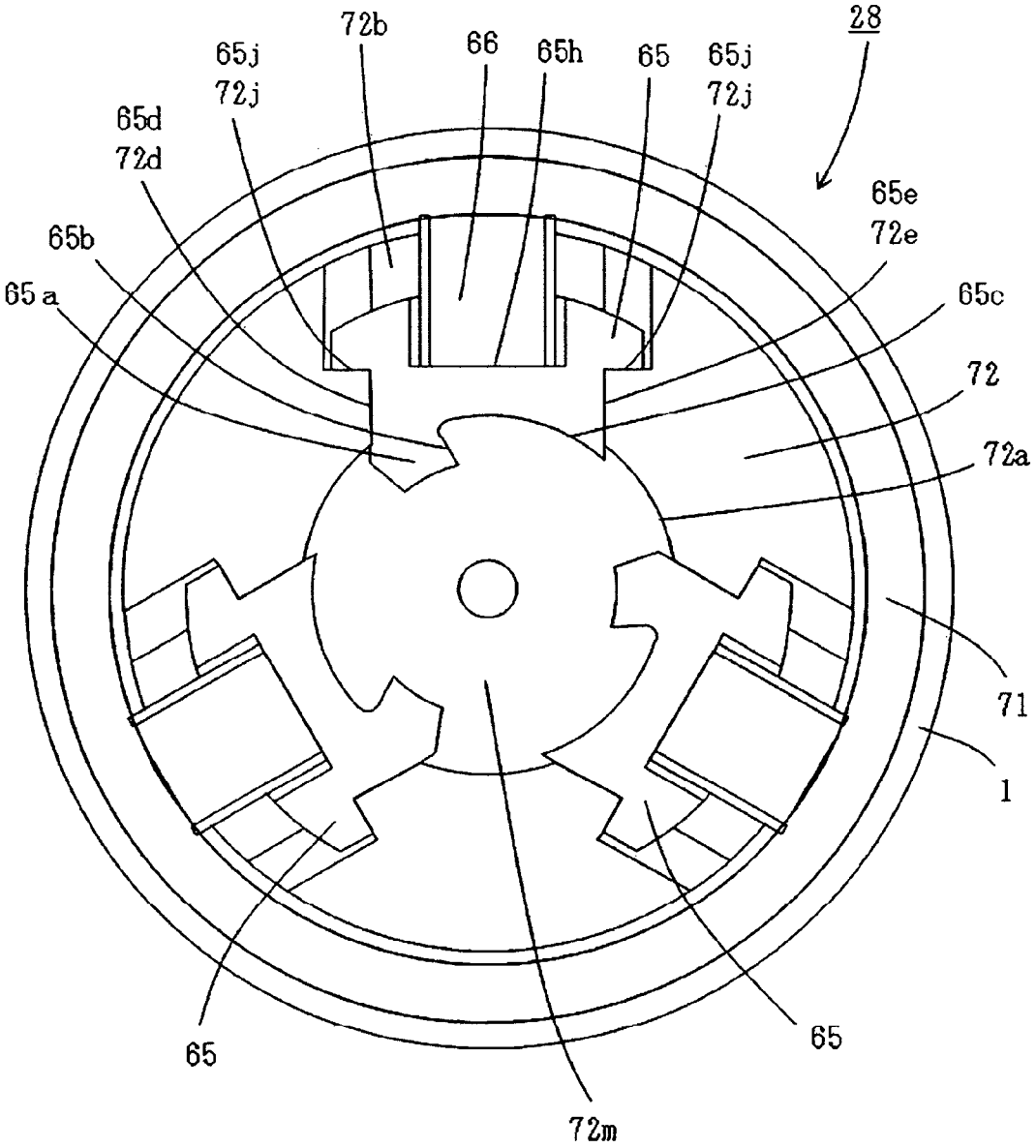

FIG. 15 is a sectional view of the coupling unit 28 taken along a plane perpendicular to the rotational axis.

Figure 16:
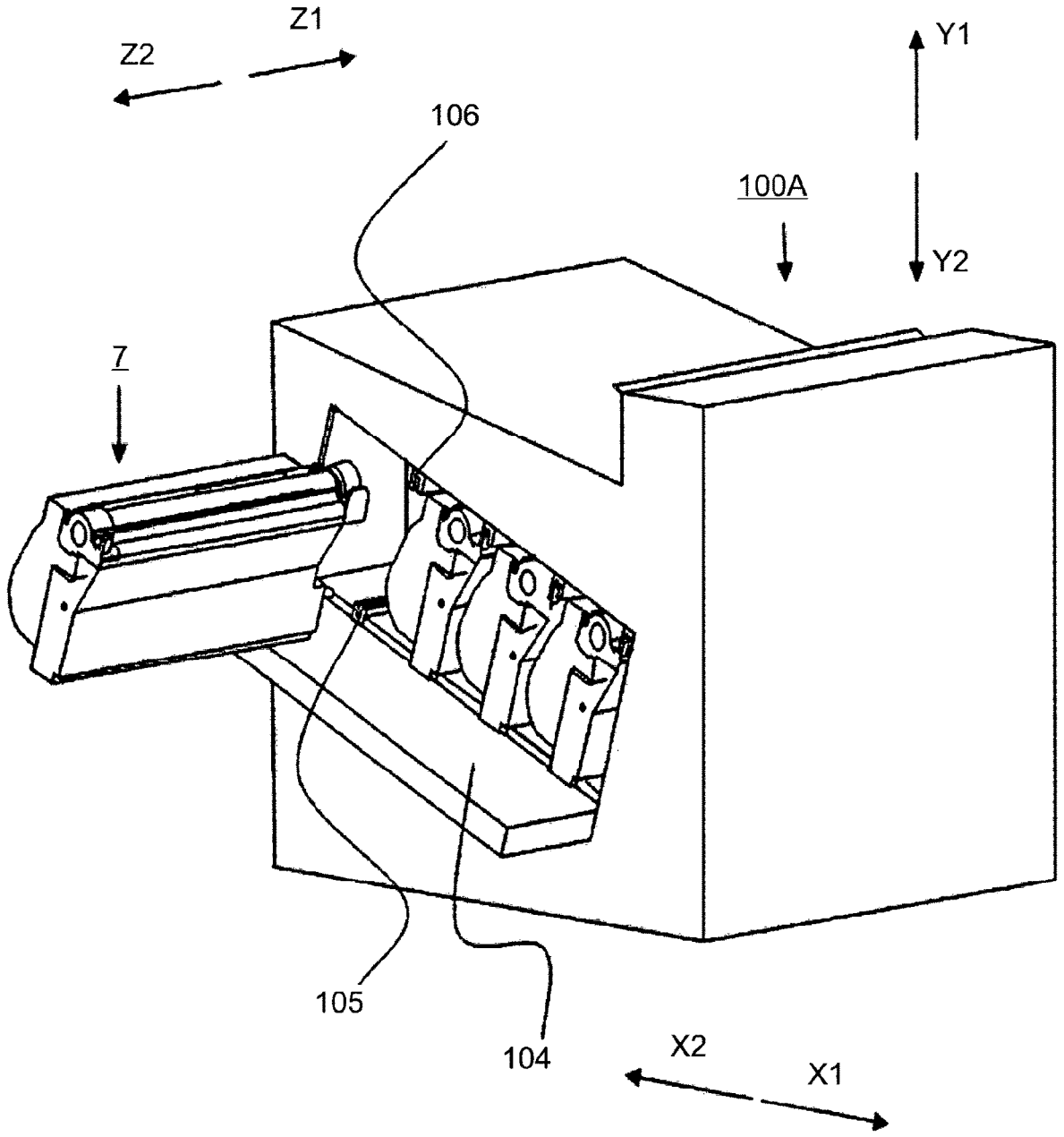

FIG. 16 is a perspective view illustrating mounting of the cartridge 7 to the image forming apparatus main assembly 100A.

Figure 17:
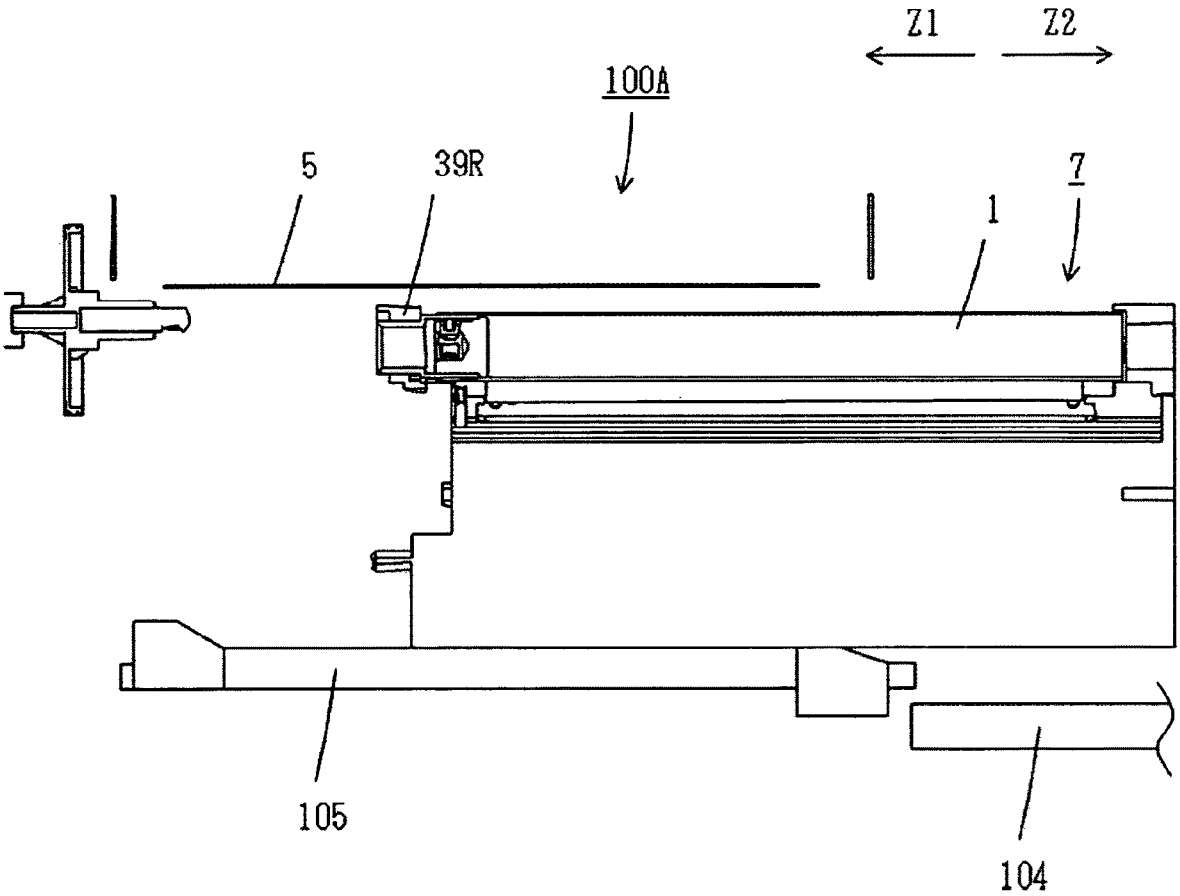

FIG. 17 is sectional views illustrating the mounting operation of the cartridge 7 to the image forming apparatus main assembly 100A.

Figure 18:
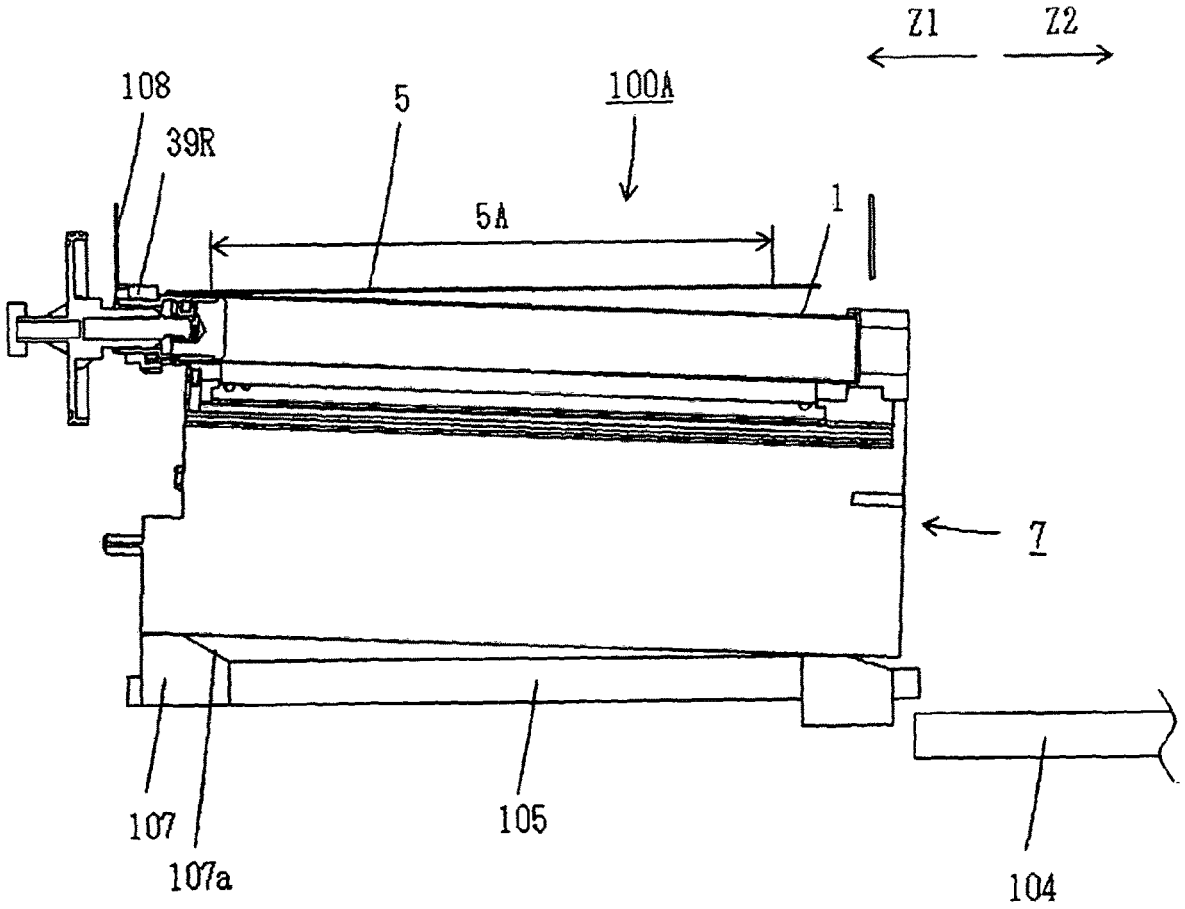

FIG. 18 is a sectional view illustrating the operation of mounting the cartridge 7 to the main assembly 100A of the image forming apparatus.

Figure 19:
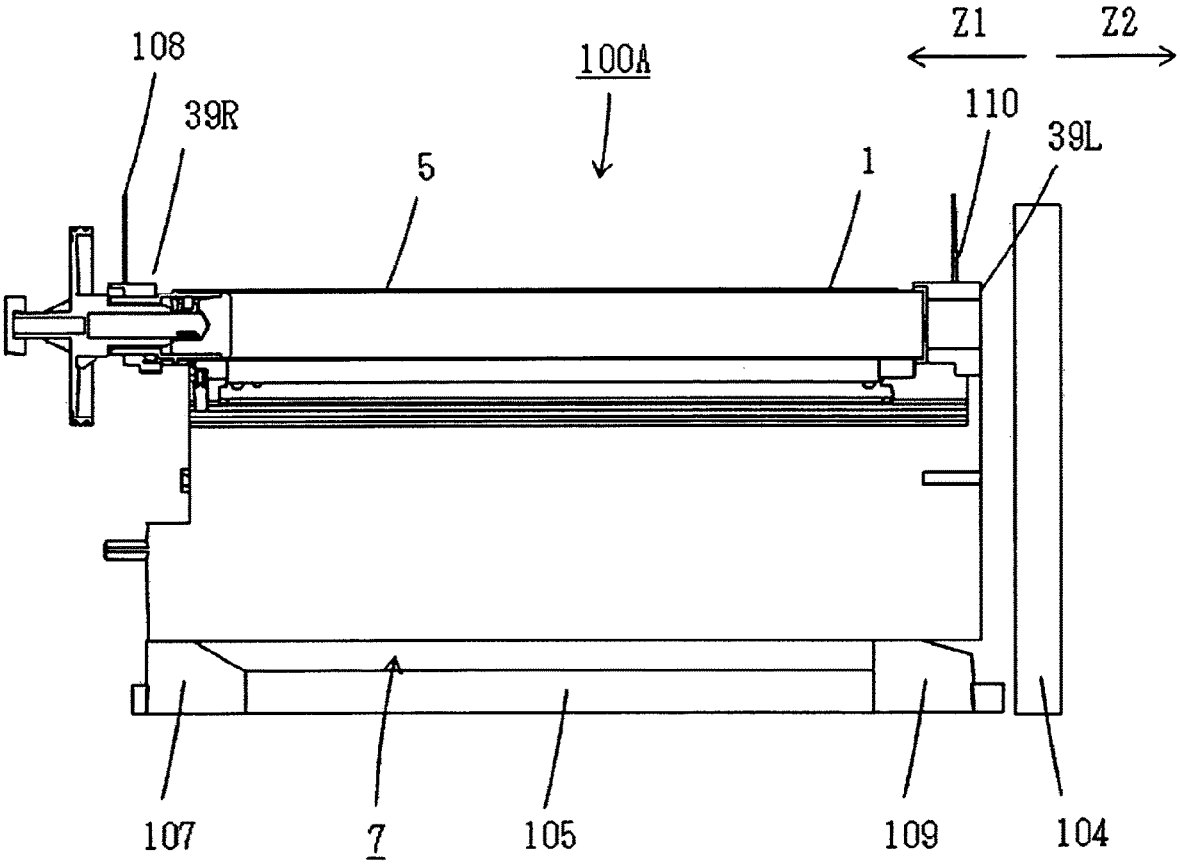

FIG. 19 is a sectional view illustrating the operation of mounting the cartridge 7 to the main assembly 100A of the image forming apparatus.

Figure 20:
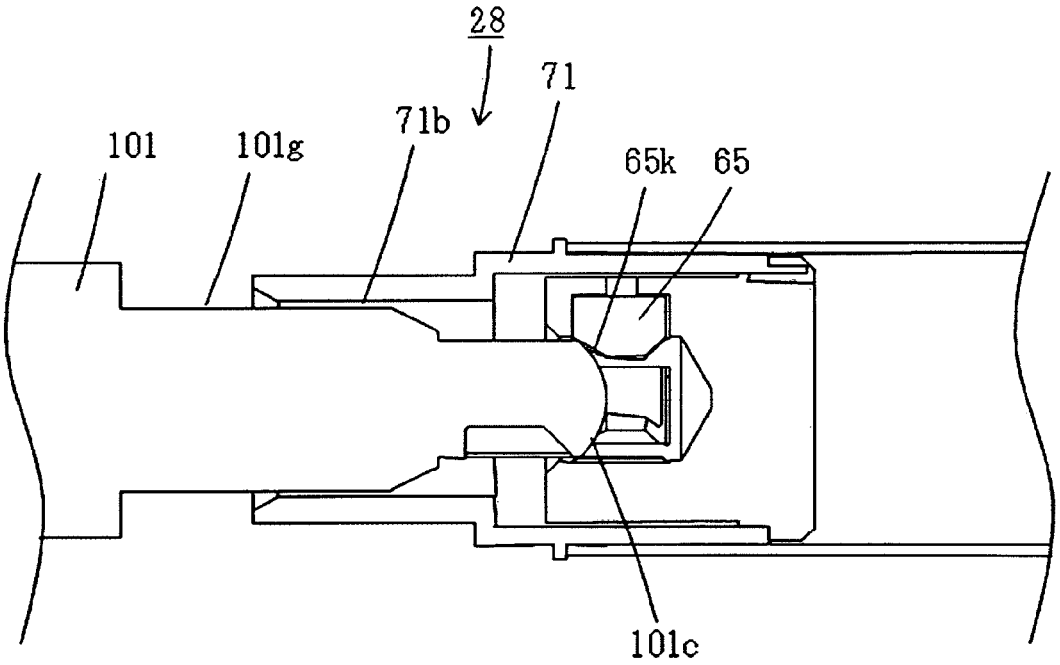

FIG. 20 is a sectional view illustrating the mounting of the coupling unit 28 to the main assembly driving shaft 101.

Figure 21:
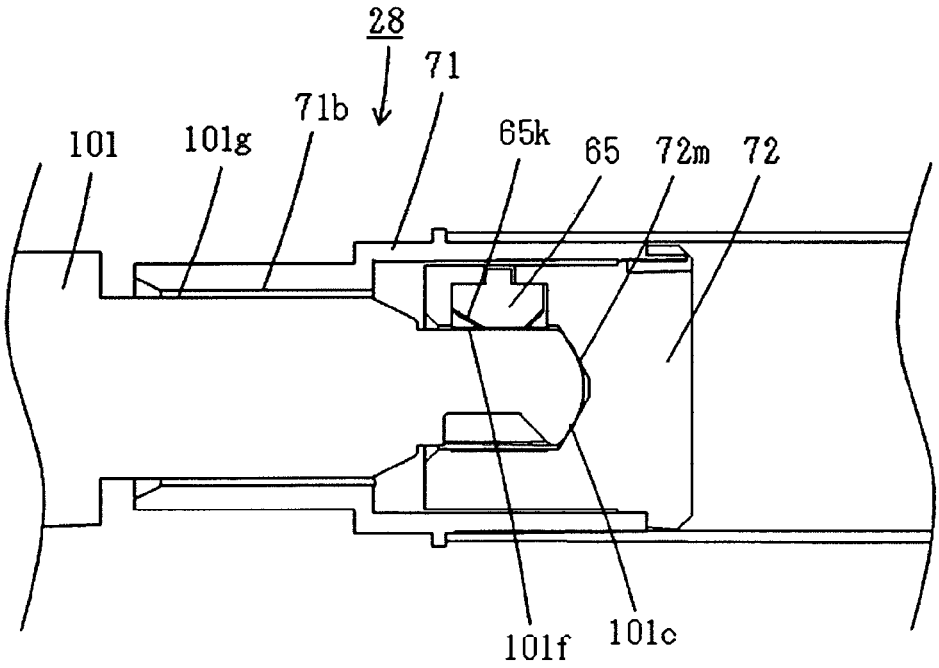

FIG. 21 is a sectional view illustrating the mounting of the coupling unit 28 to the main assembly driving shaft 101.

Figure 22:
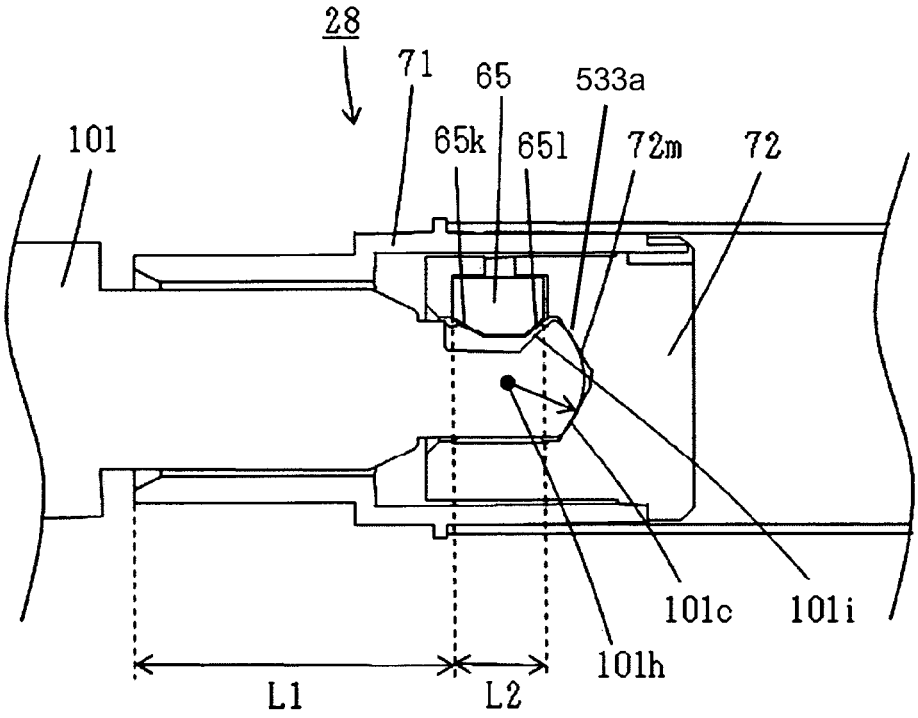

FIG. 22 is a sectional view illustrating the mounting of the coupling unit 28 to the main assembly driving shaft 101.

Figure 23:
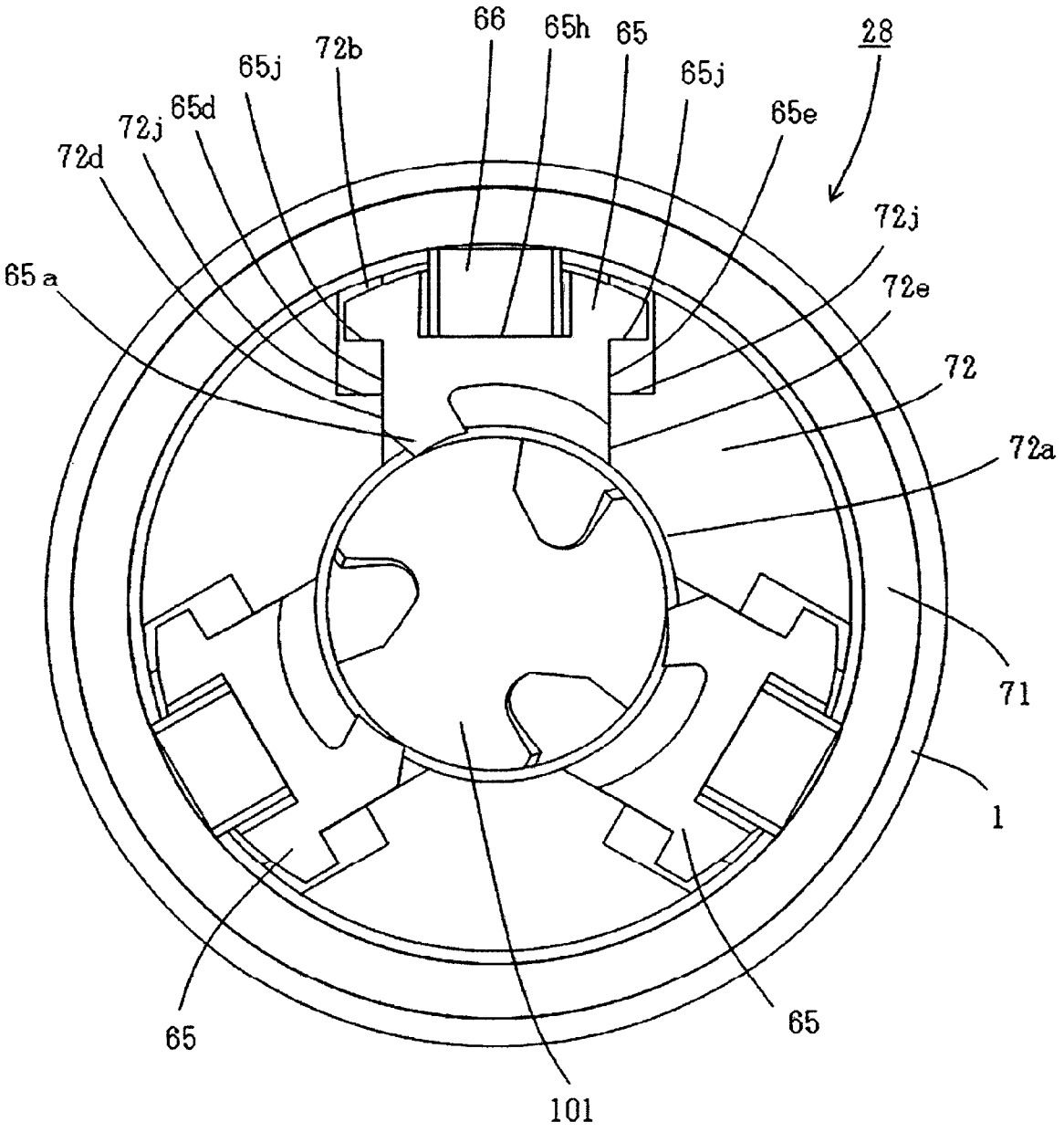

FIG. 23 is a sectional view of the coupling unit 28 and the main assembly driving shaft 101 taken along a plane perpendicular to the rotational axis.

Figure 24:
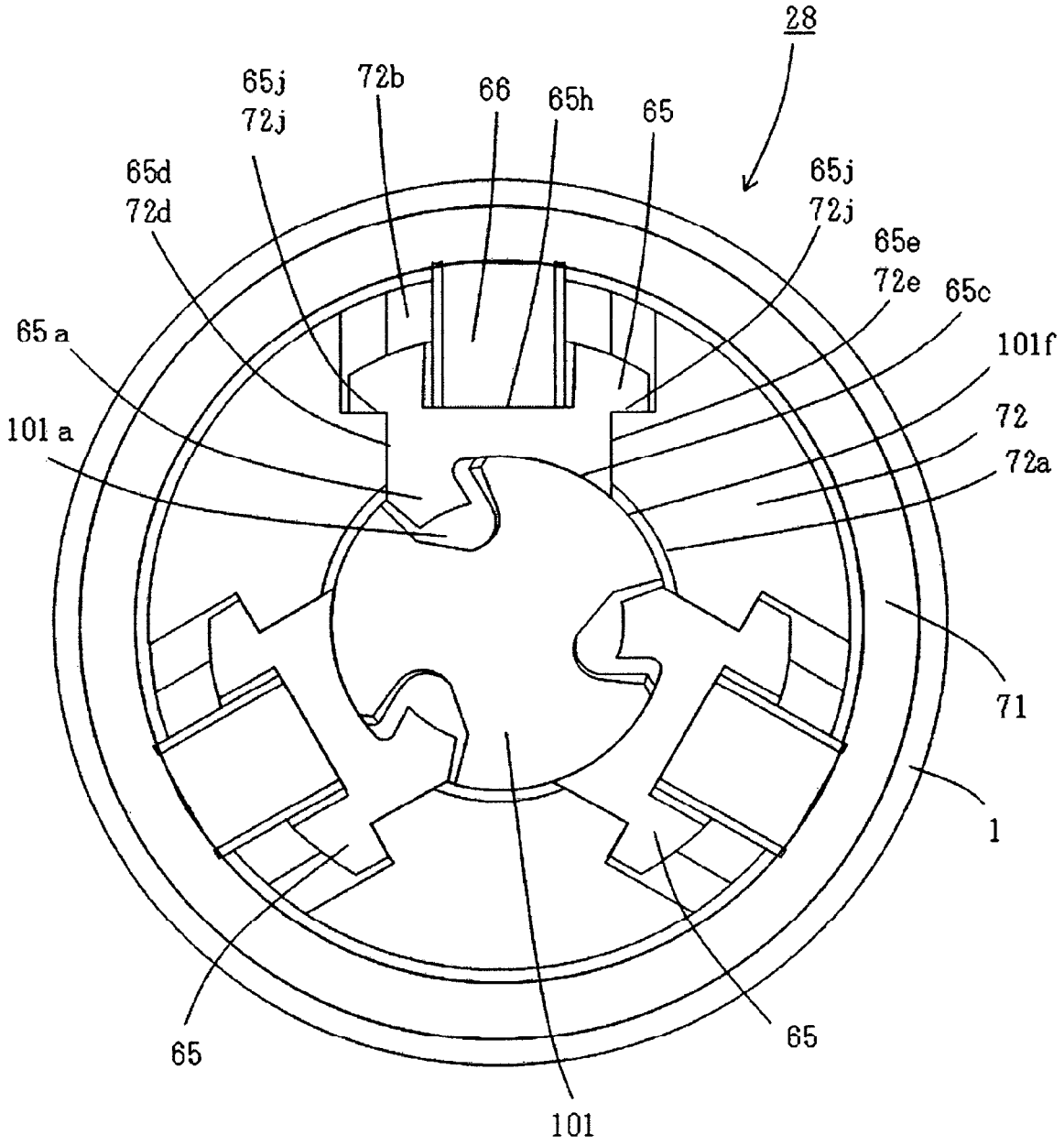

FIG. 24 is an sectional view of the coupling unit 28 and the main assembly driving shaft 101 taken along a plane perpendicular to the rotational axis.

Figure 25:
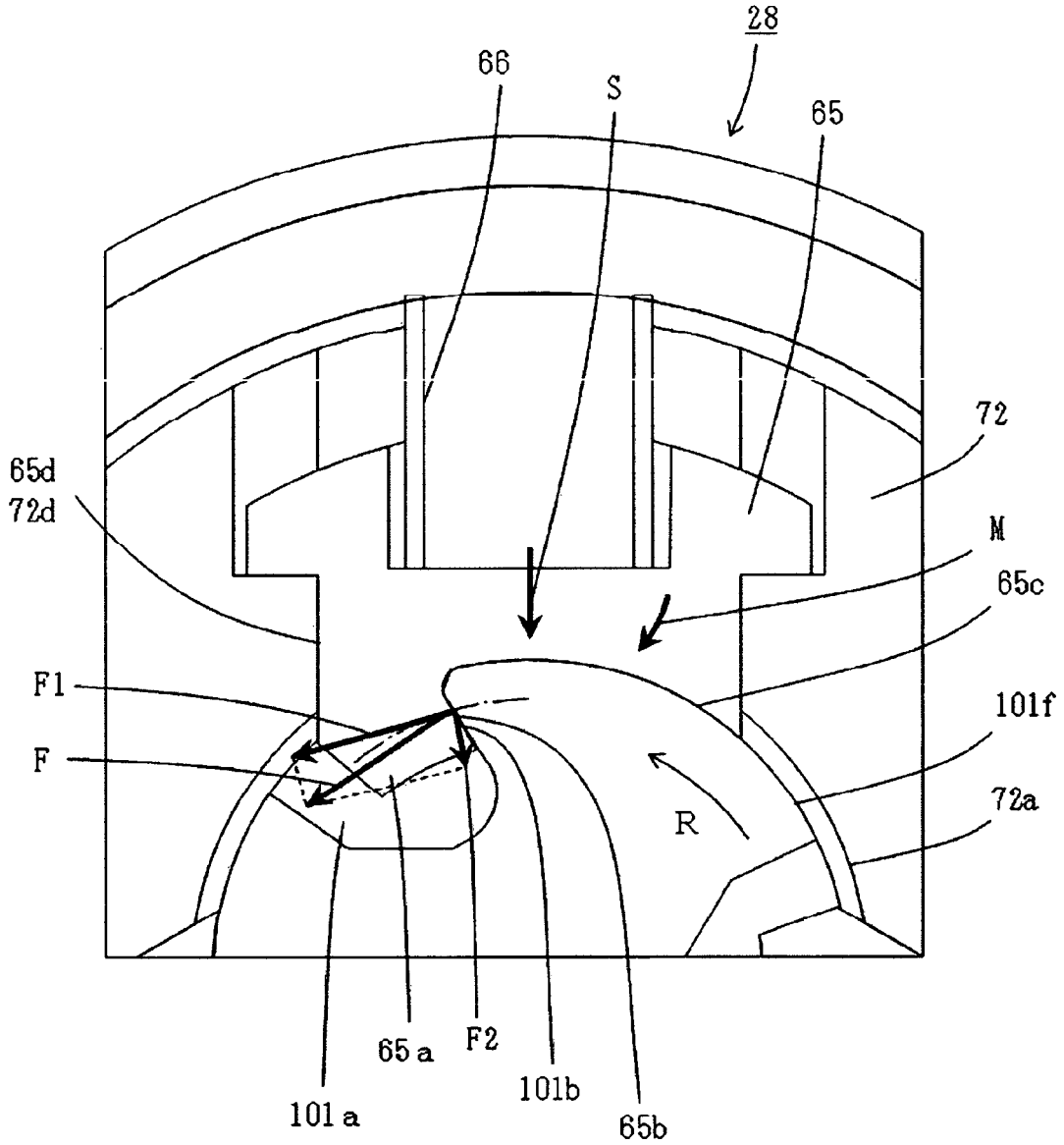
Figure 25:
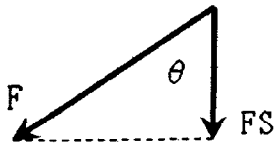

Parts (a) and (b) of FIG. 25 are sectional views of the coupling unit 28 and the main assembly driving shaft 101 taken along a plane perpendicular to the rotational axis.

Figure 26:
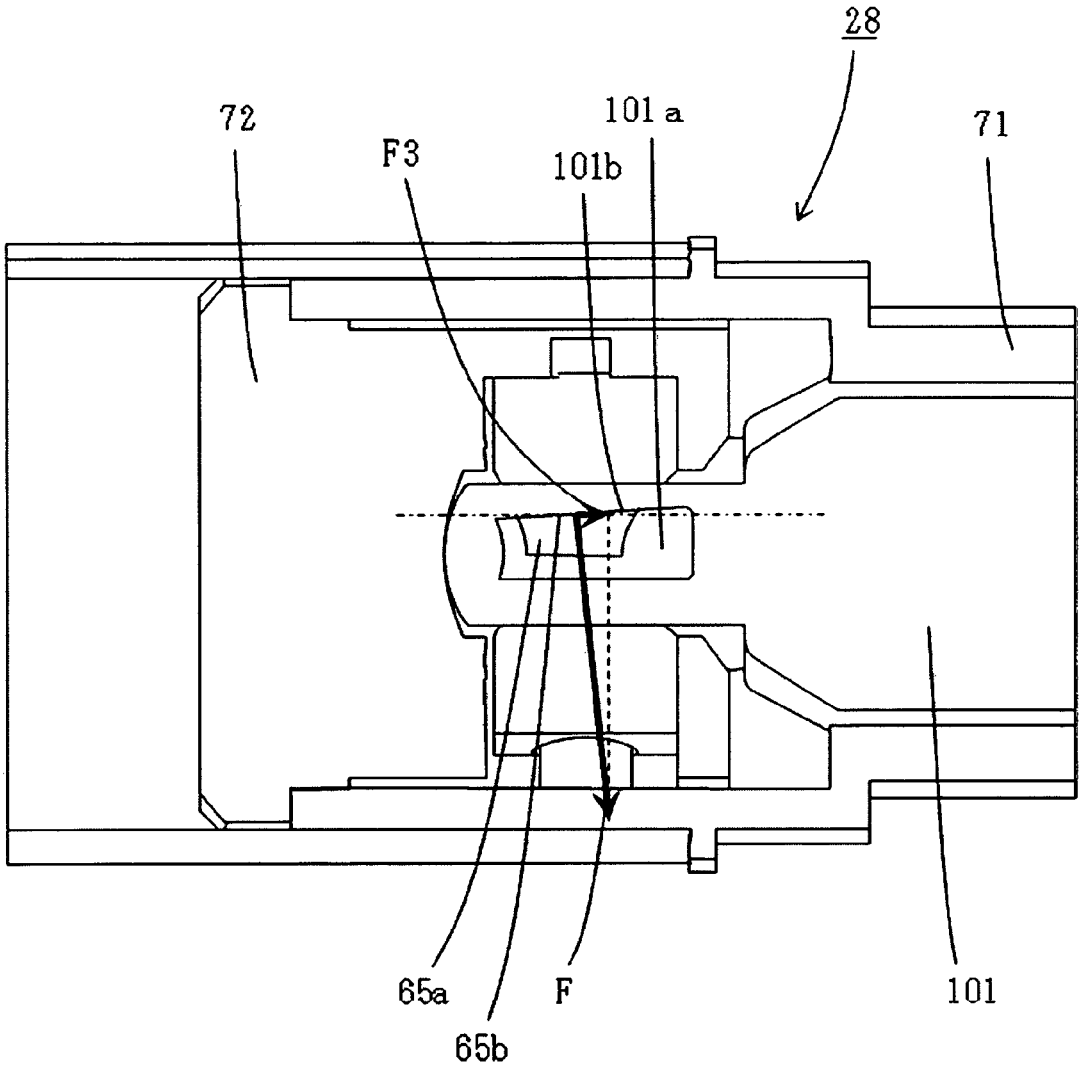

FIG. 26 is a sectional view of an engaging member 65 and a drive transmission engaging surface of the main assembly driving shaft 101.

Figure 27:
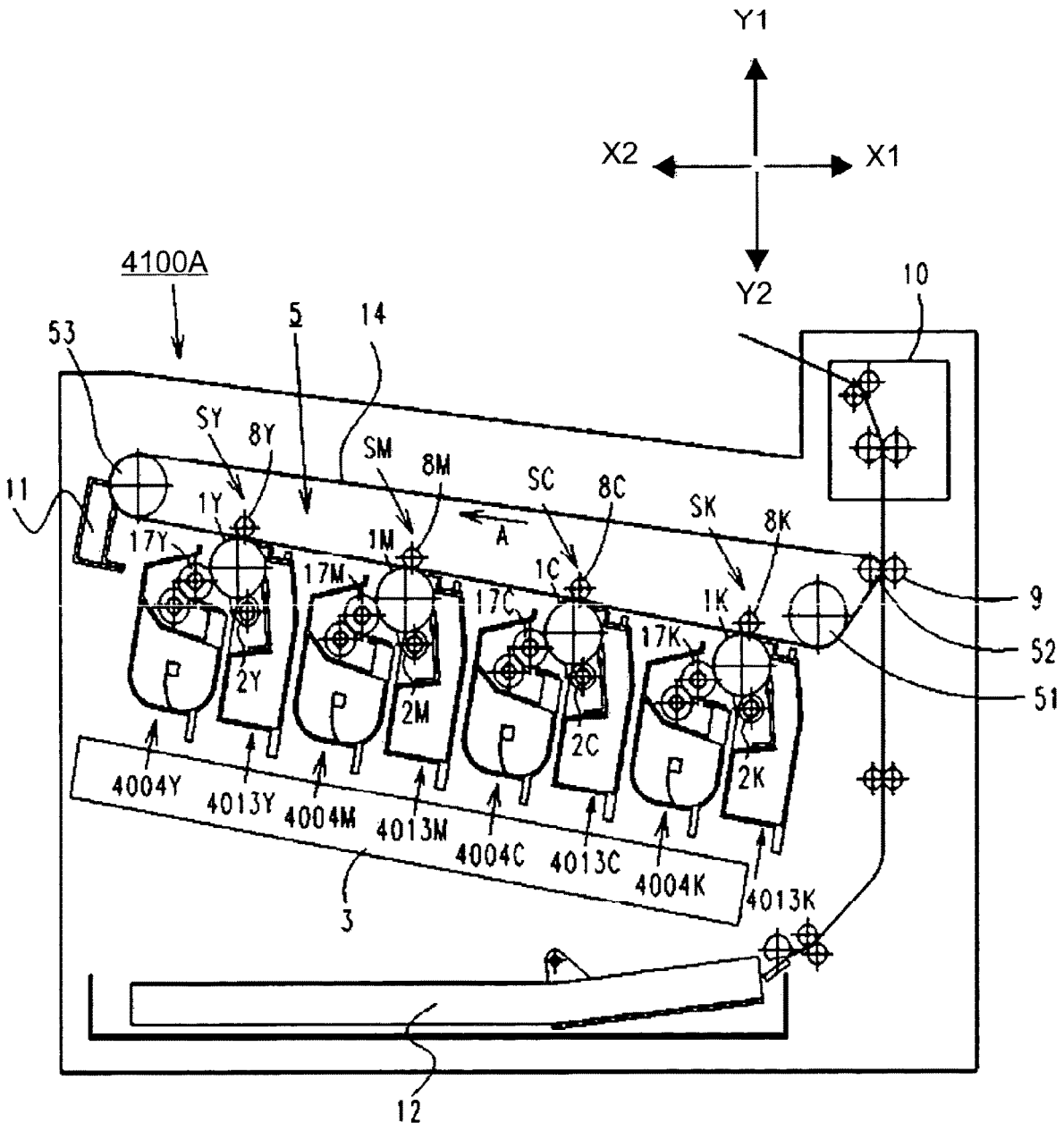

FIG. 27 is a schematic section of view of a main assembly 4100A of an image forming apparatus.

Figure 28:
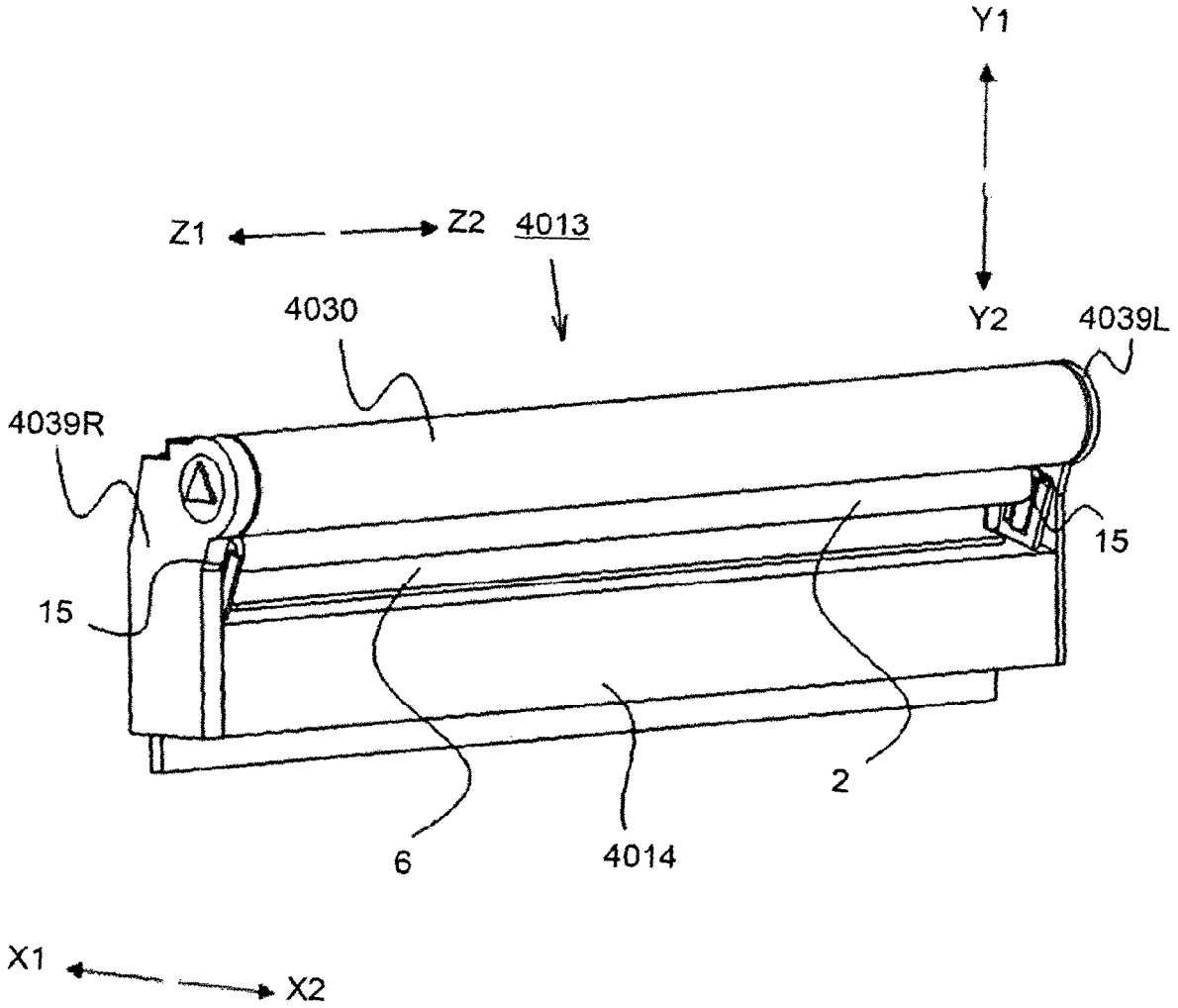

FIG. 28 shows an outer appearance of a drum cartridge 4013.

Figure 29:
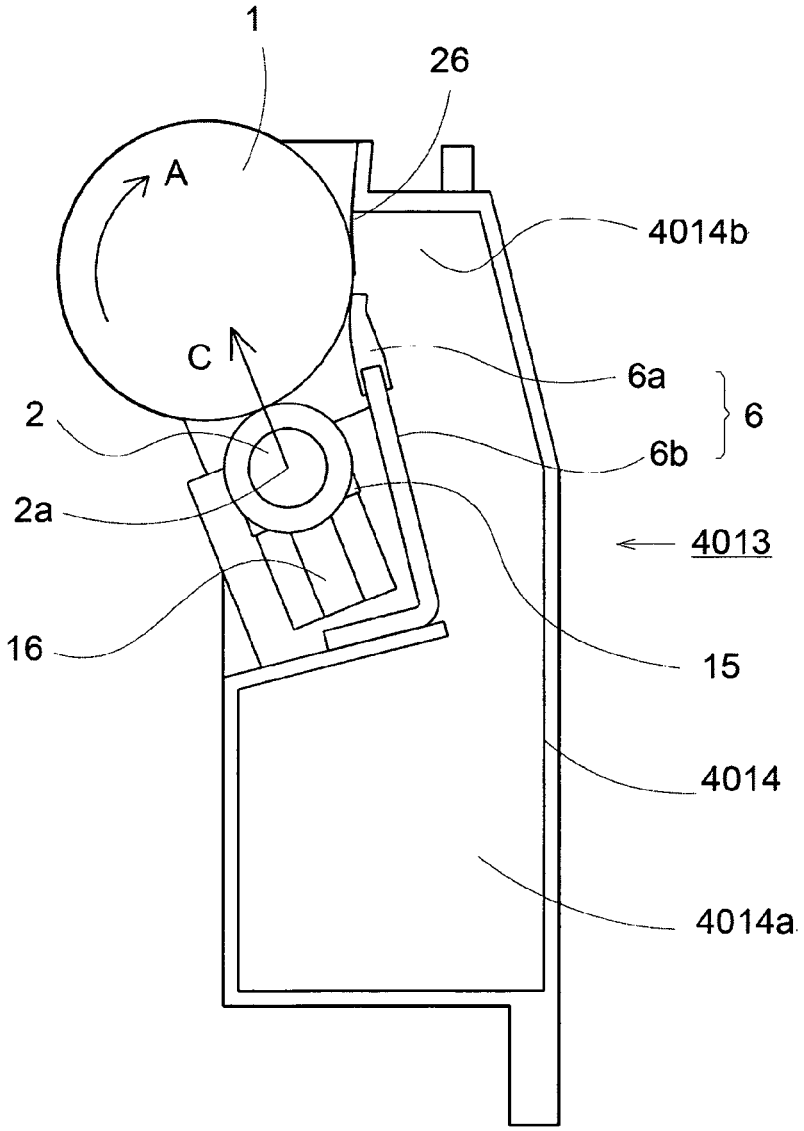

FIG. 29 is a sectional view of a drum cartridge 4013.

Figure 30:
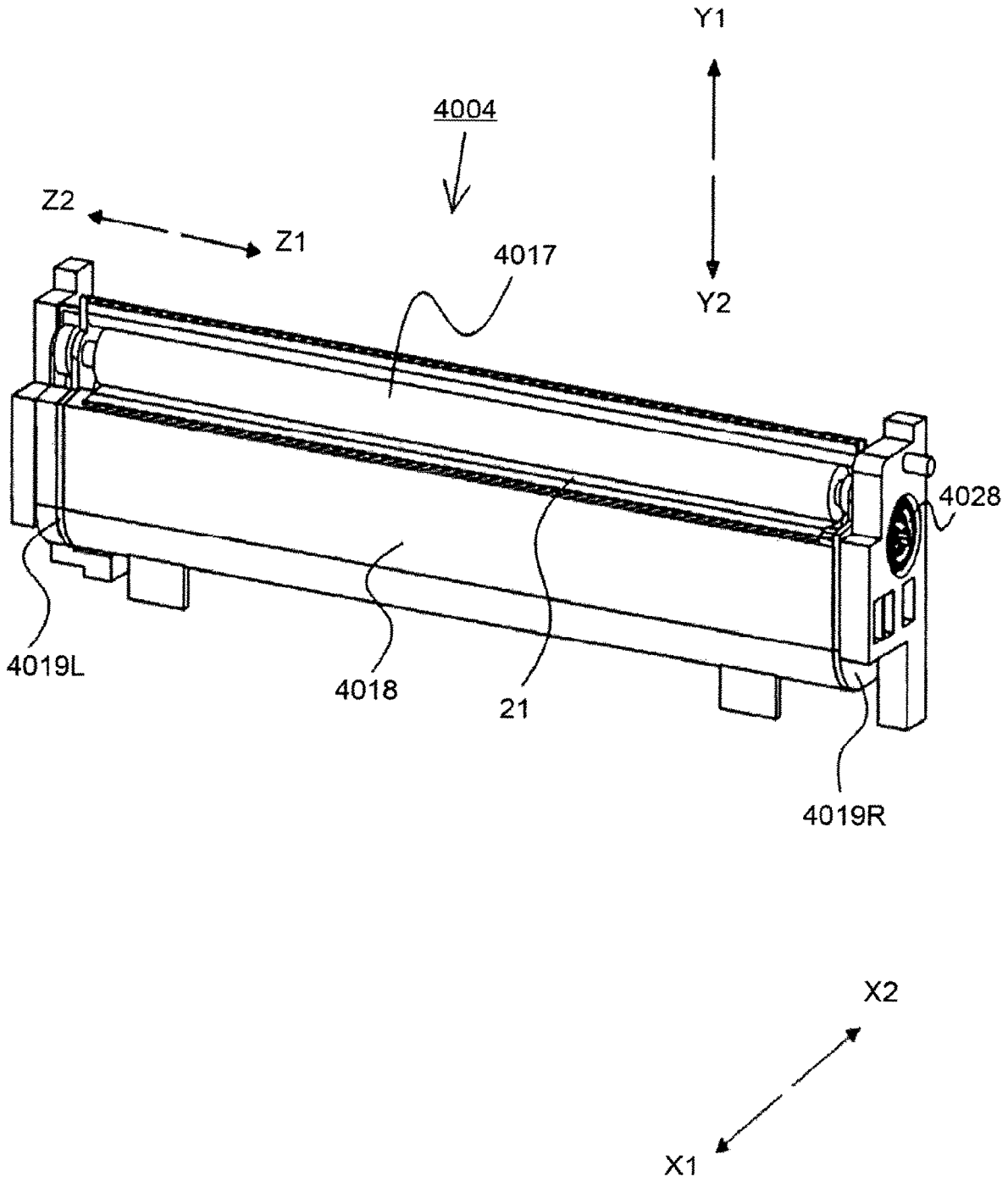

FIG. 30 shows an outer appearance of a developing cartridge 4004.

Figure 31:
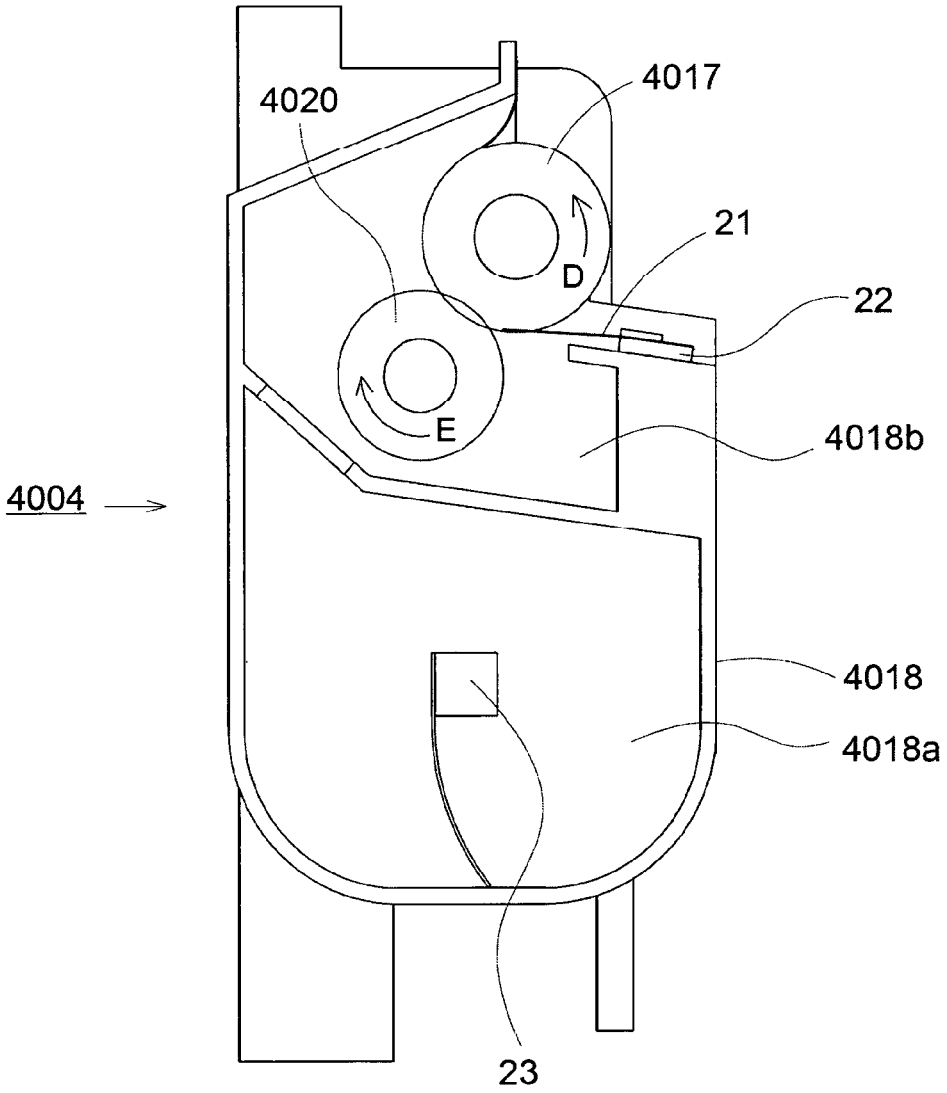

FIG. 31 is a sectional view of the developing cartridge 4004.

Figure 32:
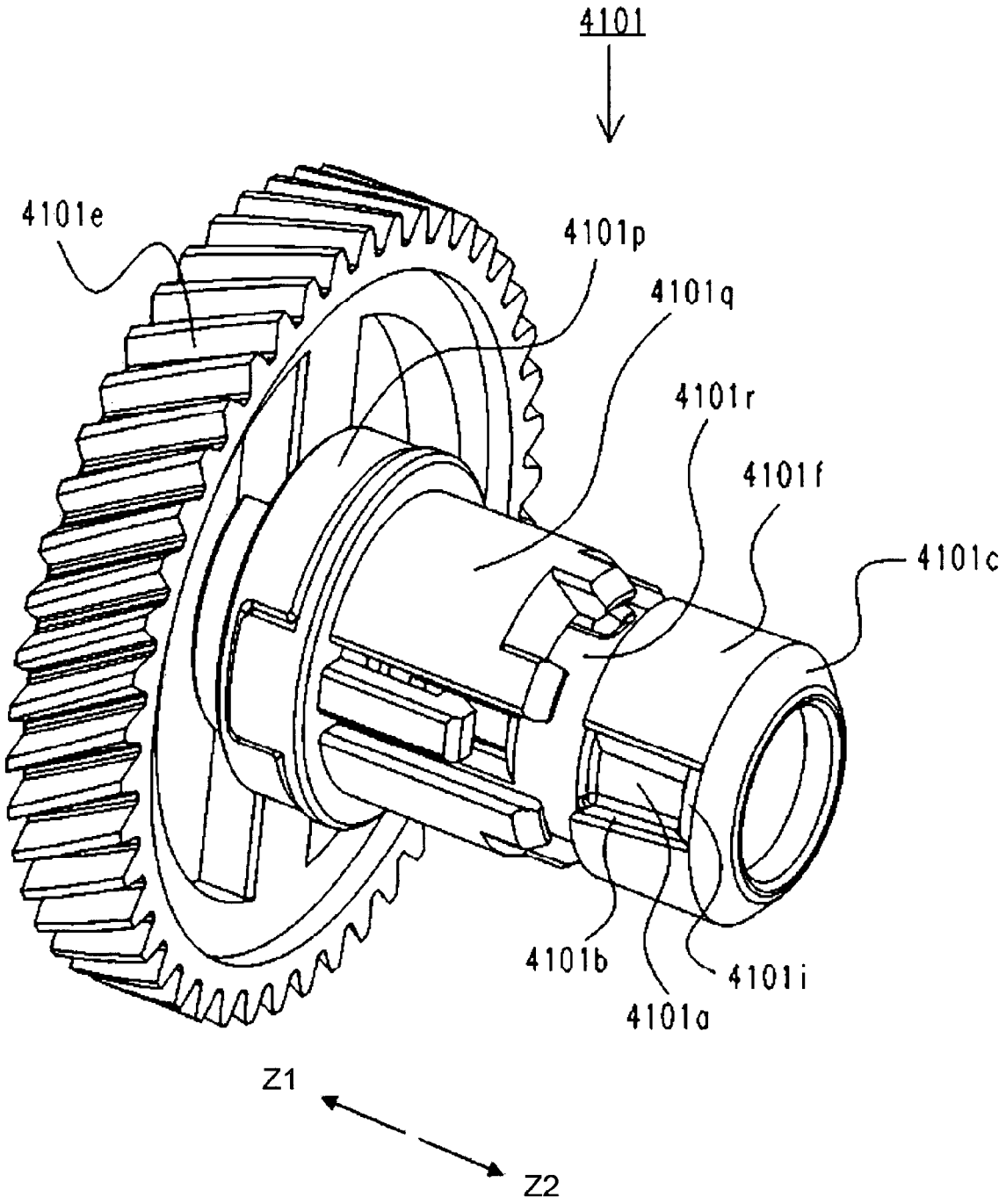

FIG. 32 is a perspective view of a main assembly driving shaft 4101.

Figure 33:
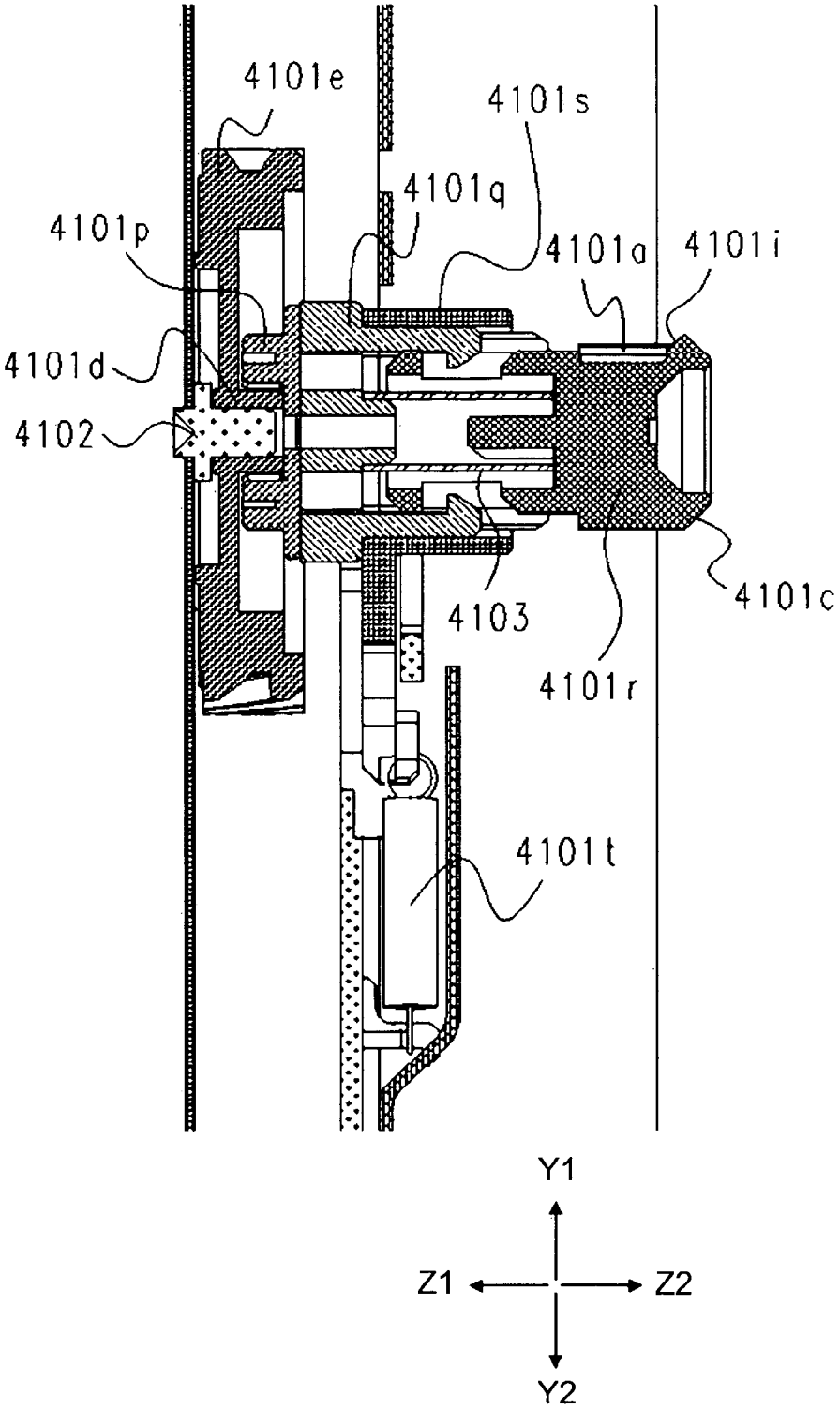

FIG. 33 is a sectional view of the main assembly driving shaft 4101.

Figure 34:
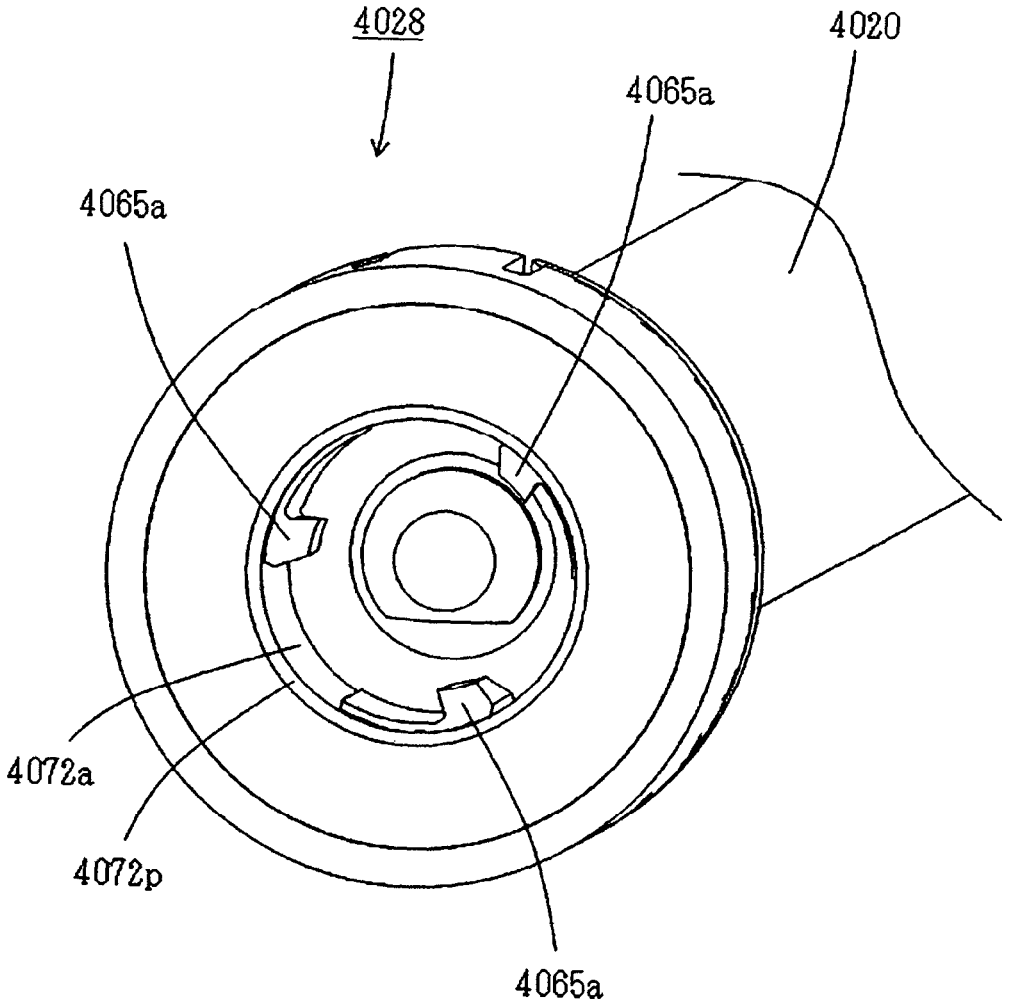

FIG. 34 is a perspective view of a coupling unit 4028.

Figure 35:
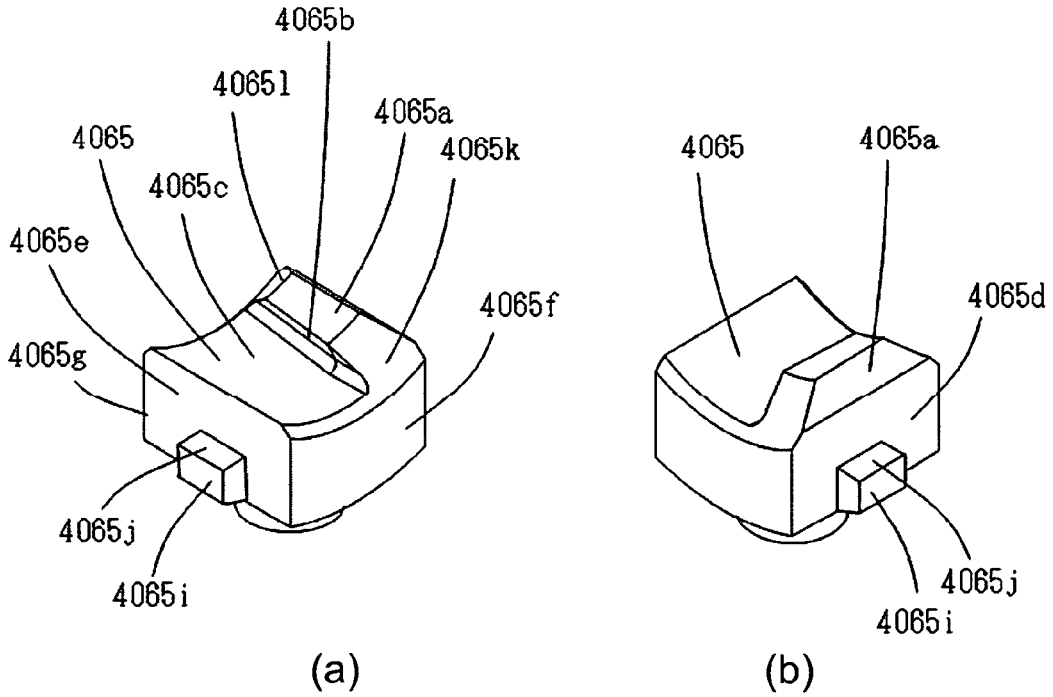

Parts (a) and (b) of FIG. 35 are perspective views of an engaging member 4065.

Figure 36:
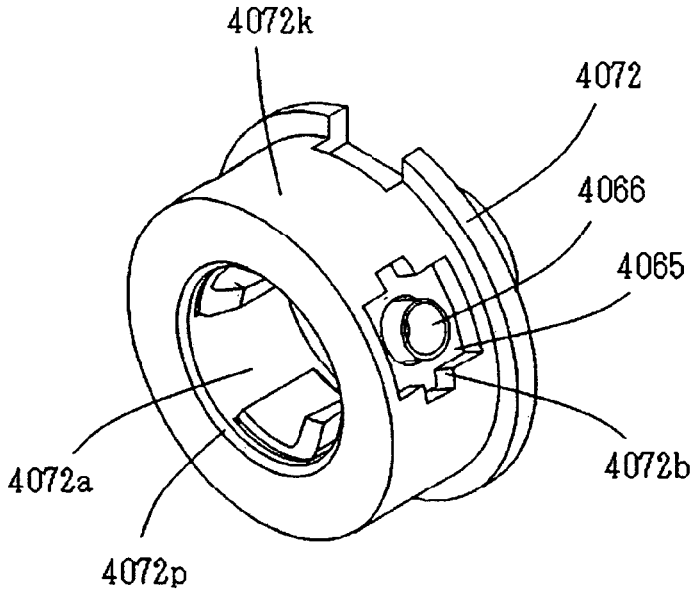
Figure 36:
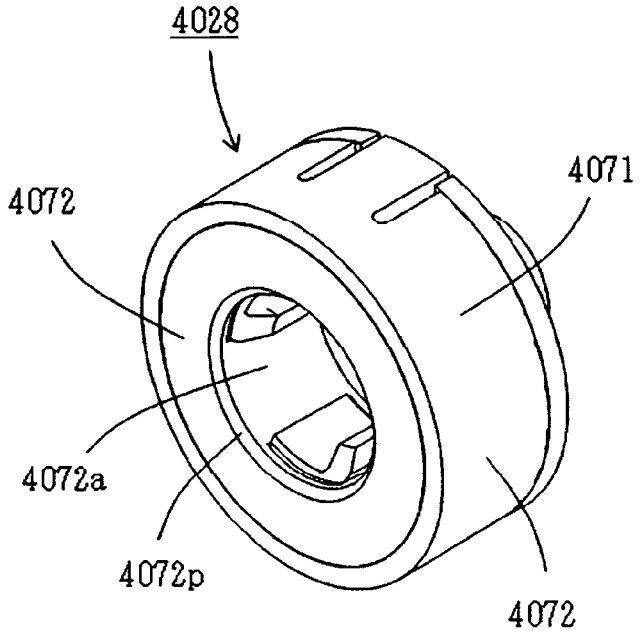

Parts (a) and (b) of FIG. 36 are perspective views of a member of the coupling unit 4028.

Figure 37:
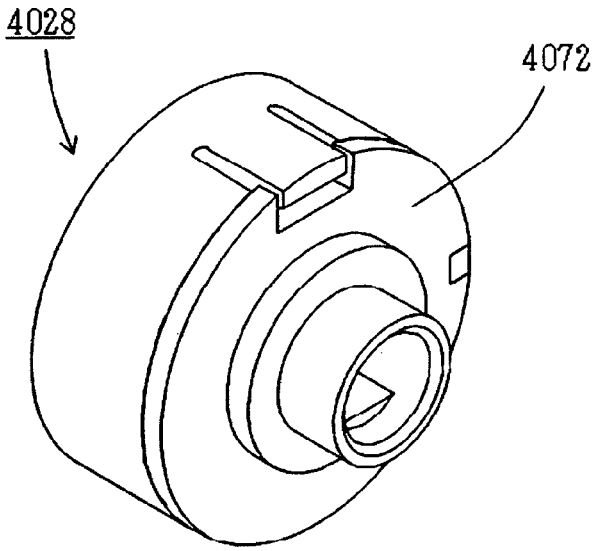
Figure 37:
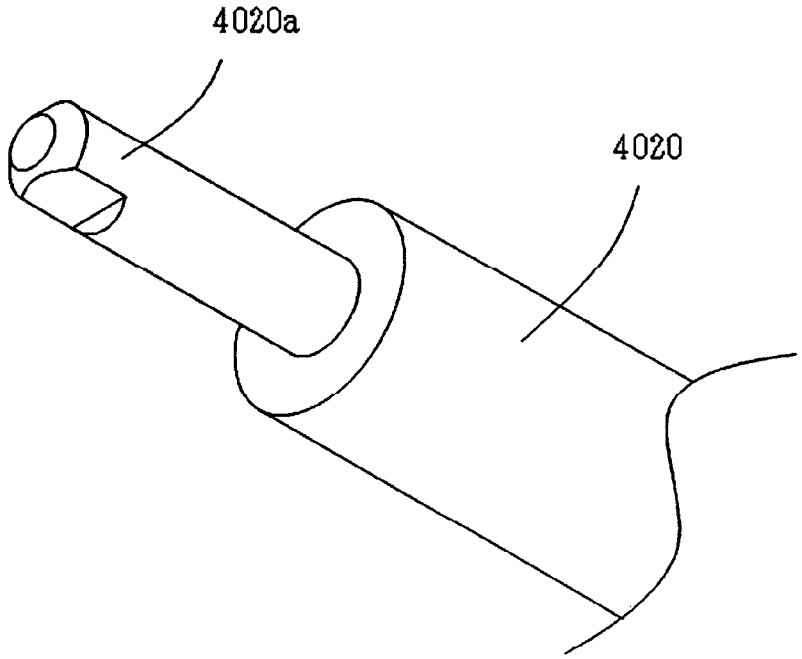

Parts (a) and (b) of FIG. 37 are perspective views of the coupling unit 4028 and a toner supplying roller 4020.

Figure 38:
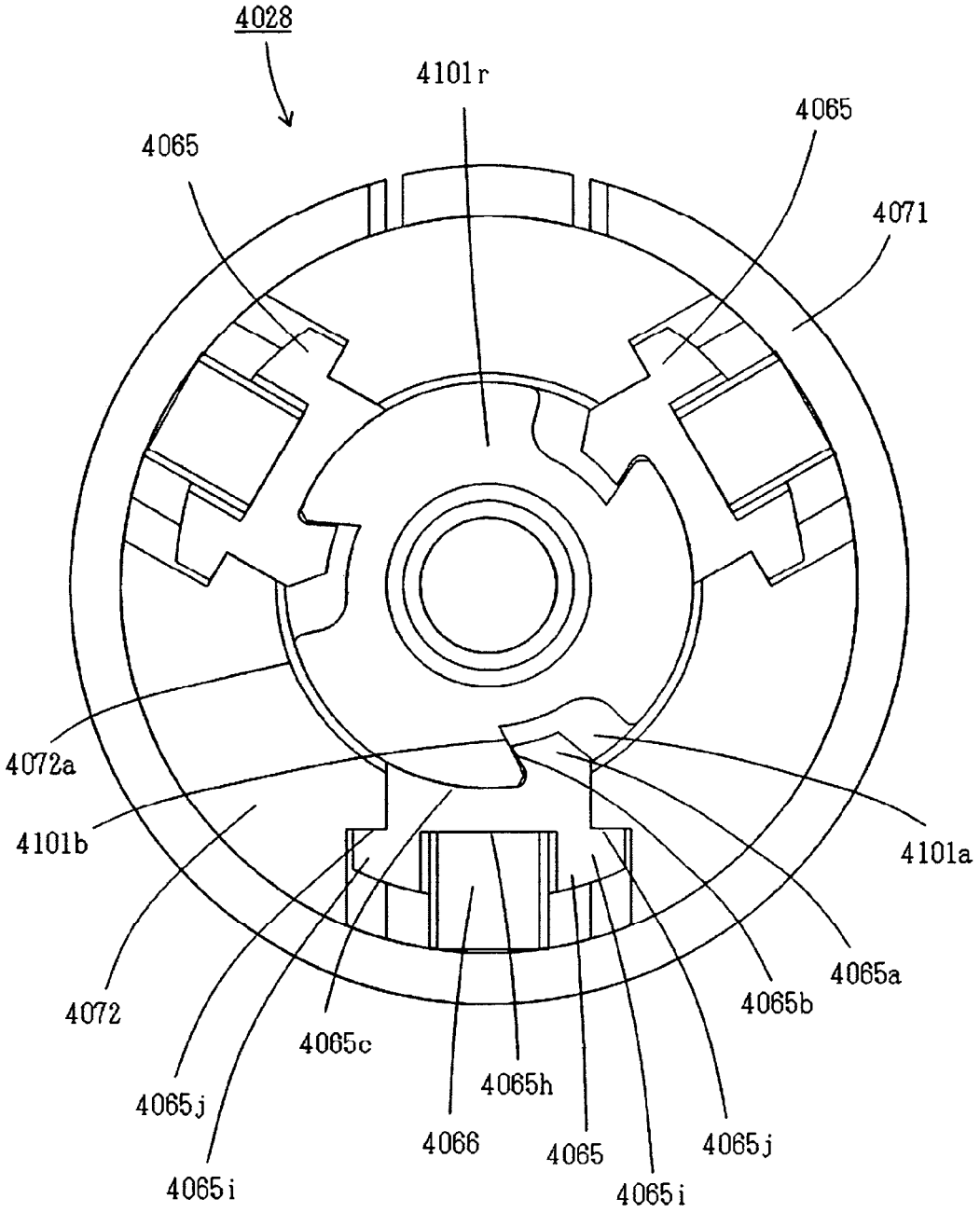

FIG. 38 is a sectional view of the coupling unit 4028 and the main assembly driving shaft 4101 taken along a plane perpendicular to the rotational axis.

Figure 39:
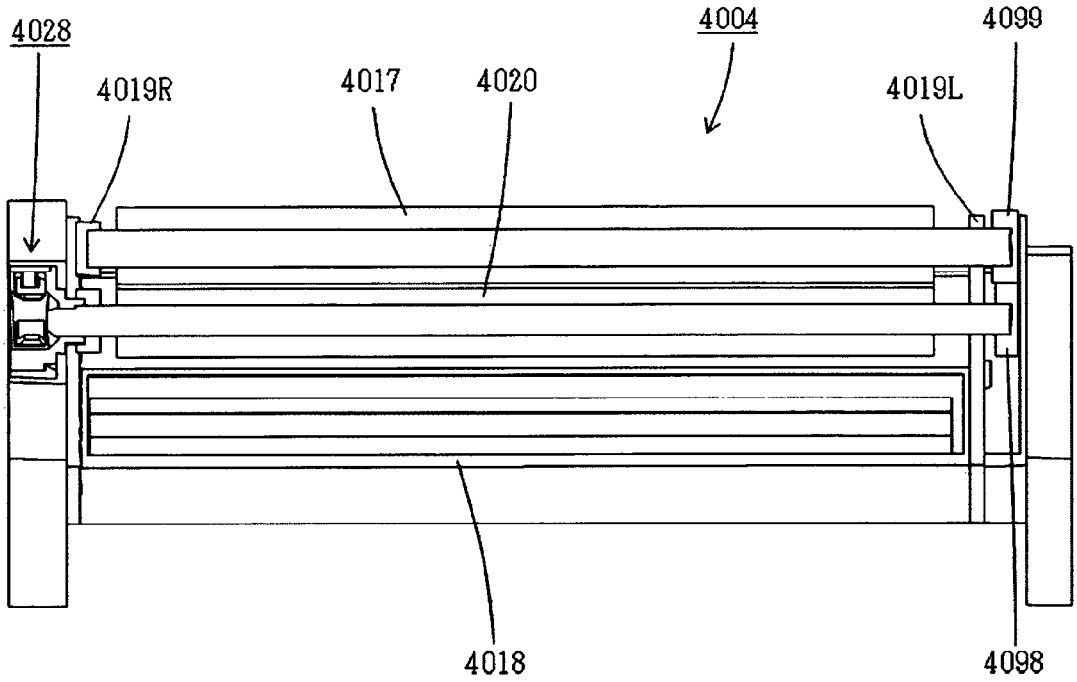

FIG. 39 is a sectional view of a developing cartridge 4004.

Figure 40:
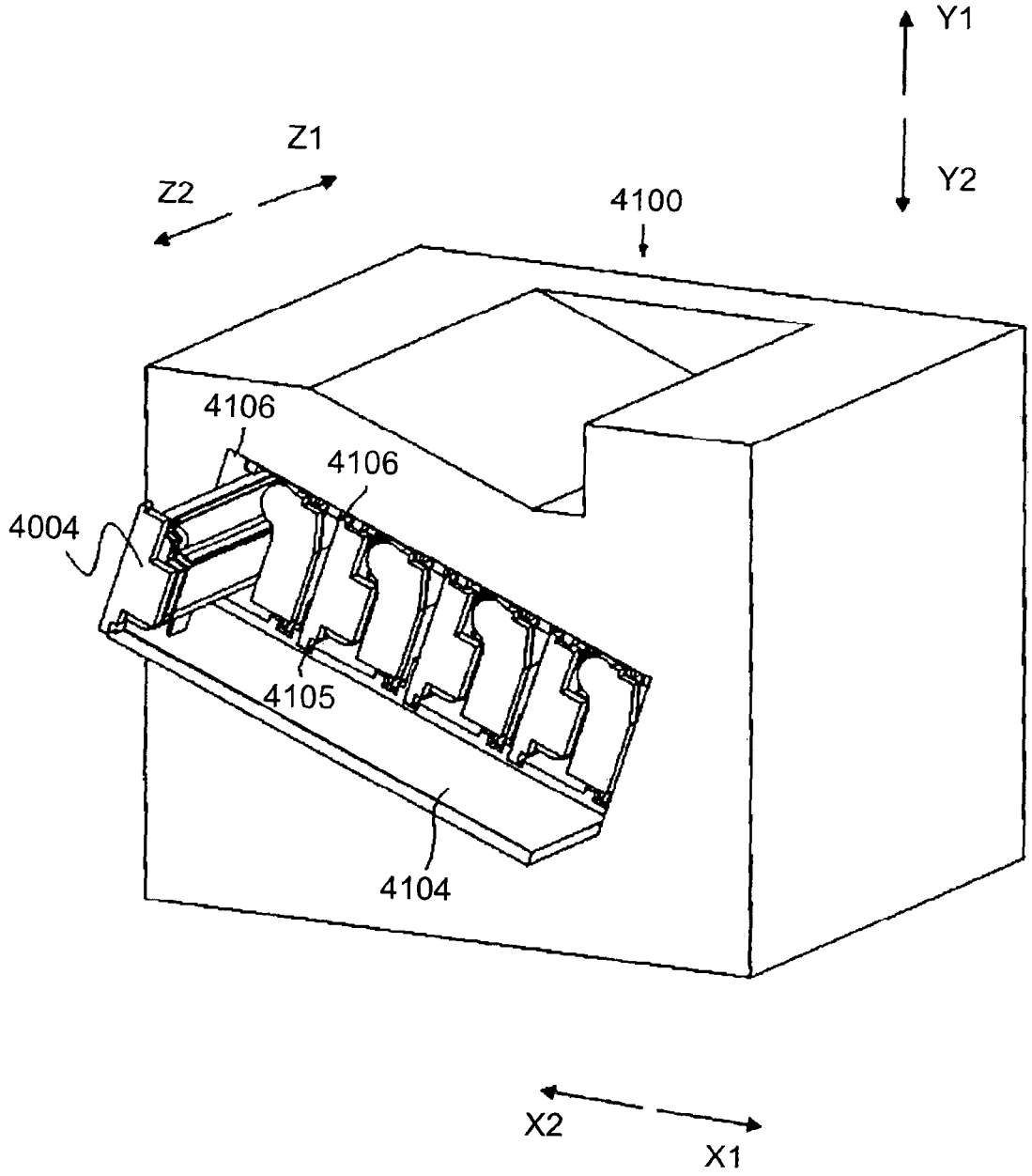

FIG. 40 is a perspective view illustrating the mounting of the developing cartridge 4004 to the main assembly 4100 of the image forming apparatus.

Figure 41:
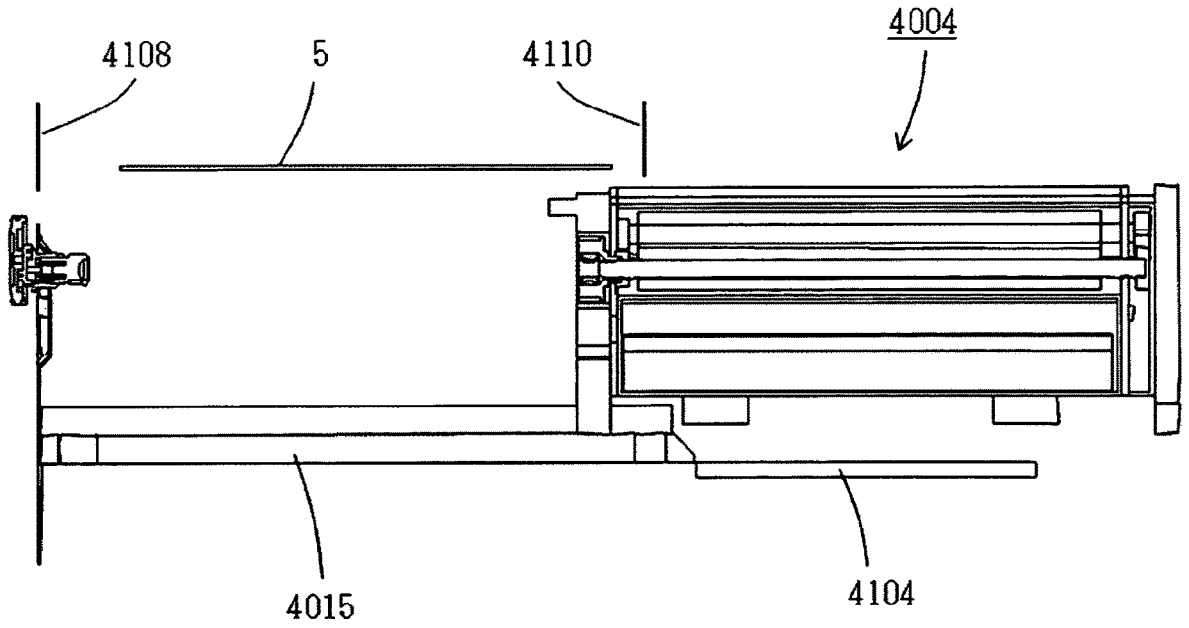

FIG. 41 is a sectional view illustrating the mounting of the developing cartridge 4004 to the main assembly 4100 of the image forming apparatus.

Figure 42:
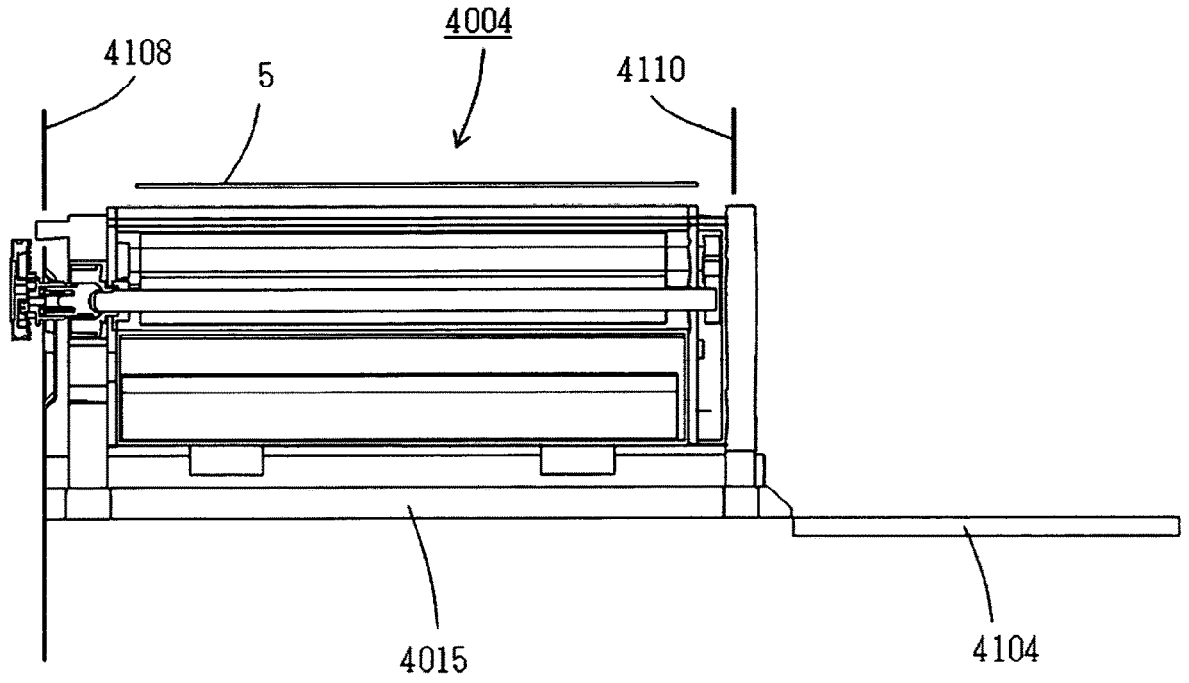

FIG. 42 is a sectional view illustrating the mounting of the developing cartridge 4004 to the main assembly 4100 of the image forming apparatus.

Figure 43:
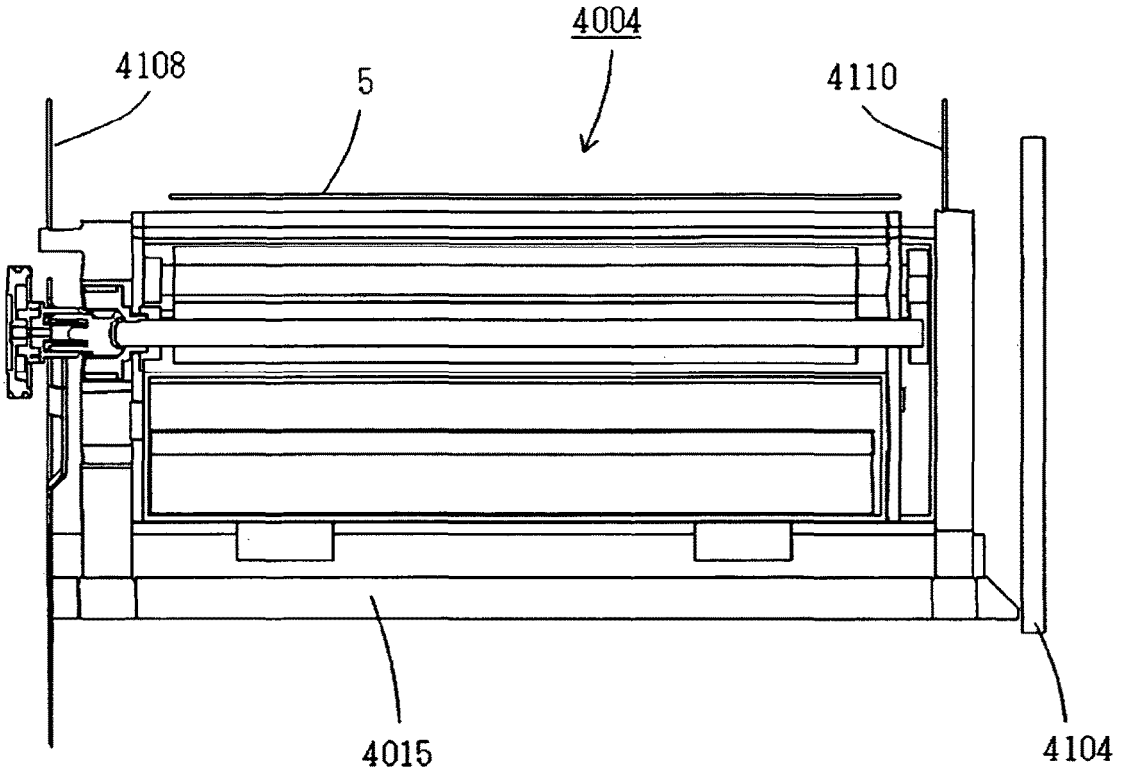

FIG. 43 is a sectional view illustrating the mounting of the developing cartridge 4004 to the main assembly 4100 of the image forming apparatus.

Figure 44:
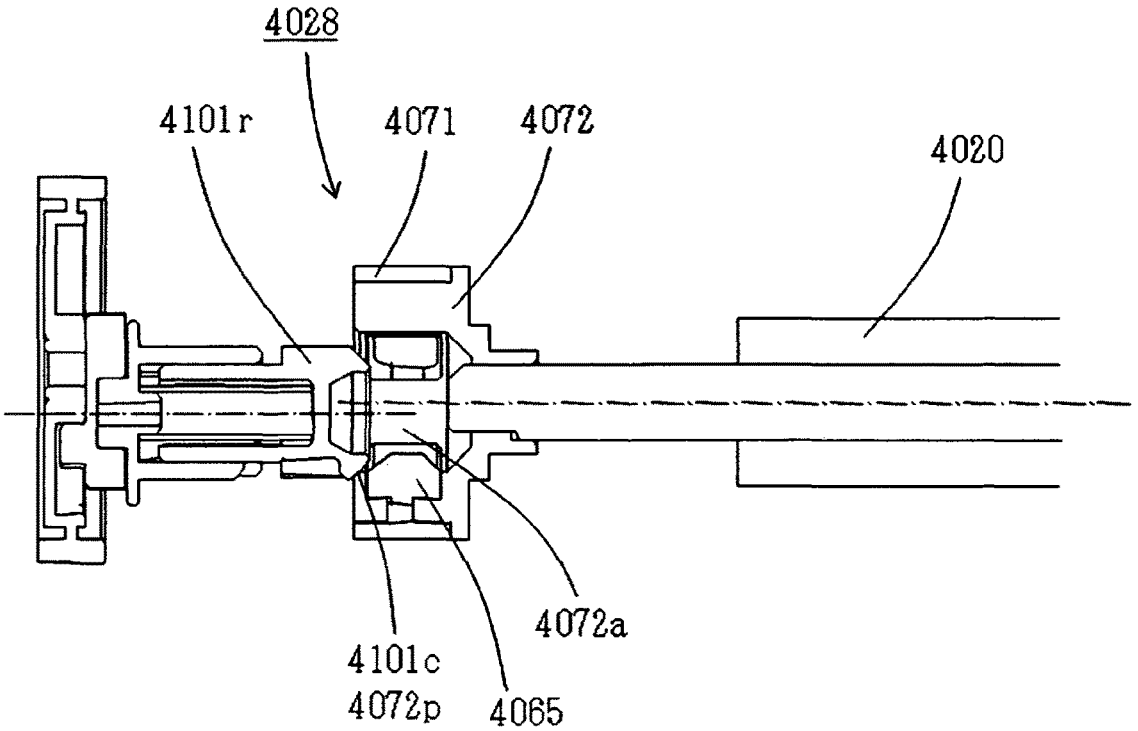

FIG. 44 is a sectional view illustrating the mounting of the coupling unit 4028 to the main assembly driving shaft 4101.

Figure 45:
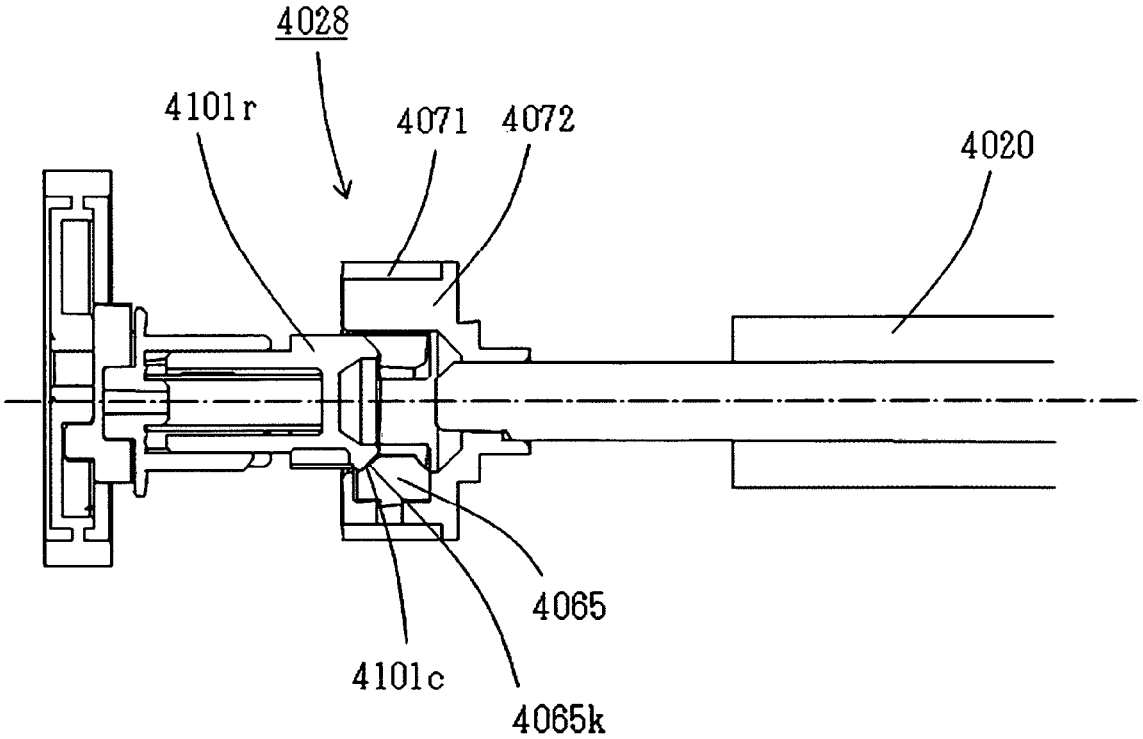

FIG. 45 is a sectional view illustrating the mounting of the coupling unit 4028 to the main assembly driving shaft 4101.

Figure 46:
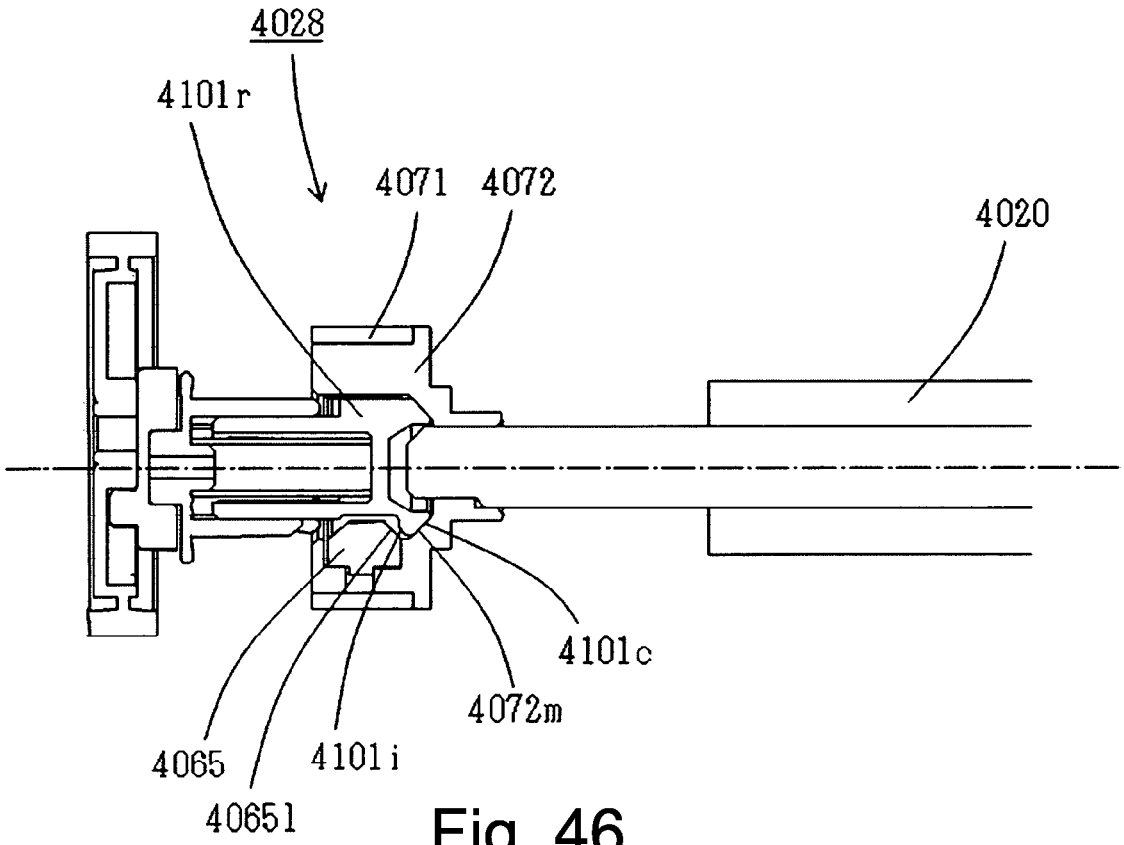

FIG. 46 is a sectional view illustrating the mounting of the coupling unit 4028 to the main assembly driving shaft 4101.

Figure 47:
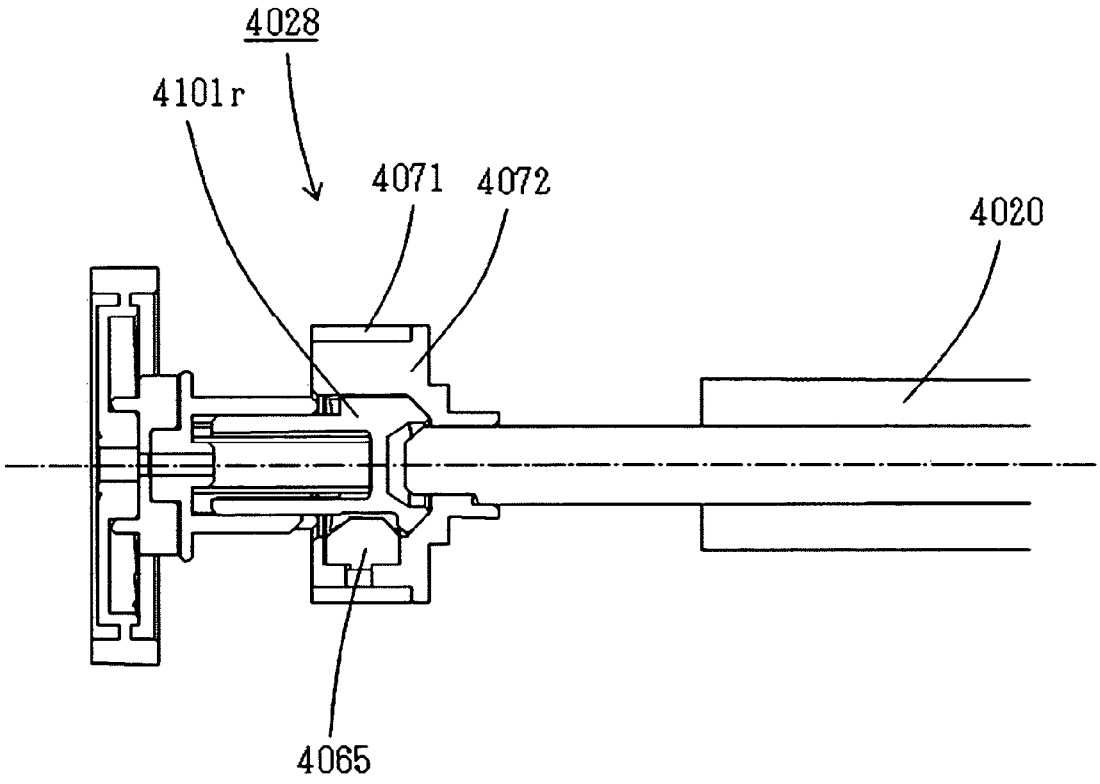

FIG. 47 is a sectional view illustrating the mounting of the coupling unit 4028 to the main assembly driving shaft 4101.

Figure 48:
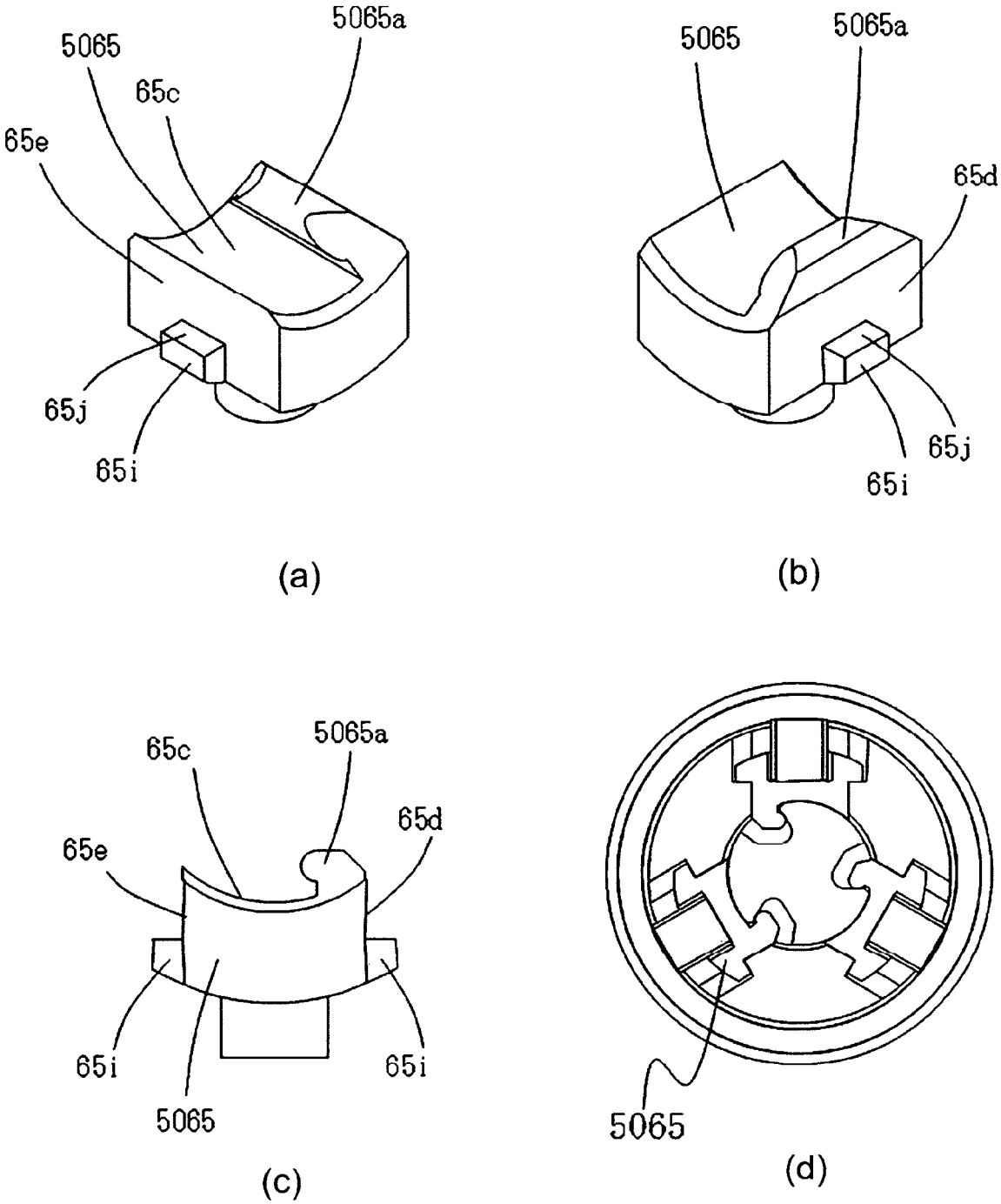

Parts (a), (b), (c) and (d) of FIG. 48 are illustrations of an engaging member.

Figure 49:
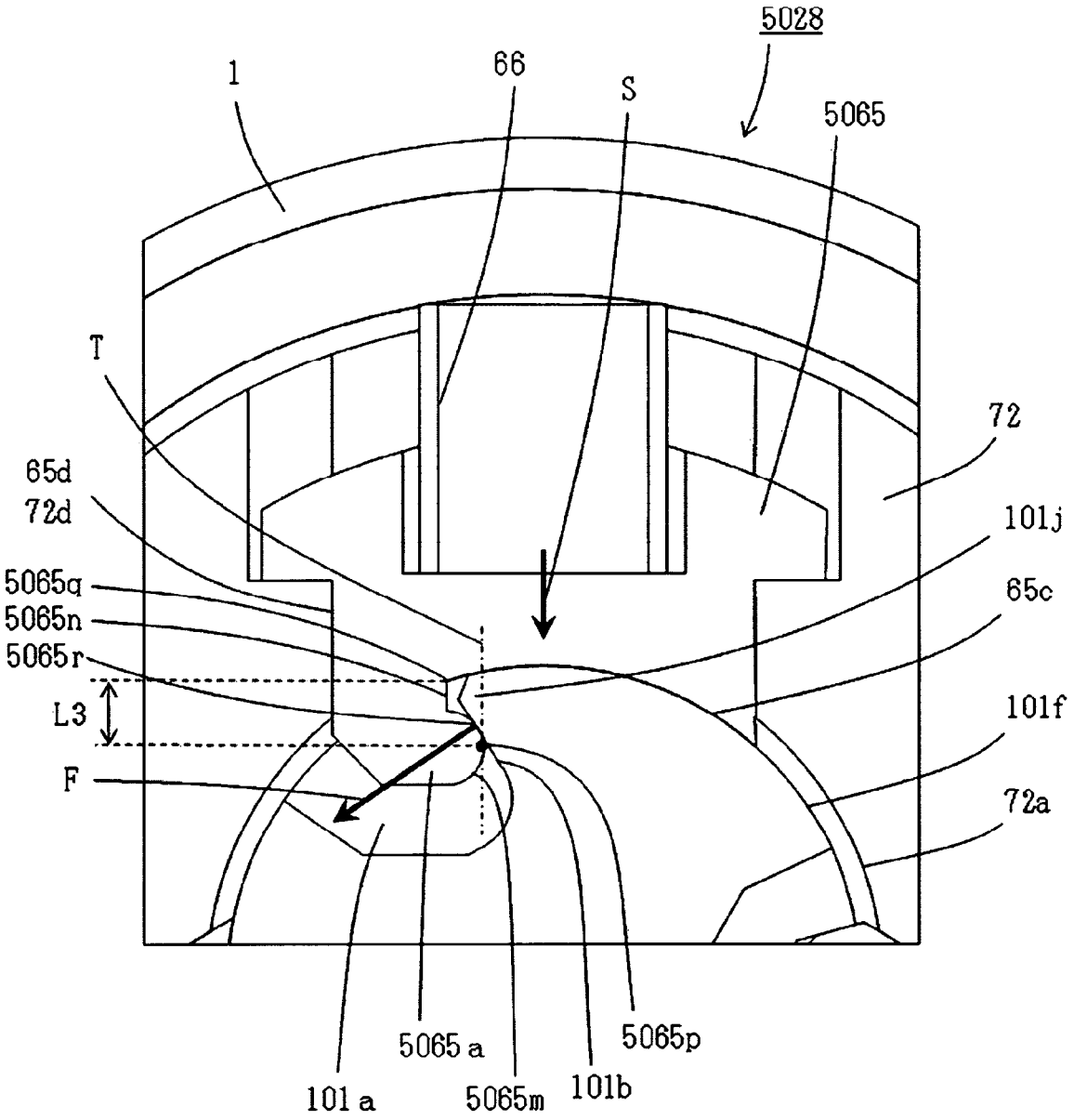
Figure 49:
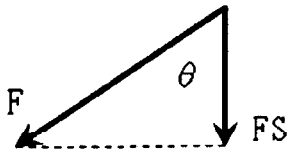

Parts (a) and (b) of FIG. 49 are sectional views of a coupling unit.

Figure 50:
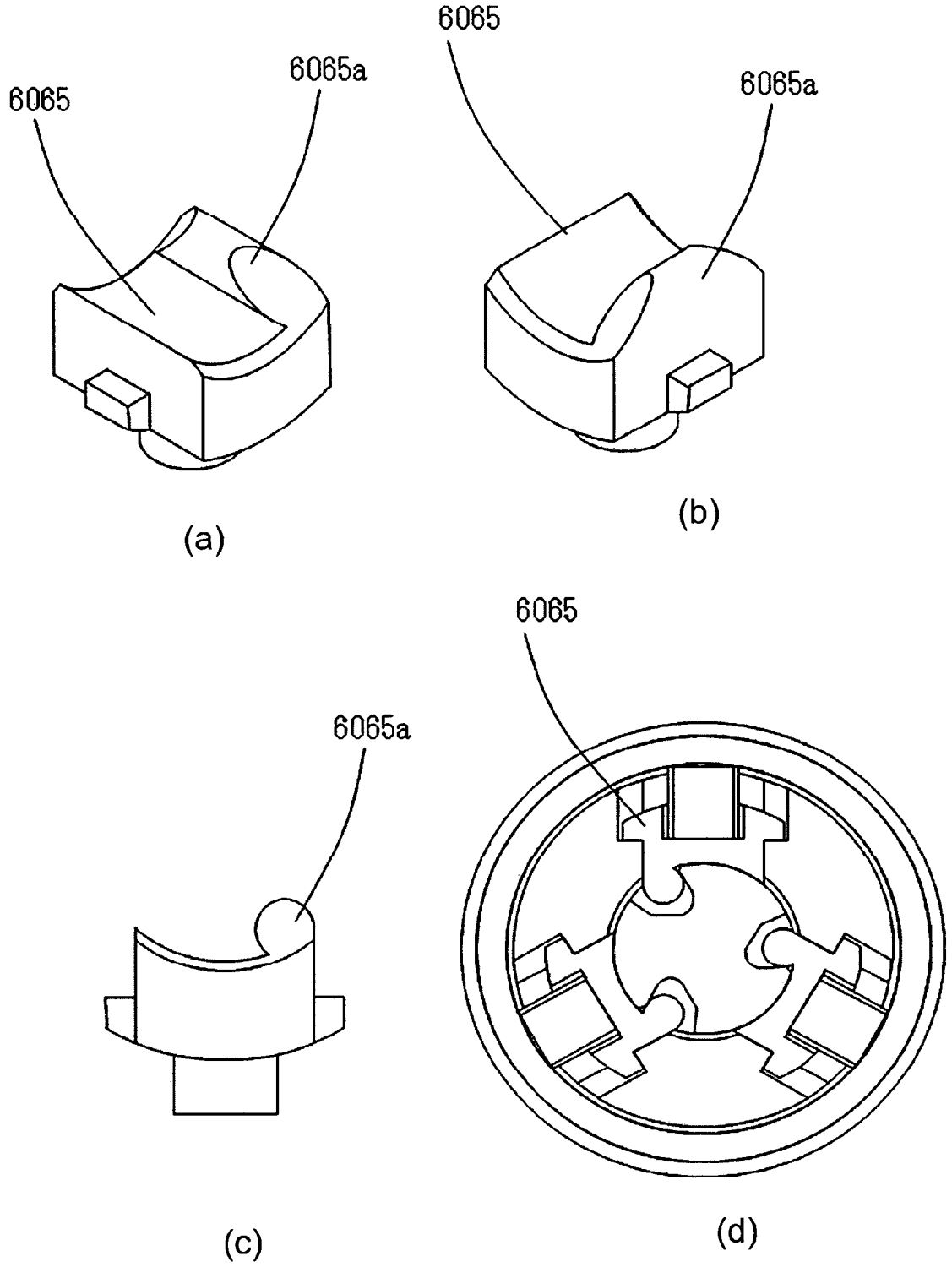

Parts (a), (b), (c) and (d) of FIG. 50 are illustrations of the engaging member.

Figure 51:
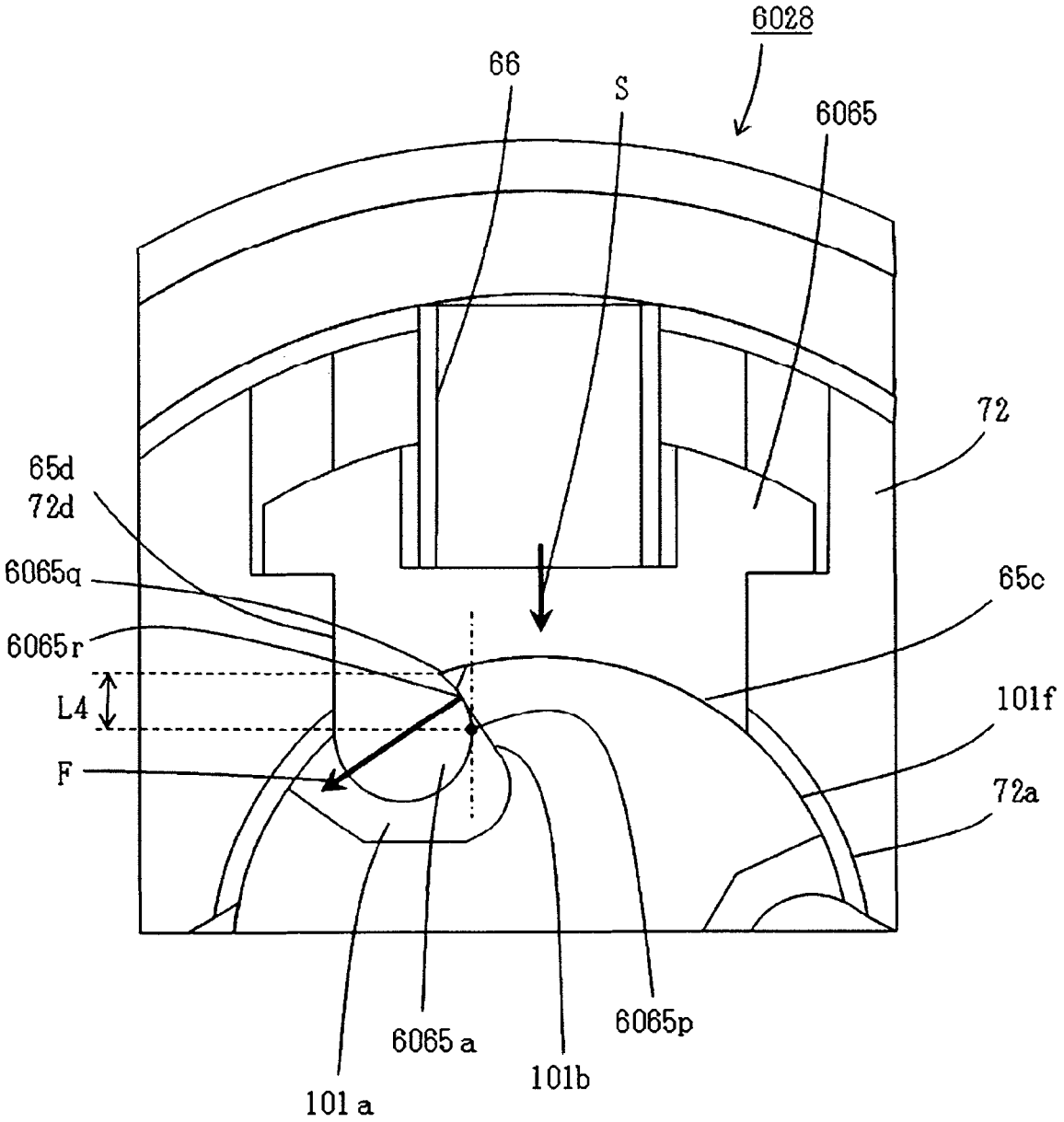
Figure 51:
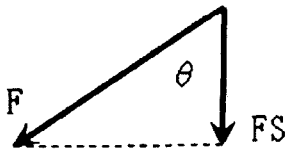

Parts (a) and (b) of FIG. 51 are sectional views of a coupling unit.

Figure 52:
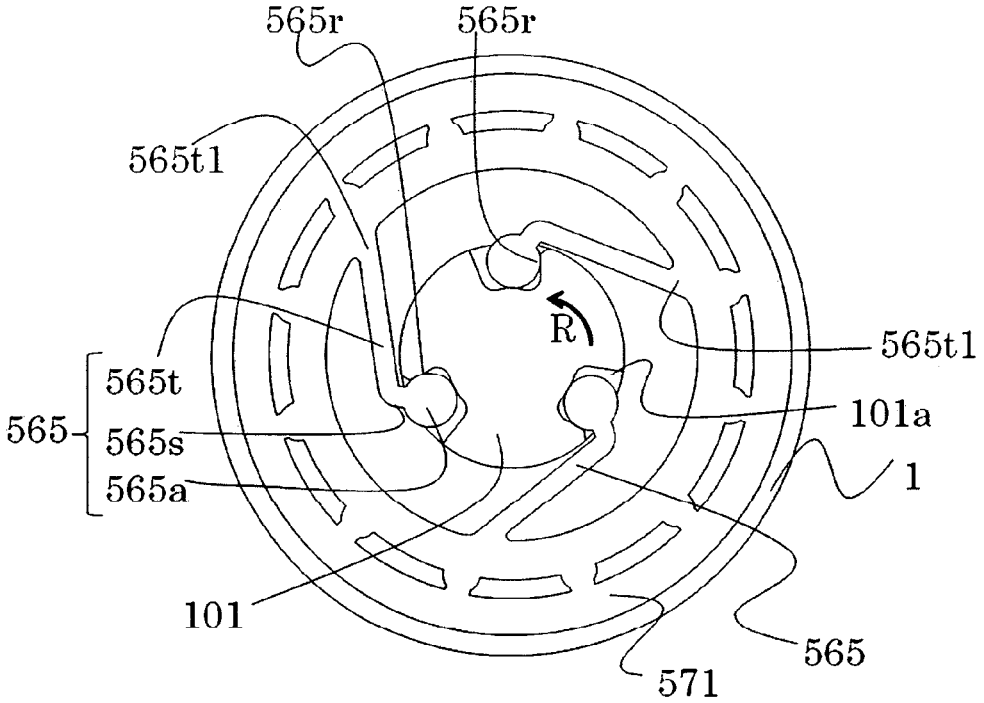
Figure 52:
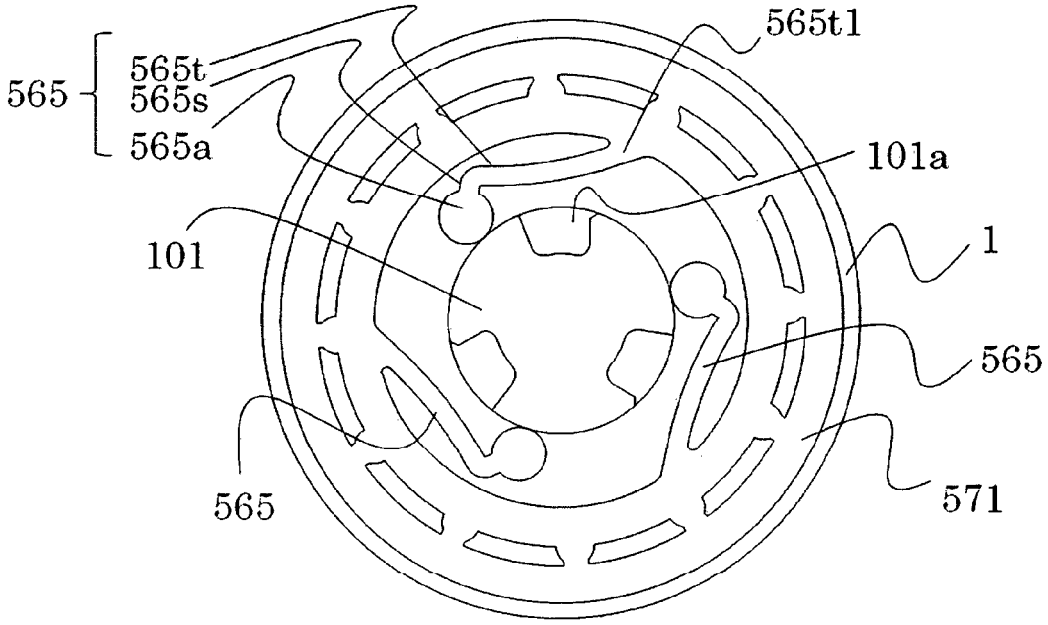

Parts (a) and (b) of FIG. 52 are sectional views of a coupling unit.

Figure 53:
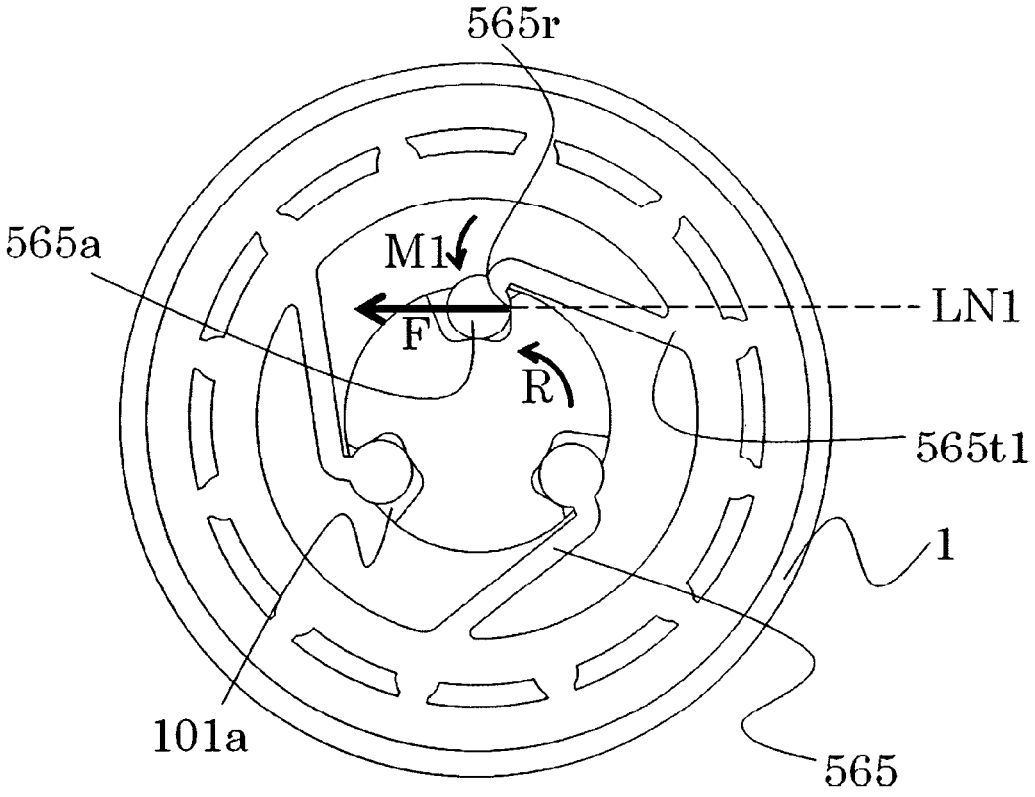

FIG. 53 is a sectional view of a coupling unit.

Figure 54:
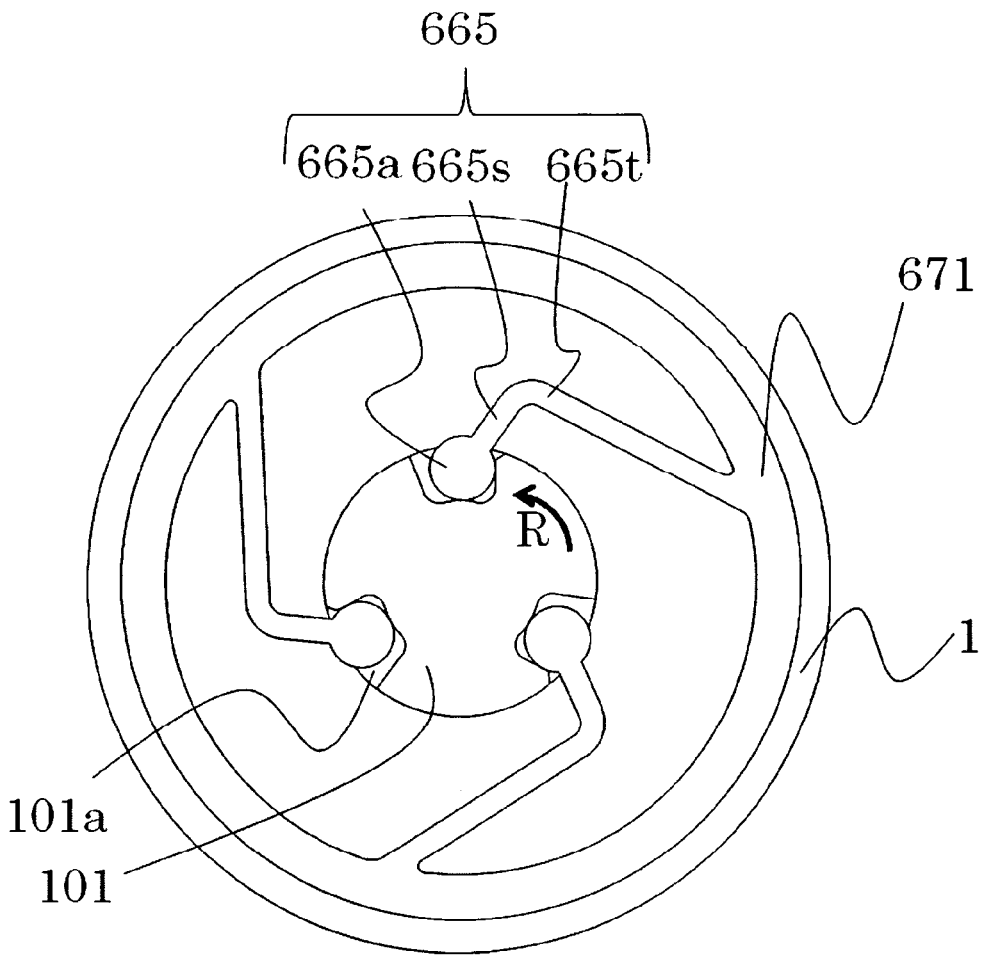

FIG. 54 is a sectional view of a coupling unit.

Figure 55:
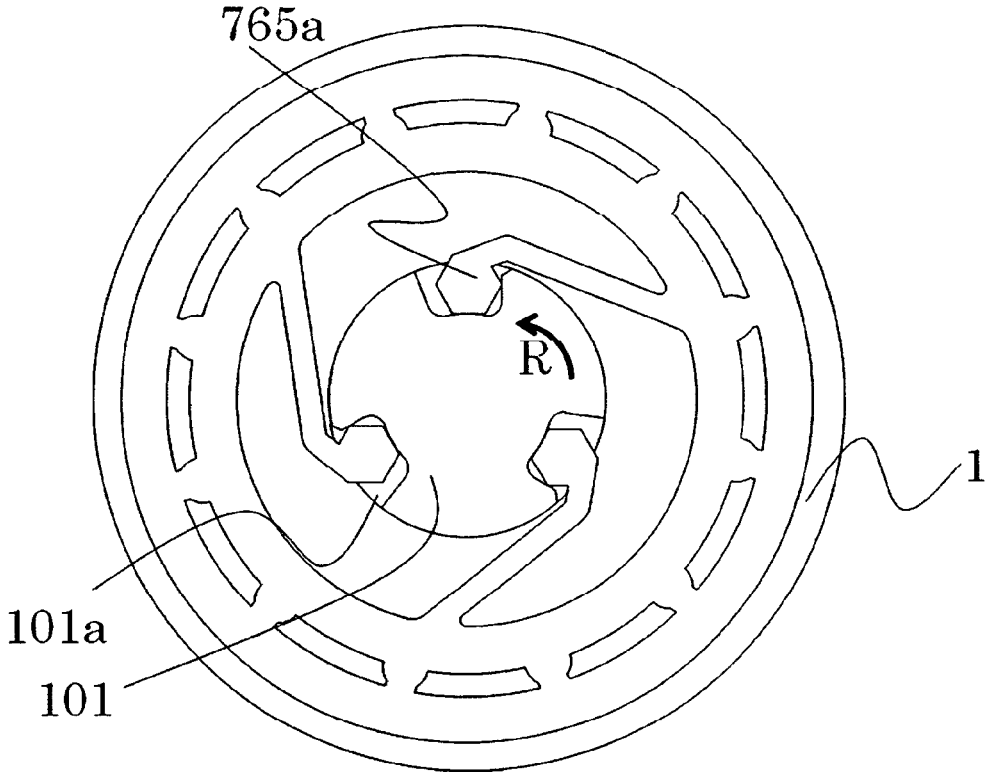

FIG. 55 is a sectional view of a coupling unit.

Figure 56:
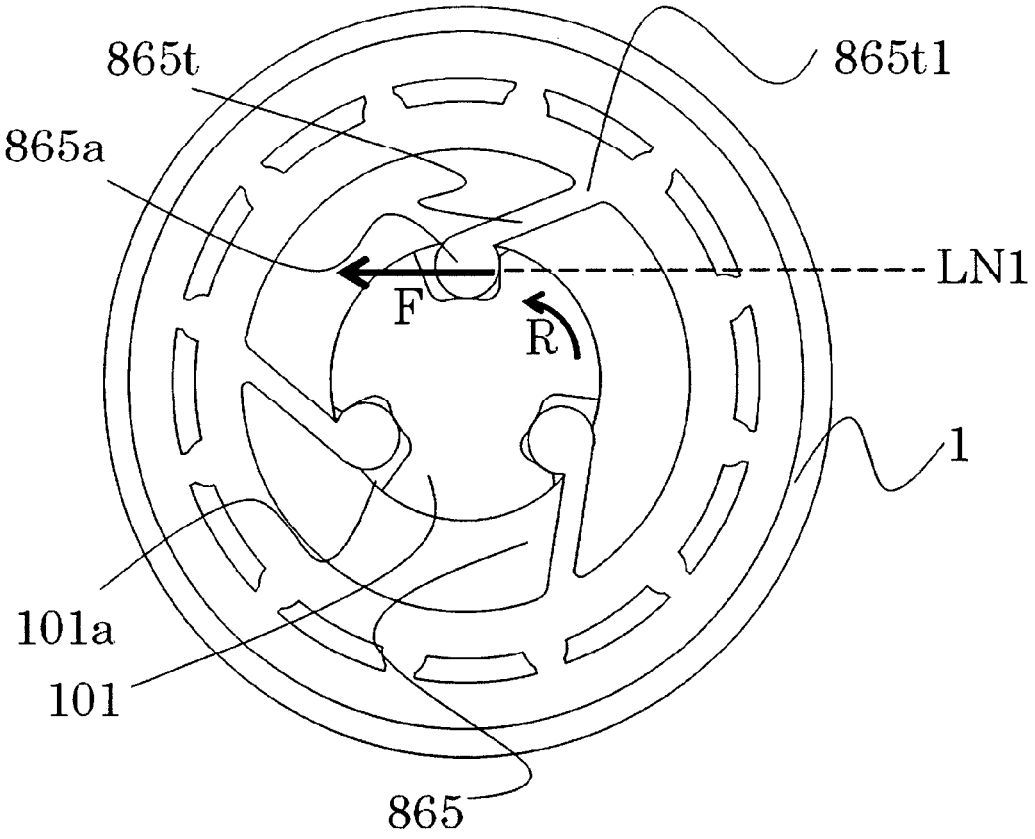

FIG. 56 is a sectional view of a coupling unit.

Figure 57:
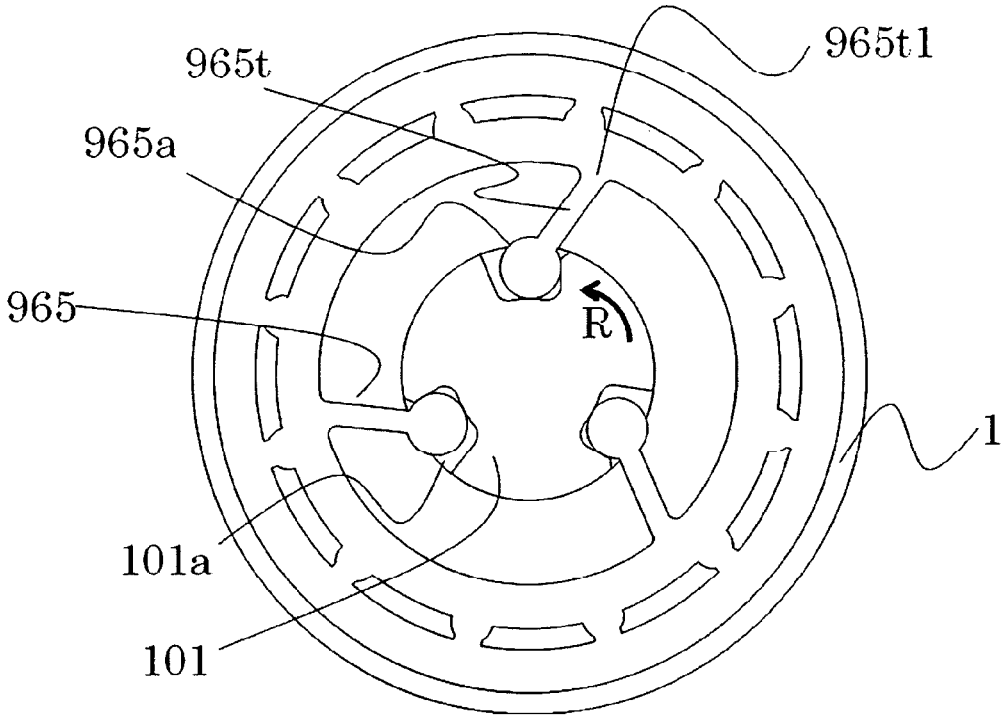

FIG. 57 is a sectional view of a coupling unit.

DESCRIPTION OF THE EMBODIMENTS

Hereinafter, the image forming apparatus and the process cartridge of the present embodiment will be described in conjunction with the accompanying drawings. The image forming apparatus forms an image on a recording material using an electrophotographic image forming process, for example. For example, it includes an electrophotographic copying apparatus, an electrophotographic printer (for example, a LED printer, a laser beam printer, etc.), an electrophotographic facsimile machine, and the like. In addition, the cartridge is mountable to and dismountable from the main assembly of the image forming apparatus (main assembly). Among the cartridges, the one unitized with process means acting on the photoreceptor and the photoreceptor is particularly called process cartridge.

Also, a unit including a photosensitive drum and a coupling member as a unit is called a drum unit.

In the following embodiments, a full-color image forming apparatus relative to which four process cartridges can be mounted and dismounted is taken as an example, in Embodiment 4. However, the number of process cartridges mountable to the image forming apparatus is not limited to this. Likewise, the constituent elements disclosed in the embodiments are not intended to limit the material, arrangement, dimensions, other numerical values, etc. Unless otherwise specified. Unless otherwise specified, "above" means upward in the direction of gravity when the image forming apparatus is installed.

Embodiment 1

[General Description of Electrophotographic Image Forming Apparatus]

First, the overall structure of an embodiment of an electrophotographic image forming apparatus (image forming apparatus) according to this embodiment will be described in conjunction with FIG. 1.

Figure 1:
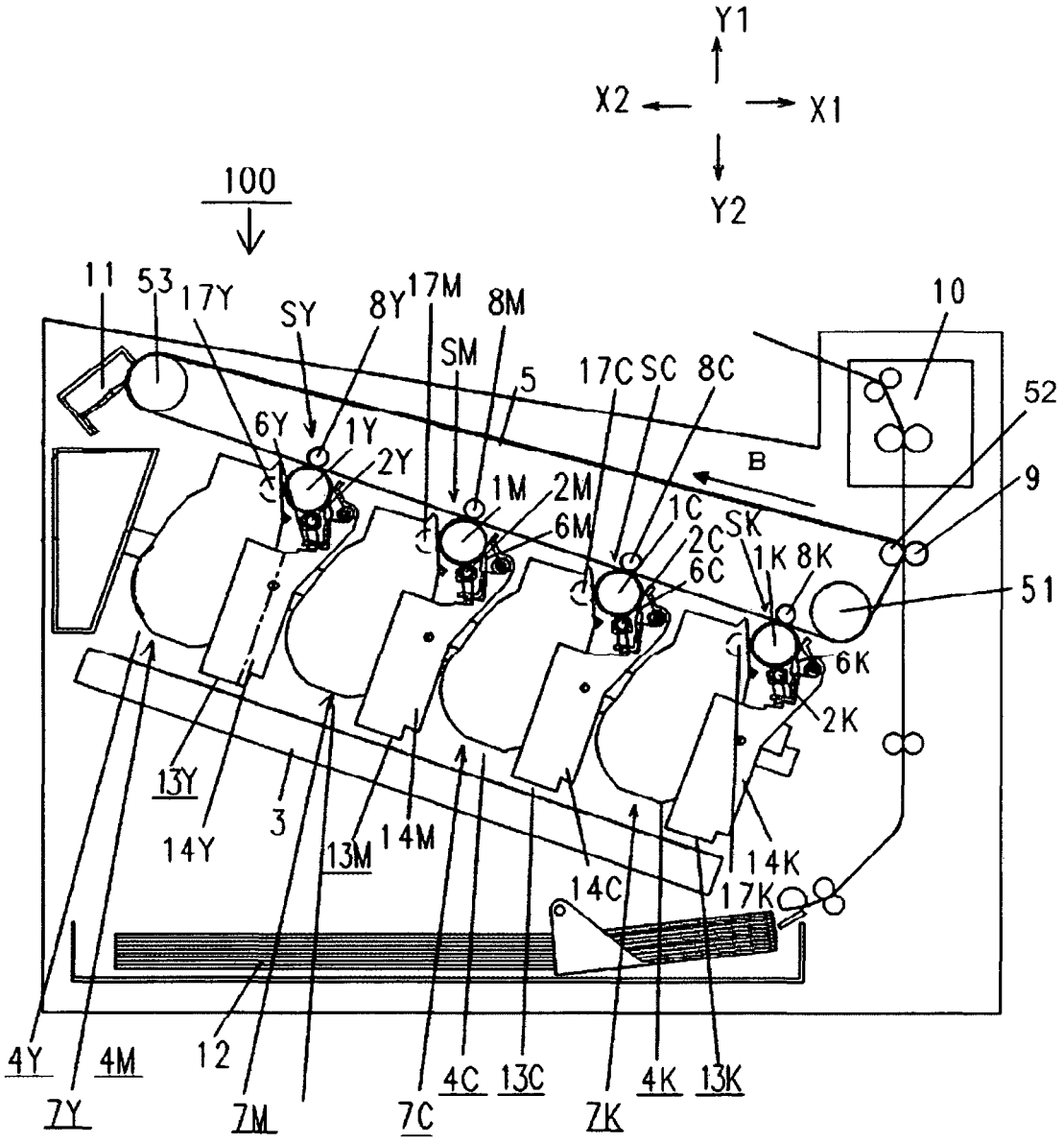
FIG. 1 is a schematic sectional view of an image forming apparatus 100.

FIG. 1 is a schematic sectional view of an image forming apparatus 100 according to this embodiment.

As shown in FIG. 1, the image forming apparatus 100 includes, as a plurality of image forming sections, first, second, third fourth image forming unit SY, SM, SC, and SK for forming images of respective colors, namely yellow (Y), magenta (M), cyan (C) and black (K). In this embodiment, the first to fourth image forming portions SY, SM, SC, and SK are arranged in a line in a substantially horizontal direction.

In this embodiment, the structures and operations of the process cartridges 7 (7Y, 7M, 7C, 7K) are substantially the same except that the colors of the images to be formed are different. Therefore, hereinafter, Y, M, C, and K will be omitted and explanation will be commonly applied unless otherwise stated.

In this embodiment, the image forming apparatus 100 has cylinders (hereinafter referred to as photosensitive drums) 1 each having a photosensitive layer, the cylinders being arranged side by side along a direction inclined slightly with respect to a vertical direction as a plurality of image bearing members. A scanner unit (exposure device) 3 is disposed below the process cartridge 7. In addition, around the photoconductive drum 1, a charging roller 2 or the like functioning as process means (process device, process member) acting on the photosensitive layer are arranged.

The charging roller 2 is charging means (charging device, charging member) for uniformly charging the surface of the photosensitive drum 1. The scanner unit (exposure device) 3 is exposure means (exposure device, exposure member) for forming an electrostatic image (electrostatic latent image) on the photosensitive drum 1 by exposing to a laser on the basis of image information. Around the photosensitive drum 1, there are provided a cleaning blade 6 of a developing device (hereinafter referred to as developing unit) 4 and cleaning means (cleaning device, cleaning member).

Further, an intermediary transfer belt 5 as an intermediary transfer member for transferring the toner image from the photosensitive drum 1 onto the recording material (sheet, recording medium) 12 is provided so as to face the four photosensitive drums 1.

The developing unit 4 of this embodiment uses a non-magnetic one-component developer (hereinafter referred to as toner) as a developer and employs a contact developing system in which a developing roller 17 as a developer carrying member contacts with the photosensitive drum 1.

With the above-described structure, the toner image formed on the photosensitive drum 1 is transferred onto the sheet (paper) 12, and the toner image transferred onto the sheet is fixed. As a process means acting on the photosensitive drum 1, the process cartridge includes a charging roller 2 for charging the photosensitive drum 1 and a cleaning blade 6 for cleaning toner remaining without being transferred onto the photosensitive drum 1. The untransferred residual toner remaining on the photosensitive drum 1 not having been transferred onto the sheet 12 is collected by the cleaning blade 6. Further, the residual toner collected by the cleaning blade 6 is accommodated in a removed developer accommodating portion (hereinafter referred to as a waste toner accommodating portion) 14*a* from the opening 14*b*. The waste toner accommodating portion 14*a* and the cleaning blade 6 are unitized to form a cleaning unit (photosensitive body unit, image bearing member unit) 13.

Further, the developing unit 4 and the cleaning unit 13 are unitized (made into a cartridge) to form a process cartridge 7. The image forming apparatus 100 is provided on the main assembly frame with guides (positioning means) such as a mounting guide and a positioning member (not shown). The process cartridge 7 is guided by the above-mentioned guide, and is configured to be mountable to and dismountable from the image forming apparatus main assembly (main assembly of the electrophotographic image forming apparatus) 100A.

Toners of respective colors of yellow (Y), magenta (M), cyan (C) and black (K) are accommodated in the process cartridges 7 for the respective colors.

The intermediary transfer belt 5 contacts the photosensitive drum 1 of each process cartridge and rotates (moves) in the direction indicated by an arrow B in FIG. 1. The intermediary transfer belt 5 is wound around a plurality of support members (a drive roller 51, a secondary transfer opposing roller 52, a driven roller 53). On the inner peripheral surface side of the intermediary transfer belt 5, four primary transfer rollers 8 as primary transfer means are juxtaposed so as to face each photosensitive drum 1. A secondary transfer roller 9 as a secondary transfer means is disposed at a position facing the secondary transfer opposing roller 52 on the outer peripheral surface side of the intermediary transfer belt 5.

At the time of image formation, the surface of the photosensitive drum 1 is first uniformly charged by the charging roller 2. Then, the surface of the thus charged photosensitive drum 1 is scanned by and exposed to laser beam corresponding to image information emitted from the scanner unit 3. By this, an electrostatic latent image corresponding to image information is formed on the photosensitive drum 1. The electrostatic latent image formed on the photosensitive drum 1 is developed into a toner image by the developing unit 4.

The photosensitive drum is a rotatable member (image bearing member) that rotates in a state of carrying an image (developer image, toner image) formed with a developer (toner) on the surface thereof.

The toner image formed on the photosensitive drum 1 is transferred (primary transfer) onto the intermediary transfer belt 5 by the operation of the primary transfer roller 8.

For example, at the time of forming a full-color image, the above-described process is sequentially performed in the four process cartridges 7 (7Y, 7M, 7C, 7K). The toner images of the respective colors formed on the photosensitive drums 1 of the respective process cartridges 7 are sequentially primary-transferred so as to be superimposed on the intermediary transfer belt 5. Thereafter, in synchronism with the movement of the intermediary transfer belt 5, the recording material 12 is fed to the secondary transfer portion. The four color toner images on the intermediary transfer belt 5 are altogether transferred onto the recording material 12 conveyed to the secondary transfer portion constituted by the intermediary transfer belt 5 and the secondary transfer roller 9.

The recording material 12 to which the toner image has been transferred is conveyed to a fixing device 10 as fixing means. By applying heat and pressure to the recording material 12 in the fixing device 10, the toner image is fixed on the recording material 12. Further, the primary transfer residual toner remaining on the photosensitive drum 1 after the primary transferring process is removed by the cleaning blade 6 and collected as waste toner. Further, the secondary transfer residual toner remaining on the intermediary transfer belt 5 after the secondary transfer step is removed by the intermediary transfer belt cleaning device 11.

The image forming apparatus 100 is also capable of forming monochrome or multicolor images using desired single or some (not all) image forming units.

[General Description of Process Cartridge]

Figure 2:
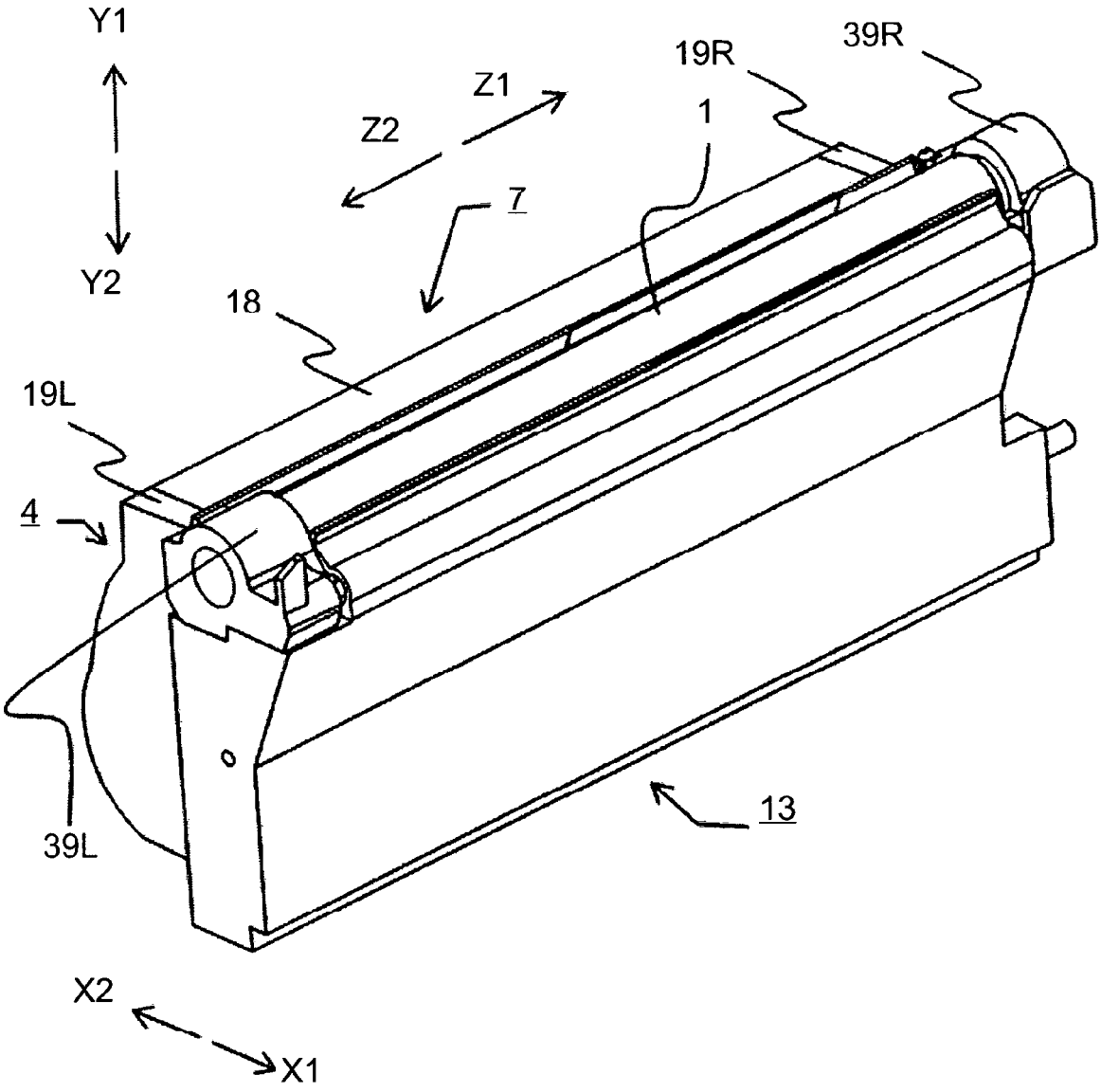
FIG. 2 is a perspective view of an outer appearance of a process cartridge 7.
Figure 3:
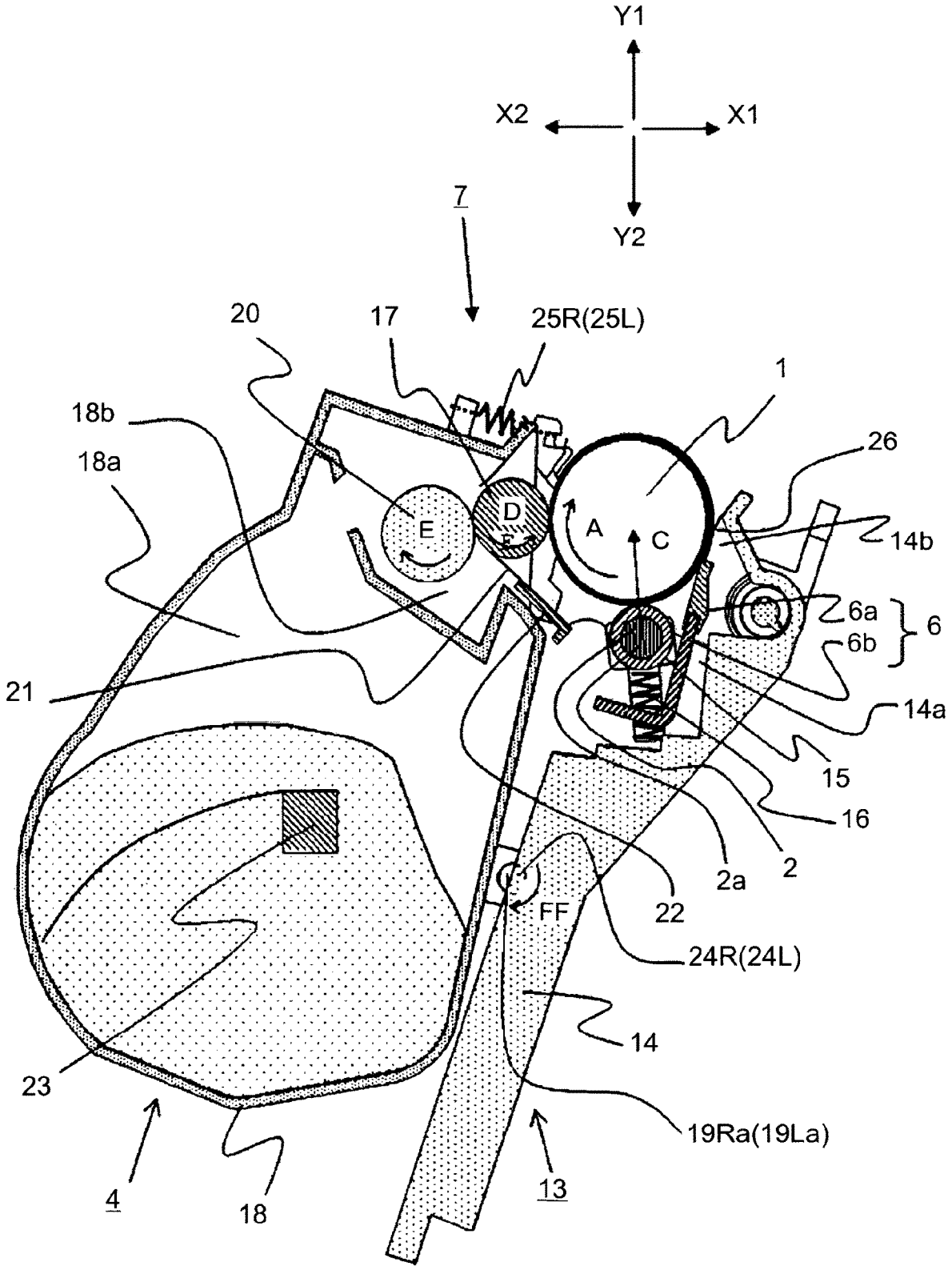
FIG. 3 is a schematic section of view of the process cartridge 7.
Figure 4:
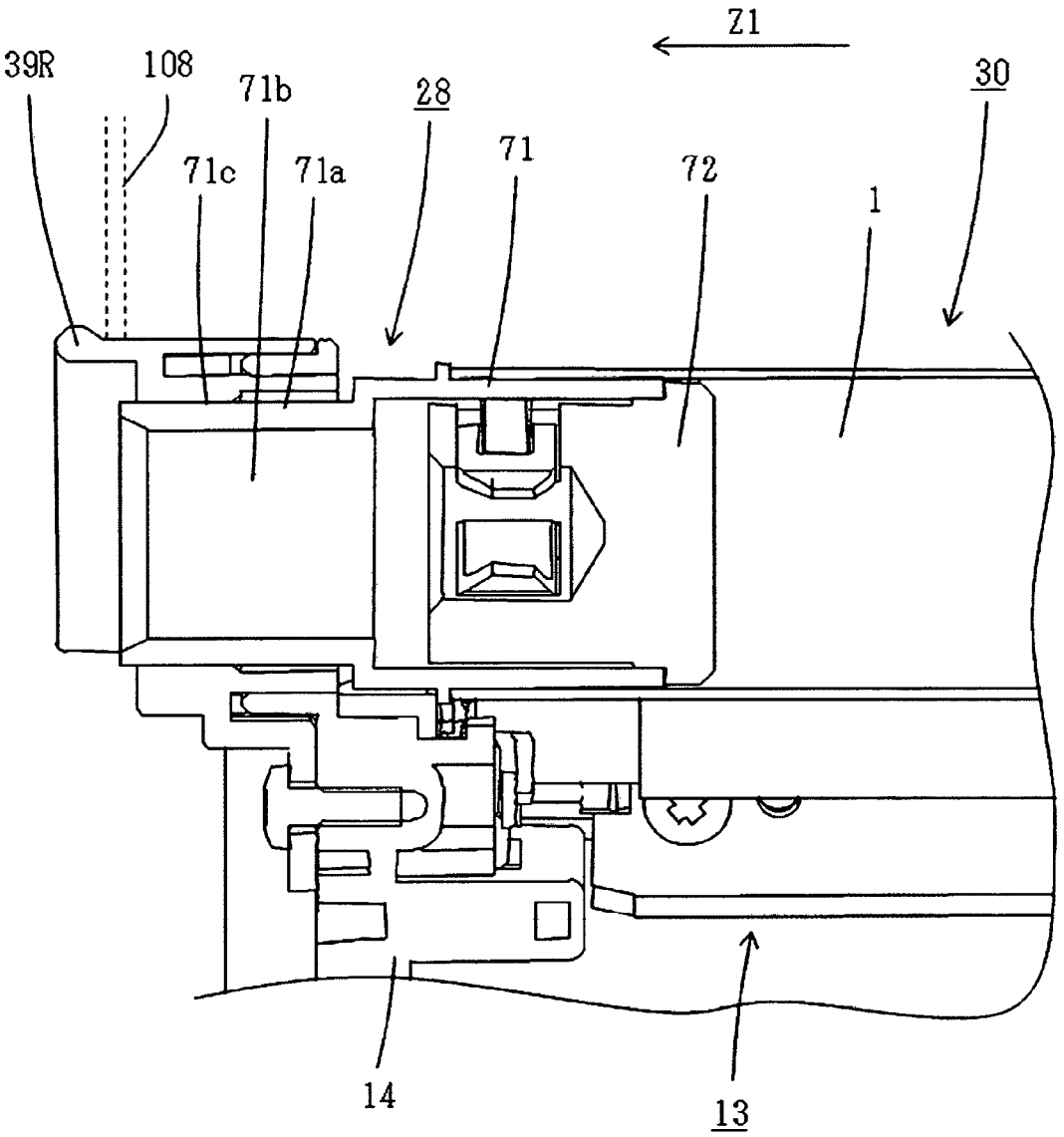
FIG. 4 is a sectional view of the process cartridge 7.

Referring to FIGS. 2, 3, and 4 the process cartridge 7 (cartridge 7) mounted in the image forming apparatus main assembly 100A of this embodiment will be described.

The cartridge containing the yellow toner, the cartridge containing the magenta toner, the cartridge containing the cyan toner and the cartridge containing the black toner have the same structure. Therefore, in the following description, each of the cartridges will be referred to simply as a cartridge 7. The respective cartridge components will also be described in the same manner.

FIG. 2 is an external perspective view of the process cartridge 7. Here, as shown in FIG. 2, the direction of the rotation axis of the photosensitive drum 1 is defined as a Z direction (arrow Z1, arrow Z2), the horizontal direction in FIG. 1 as X direction (arrow X1, arrow X2), the vertical direction is a Y direction (arrow Y1, arrow Y2).

FIG. 3 is a schematic cross-sectional view of the process cartridge 7 viewed in the Z direction in a state (attitude) in which the photosensitive drum 1 and the developing roller 17 are in contact with each other, which is mounted to the image forming apparatus 100.

The process cartridge 7 comprises two units, namely a cleaning unit 13 including the photosensitive drum 1, the charging roller 2 and the cleaning blade 6 as a unit, and a developing unit 4 including a developing member such as the developing roller 17.

The developing unit 4 has a developing frame 18 for supporting various elements in the developing unit 4. The developing unit 4 includes the developing roller 17 as a developer carrying member which is rotatable in the direction of the arrow D (counterclockwise direction) in contact with the photosensitive drum 1. The developing roller 17 is rotatably supported by the developing frame 18 through development bearings 19 (19R, 19L) at both end portions with respect to the longitudinal direction (rotational axis direction) thereof. Here, the developing bearings 19 (19R, 19L) are mounted to respective side portions of the developing frame 18, respectively.

In addition, the developing unit 4 is provided with a developer accommodating chamber (hereinafter, toner accommodating chamber) 18*a* and a developing chamber 18*b* in which the developing roller 17 is provided.

In the developing chamber 18*b*, there are provided a toner supplying roller 20 as a developer supply member which contacts the developing roller 17 and rotates in the direction of arrow E, and a developing blade 21 as a developer regulating member for regulating the toner layer of the developing roller 17. The developing blade 21 is fixed and integrated to the fixing member 22 by welding or the like.

A stirring member 23 for stirring the contained toner and for conveying the toner to the toner supplying roller 20 is provided in the toner accommodating chamber 18*a* of the developing frame 18.

The developing unit 4 is rotatably coupled to the cleaning unit 13 around the fitting shafts 24 (24R, 24L) fitted in the holes 19Ra, 19La provided in the bearing members 19R, 19L. Further, in the developing unit 4, the developing roller 17 is urged by the pressure spring 25 (25R, 25L) in a direction of contacting to the photosensitive drum 1. Therefore, at the time of image formation using the process cartridge 7, the developing unit 4 turns (rotates) in the direction of an arrow FF about the fitting shaft 24, so that the photosensitive drum 1 and the developing roller 17 are in contact with each other.

The cleaning unit 13 has a cleaning frame 14 as a frame for supporting various elements in the cleaning unit 13.

Figure 5:
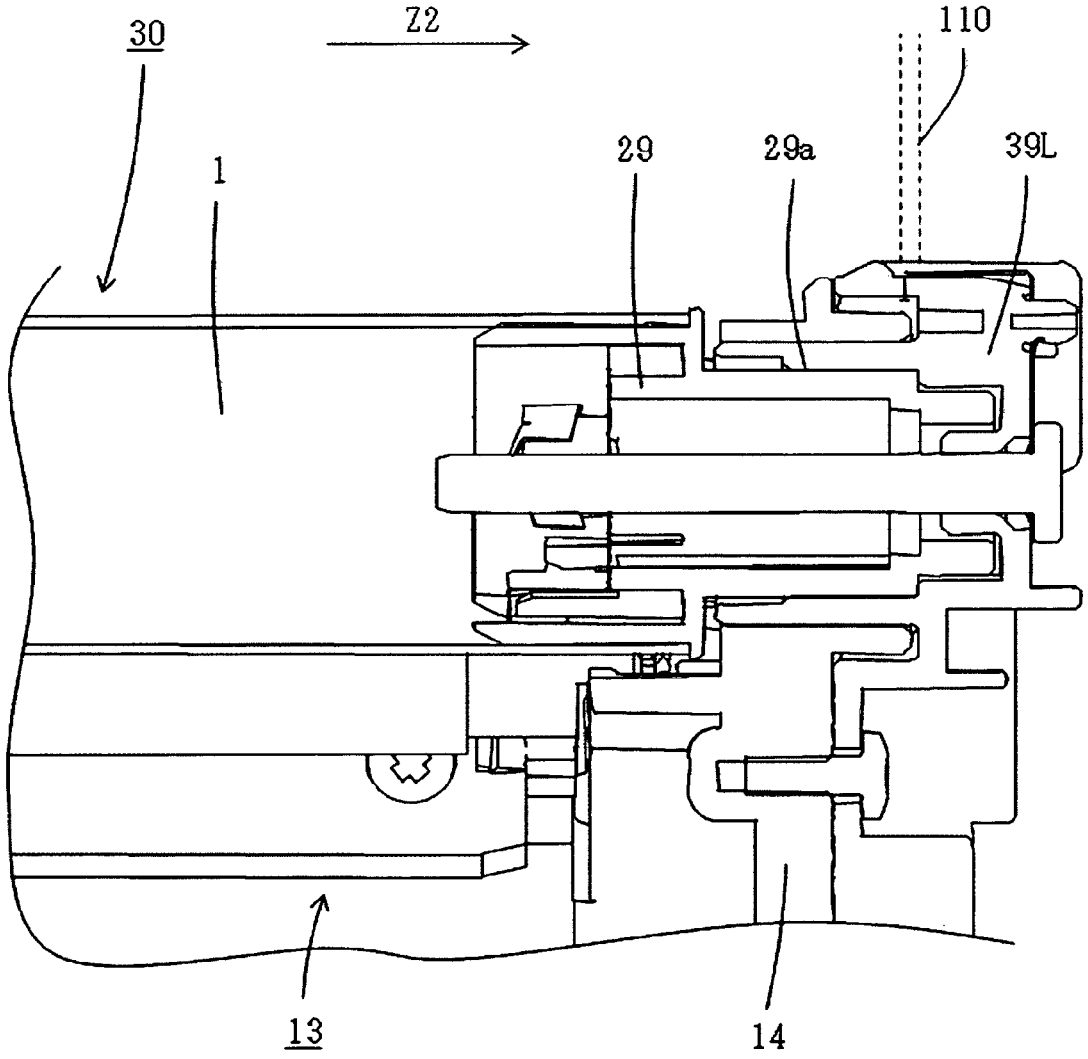
FIG. 5 is a sectional view of the process cartridge 7.

FIGS. 4 and 5 are cross-sectional views taken along an imaginary plane along a rotational axis of the photosensitive drum 1 of the process cartridge 7.

In FIG. 4, the side (with respect to the Z1 direction) where the coupling unit (coupling member) 28 receives the driving force from the image forming apparatus main assembly is referred to as the driving side of the process cartridge 7. In FIG. 5, the side opposite to the driving side (with respect to the Z2 direction) is referred to as the non-driving side (front side) of the process cartridge 7.

When the cartridge 7 is mounted in the mounting portion of the main assembly of the image forming apparatus, the driving side of the cartridge 7 is placed in the back side, and the non-driving side in placed in the front side of the mounting portion of the cartridge 7.

On the end opposite from the coupling unit 28 (the end portion on the non-driving side of the process cartridge), there is provided an electrode (electrode portion) in contact with the inner surface of the photosensitive drum 1, and this electrode functions as the electrical ground by contacting the main assembly.

The coupling unit 28 is mounted to one end of the photosensitive drum 1, and a non-driving side flange member 29 is mounted to the other end of the photosensitive drum 1 to constitute a photosensitive drum unit 30. The photosensitive drum unit 30 receives a driving force from a main assembly driving shaft 101 provided in the image forming apparatus main assembly 100A via the coupling unit 28 (driving force is transmitted from the main assembly driving shaft 101). As will be described in detail hereinafter, with the mounting of the cartridge 7 to the main assembly 100A, the coupling unit 28 is capable of engaging with the main assembly driving shaft 101. With the dismounting of the cartridge 7 from the main assembly 100A, the coupling unit 28 is capable of disengaging from the main assembly driving shaft 101.

The coupling unit 28 is configured to be coupled to and detached from the main assembly driving shaft 101.

The coupling unit 28 includes a flange member (driving side flange member) mounted to the driving side end portion of the photosensitive drum 1.

As shown in FIG. 4, the Z1 side of the coupling unit 28 has a cylindrical shape (cylindrical portion 71*a*). The cylindrical portion 71*a* protrudes toward the Z1 side (outside in the axial direction) beyond the end portion of the photosensitive drum 1. In the cylindrical portion 71*a*, a portion on the Z1 side, near the free end, is a borne portion 71*c*. The borne portion 71*c* is rotatably supported by the bearing portion provided in a drum unit bearing member 39R. In other words, the borne portion 71*c* is supported by the bearing portion of the drum unit bearing member 39R, so that the photosensitive drum unit 30 can rotate.

Similarly, in FIG. 5, the non-driving side flange member 29 provided on the non-driving side of the photosensitive drum unit 30 is rotatably supported by a drum unit bearing member 39L. The non-driving side flange member 29 has a cylindrical portion (cylindrical portion) projecting from the end portion of the photosensitive drum 1, and the outer peripheral surface of this cylindrical portion 29*a* is rotatably supported by the drum unit bearing member 39L.

The drum unit bearing member 39R is disposed on the driving side of the process cartridge 7, and the drum unit bearing member 39L is disposed on the non-driving side of the process cartridge 7.

As shown in FIG. 4, when the process cartridge 7 is mounted in the apparatus main assembly 100A, the drum unit bearing member 39R abuts to the rear cartridge positioning section 108 provided in the image forming apparatus main assembly 100A. Further, the drum unit bearing member 39L abuts to the front side cartridge positioning portion 110 of the image forming apparatus main assembly 100A. Thereby, the cartridge 7 is positioned in the image forming apparatus 100A.

In the Z direction of this embodiment, as shown in FIG. 4, the position where the drum unit bearing member 39R supports the borne portion 71*c* is made close to the position where the drum unit bearing member 39R is positioned at the rear side cartridge positioning portion 108. By doing so, it is possible to suppress inclination of the coupling unit 28 when the process cartridge 7 is mounted in the apparatus main assembly 100A.

The borne portion 71*c* is disposed so that the position where the bearing member 39R supports the borne portion 71*c* and the position where the bearing member 39R is positioned at the rear side cartridge positioning portion 108 can be close to each other. That is, the borne portion 71*c* is disposed on the free end side (the Z1 direction side) of the outer peripheral surface 71*a* of the cylindrical portion 71 provided in the coupling unit 28.

Similarly, in the Z2 direction, as shown in FIG. 5, the position where the drum unit bearing member 39L rotatably supports the non-driving side flange member 29 is arranged at a position close to the position where the drum unit bearing member 39L is positioned on the near side cartridge positioning portion 110. By this, the inclination of the non-driving side flange member 29 is suppressed.

The drum unit bearing members 39R and 39L are mounted to the sides of the cleaning frame 14, respectively, and support the photosensitive drum unit 30. By this, the photosensitive drum unit 30 is supported so as to be rotatable relative to the cleaning frame 14.

In addition, a charging roller 2 and a cleaning blade 6 are mounted to the cleaning frame 14, and they are arranged so as to be in contact with the surface of the photosensitive drum 1. In addition, charging roller bearings 15 (15R, 15L) are mounted to the cleaning frame 14. The charging roller bearing 15 is a bearing for supporting the shaft of the charging roller 2.

Here, the charging roller bearings 15 (15R, 15L) are mounted so as to be movable in the direction of the arrow C shown in FIG. 3. A rotating shaft 2*a* of the charging roller 2 is rotatably mounted to the charging roller bearing 15 (15R, 15L). The charging roller bearing 15 is urged toward the photosensitive drum 1 by a pressing spring 16 as an urging means. As a result, the charging roller 2 abuts against the photosensitive drum 1 and is rotated by the photosensitive drum 1.

The cleaning frame 14 is provided with a cleaning blade 6 as a cleaning means for removing the toner remaining on the surface of the photosensitive drum 1. The cleaning blade 6 is formed by unitizing a blade-shaped rubber (elastic member) 6*a* that abuts against the photosensitive drum 1 to remove toner on the photosensitive drum 1 and a supporting metal plate 6*b* that supports the blade-like rubber (elastic member) 6*a*. In this embodiment, the supporting metal plate 6*b* is fixed to the cleaning frame 14 with screws.

As described in the foregoing, the cleaning frame 14 has an opening 14*b* for collecting the transfer residual toner collected by the cleaning blade 6. The opening 14*b* is provided with a blowing prevention sheet 26 which is in contact with the photosensitive drum 1 and seals between the photosensitive drum 1 and the opening 14*b* so as to suppress toner leakage in the upward direction of the opening 14*b*.

In this manner, by employing the structure in which the components related to the image formation are unitized in a cartridge detachably mountable to the apparatus main assembly, the maintenance easiness is improved. In other words, the user can easily perform maintenance of the apparatus by exchanging the process cartridge. Therefore, it is possible to provide an apparatus for which the maintenance operation can be performed not only by a serviceman but also by a user.

[Structure of Main Assembly Driving Shaft]

Referring to FIGS. 5, 6, 7, 8, 9 and 10, structures of the main assembly driving shaft 101 will be described.

Figure 6:
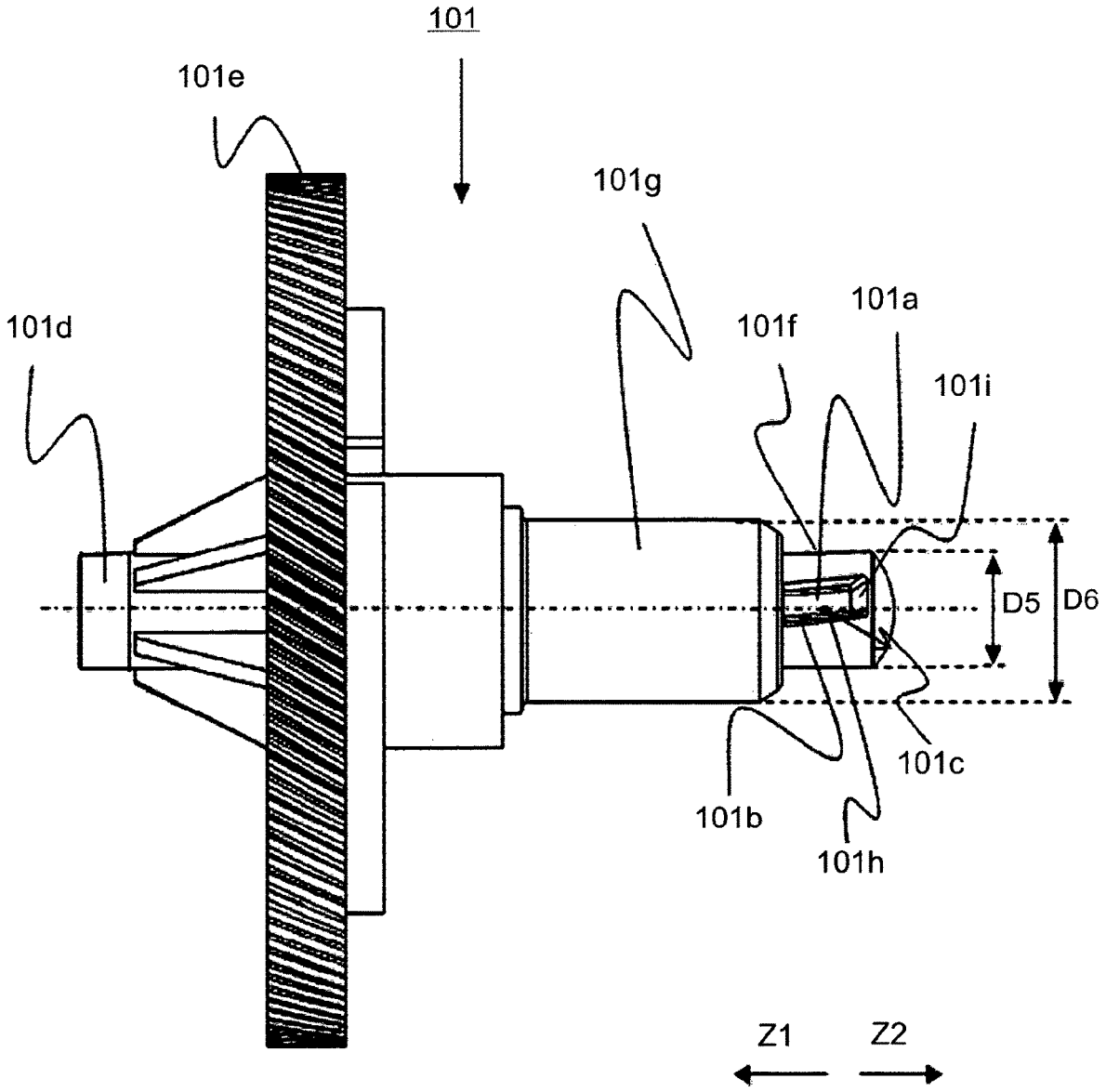
FIG. 6 shows an outer appearance of a main assembly driving shaft 101.

FIG. 6 is an external view of the main assembly driving shaft.

Figure 7:
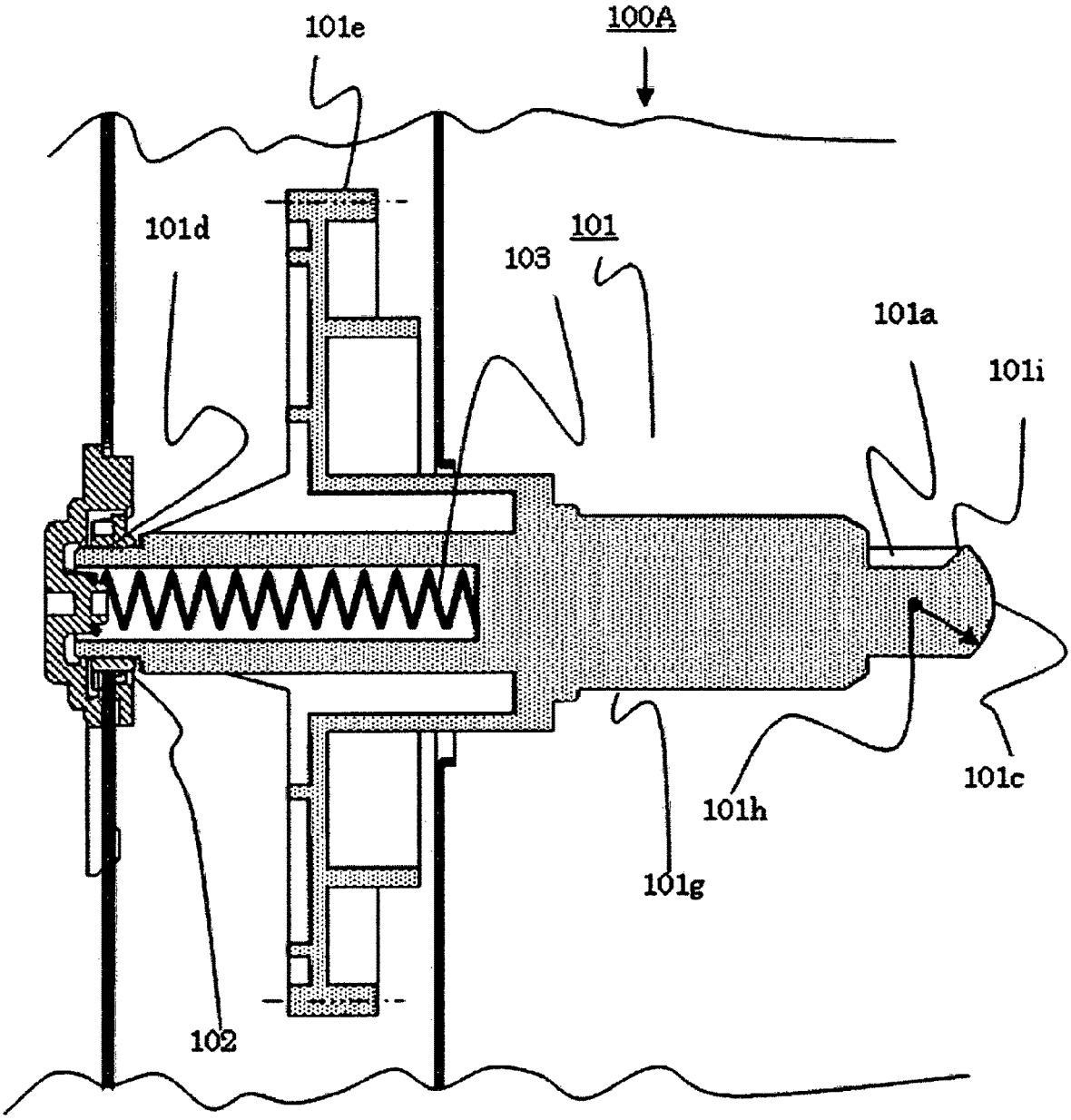
FIG. 7 is a sectional view of the main assembly driving shaft 101.

FIG. 7 is a cross-sectional view taken along the rotation axis (rotation axis) of the main assembly driving shaft 101 mounted to the image forming apparatus main assembly.

Figure 8:
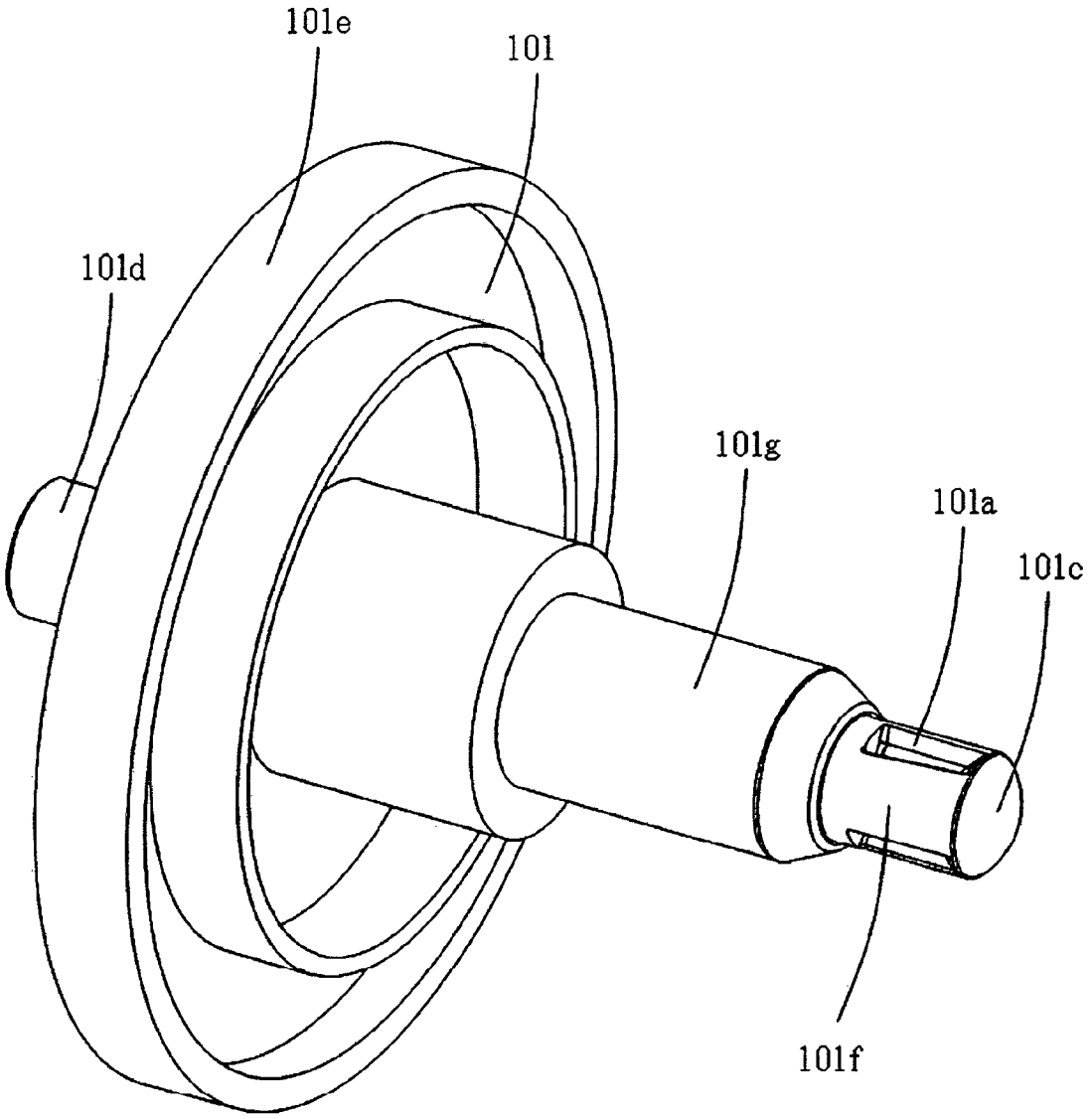
FIG. 8 is a perspective view of the main assembly driving shaft 101.

FIG. 8 is a perspective view of the main assembly driving shaft.

Figure 9:
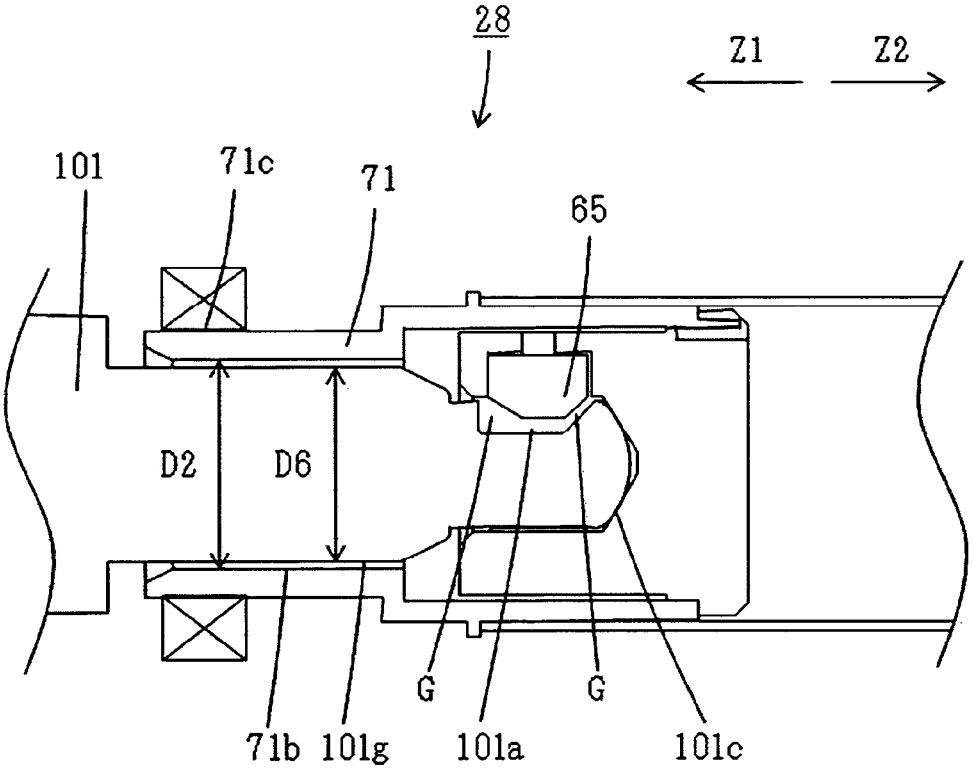
FIG. 9 is a sectional view of the coupling 28 and the main assembly driving shaft 101.

FIG. 9 is a cross-sectional view of the coupling unit 28 and the main assembly driving shaft 101 taken along the rotation axis (rotation axis).

Figure 10:
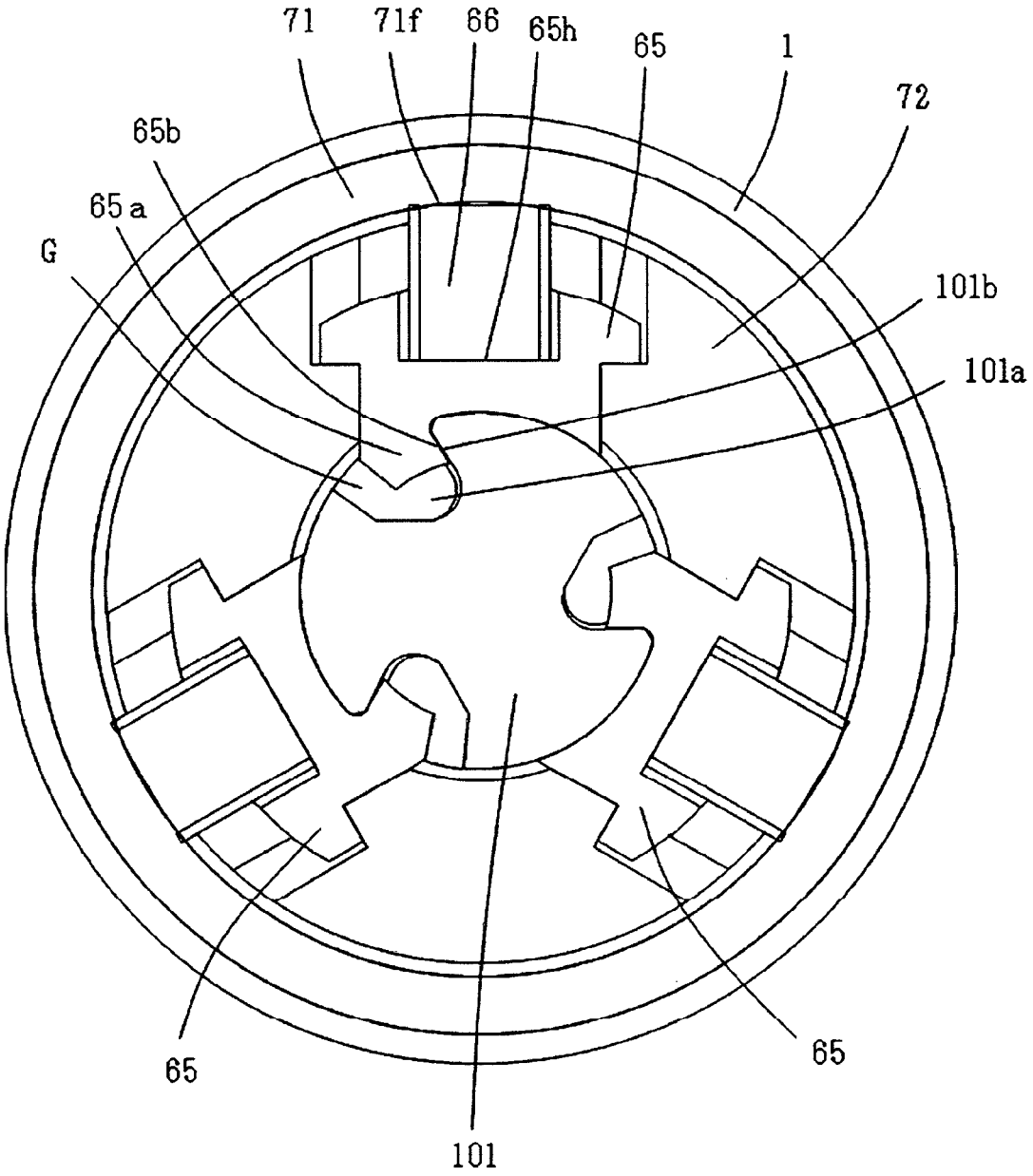
FIG. 10 is a sectional view of a coupling unit 28 and the main assembly driving shaft 101 taken along a plane perpendicular to a rotational axis.

FIG. 10 is a cross-sectional view of the coupling member 28 and the main assembly driving shaft 101 taken along a plane perpendicular to the rotation axis.

As shown in FIG. 6, the main assembly driving shaft 101 is provided with a gear portion 101*e*, a shaft portion 101*f*, a rough guide portion 101*g* and a borne portion 101*d*.

A motor (not shown) as a drive source is provided in the image forming apparatus main assembly 100A. From the motor, the gear portion 101*e* receives the rotational driving force so that the main assembly driving shaft 101 rotates. Further, the main assembly driving shaft 101 includes a rotatable projecting shaft portion 101*f* protruding toward the cartridge side from the gear portion 101*e* along the rotation axis thereof. The rotational driving force received from the motor is transmitted to the cartridge 7 side by way of the groove-shaped drive transmission groove 101*a* (recessed portion, drive passing portion) provided in the shaft portion 101*f*. In addition, the shaft portion 101*f* has a semispherical shape 101*c* at its free end portion.

The main assembly drive transmission groove 101*a* is shaped so that a part of an engaging portion 65*a* of the coupling unit 28 which will be described hearing after can enter. Specifically, it is provided with a main assembly drive transmission surface 101*b* as a surface that contacts the driving force receiving surface (driving force receiving portion) 65*b* of the coupling unit 28 to transmit the driving force.

Further, as shown in FIG. 6, the main assembly drive transmission surface 101*b* is not a flat surface but a shape twisted about the rotational axis of the main assembly driving shaft 101. The twisting direction is such that the downstream side in the Z1 direction of the main assembly driving shaft 101 is upstream of the downstream side in the Z2 direction thereof, with respect to the rotational direction of the main assembly driving shaft 101. In this embodiment, the amount of twisting along the rotational axis direction of the cylinder of the engaging portion 65*a* is set to about 1 degree per 1 mm. The reason why the main assembly drive transmission surface 101*b* is twisted will be described hereinafter.

Also, the main assembly drive transmission groove 101*a* provided on the Z2 direction side surface with a main assembly side removal taper 101*i*. The main assembly side removal taper 101*i* is a taper (inclined surface, inclined portion) for assisting the engaging portion 65*a* to disengage from the drive transmission groove 101*a* when dismounting the process cartridge 7 from the apparatus main assembly 100A. The details thereof will be described hereinafter.

Here, when the driving force is transmitted from the drive transmission groove 101*a* to the engaging portion 65*a*, it is desirable that the main assembly drive transmission surface 101*b* and the driving force receiving surface (driving force receiving portion) 65*b* are assuredly in contact with each other. Therefore, in order to prevent the surface other than the main assembly drive transmission surface 101*b* from coming into contact with the engaging portion 65*a*, the main assembly drive transmission groove 101*a* has a clearance (G) relative to the engaging portion 65*a* in the rotational axis direction, the circumferential direction and in the radial direction (FIGS. 9 and 10).

Further, in the axial direction of the main assembly driving shaft 101, the center 101*h* of the semispherical shape 101*c* is disposed within the range of the main assembly drive transmission groove 101*a* (FIG. 7). In other words, when the center 101*h* and the main assembly drive transmission groove 101*a* are projected on the axis of the main assembly driving shaft 101 on the axis of the main assembly driving shaft 101, the projection area of the center 101*h* on the axis is within the projection area of the main assembly drive transmission groove 101*a*.

Here, the main assembly driving shaft and the axis (rotation axis, rotation center line) of the drum unit mean an imaginary straight line extending so as to pass through the rotation center of the shaft. Also, the axial direction (rotational axis direction) means the direction in which the axis extends. The axial direction of the drum unit 30 has the same meaning as the longitudinal direction (Z direction) of the drum unit 30.

Furthermore, "X and Y overlap each other in the A direction" means that as X and Y are projected on a straight line extending in parallel to the A direction means that at least a part of the projection area of X overlaps at least a part the projection area of Y, on the straight line.

In the case of projecting something on a line, the projecting direction is a direction perpendicular to the line unless otherwise specified. For example, "project P on the axis" means "project P in a direction perpendicular to the axis onto the axis".

The rough guide portion 101*g* of the main assembly driving shaft 101 is provided between the shaft portion 101*f* and the gear portion 101*e* in the axial direction (FIG. 6). As shown in FIG. 9, the rough guide portion 101*g* has a tapered shape at the free end portion on the shaft portion 101*f* side, and the outer diameter D6 of the rough guide portion 101*g* is, as shown in FIG. 7, is smaller than the inner diameter D2 of inner surface 71*b* of the cylindrical portion 71 of the coupling unit 28. The outer diameter D6 of the rough guide portion 101*g* is larger than the outer diameter D5 of the shaft portion 101*f* as shown in FIG. 6. Thus, when the cartridge 7 is inserted into the image forming apparatus main assembly 100A, the main assembly driving shaft 101 is guided to be along the coupling unit 28 so as to reduce the axial misalignment between the rotation center of the cylindrical portion 71 and the rotation center of the shaft portion 101*f*. Therefore, the rough guide portion 101*g* can be said to be an insertion guide.

The rough guide portion 101*g* is set to have such a dimensional relationship that it does not abut on the inner peripheral surface 71*b*, after the mounting of the cartridge 7 to the image forming apparatus main assembly 100A is completed.

As shown in FIG. 7, the borne portion 101*d* of the main assembly driving shaft 101 is disposed on the opposite side of the rough guide portion 101*g* across the gear portion 101*e*. The borne portion 101*d* is rotatably supported by a bearing member 102 provided in the image forming apparatus main assembly 100A.

Further, as shown in FIG. 7, the main assembly driving shaft 101 is urged toward the cartridge 7 side by a spring member 103 of the image forming apparatus main assembly 100A. However, the movable amount (play) of the main assembly driving shaft 101 in the Z direction is about 1 mm which is sufficiently smaller than the width, measured in the Z direction, of the driving force receiving surface 65*ba* which will be described hereinafter.

As described above, the main assembly driving shaft 101 is provided with the main assembly drive transmission groove 101*a*, and the coupling unit 28 is provided with the engaging portion 65*a*, to transmit the drive from the main assembly 100A to the cartridge 7 (drum unit 30).

As will be described in detail hereinafter, the engaging portion 65*a* is urged by an urging member which is a compression spring elastically expandable and contractable. Therefore, the engaging portion 65*a* is configured to be movable at least outwardly in the radial direction of the drum unit 30 when the cartridge 7 is mounted to the apparatus main assembly 100A. Therefore, as the cartridge 7 is inserted into the apparatus main assembly 100A, the engaging portion 65*a* enters the drive transmission groove 101*a*, and the engaging portion 65*a* and the main assembly drive transmission groove 101*a* can engage with each other.

In the following description, the radial direction of the drum unit 30 may be simply referred to as the radial direction. The radial direction of the drum unit 30 is the radial direction of the photosensitive drum 1 and also the radial direction of the coupling unit 28.

[Structure of Coupling Member]

Referring to FIGS. 11, 12, 13, 14, and 15, the coupling unit 28 of this embodiment will be described in detail.

Figure 11:
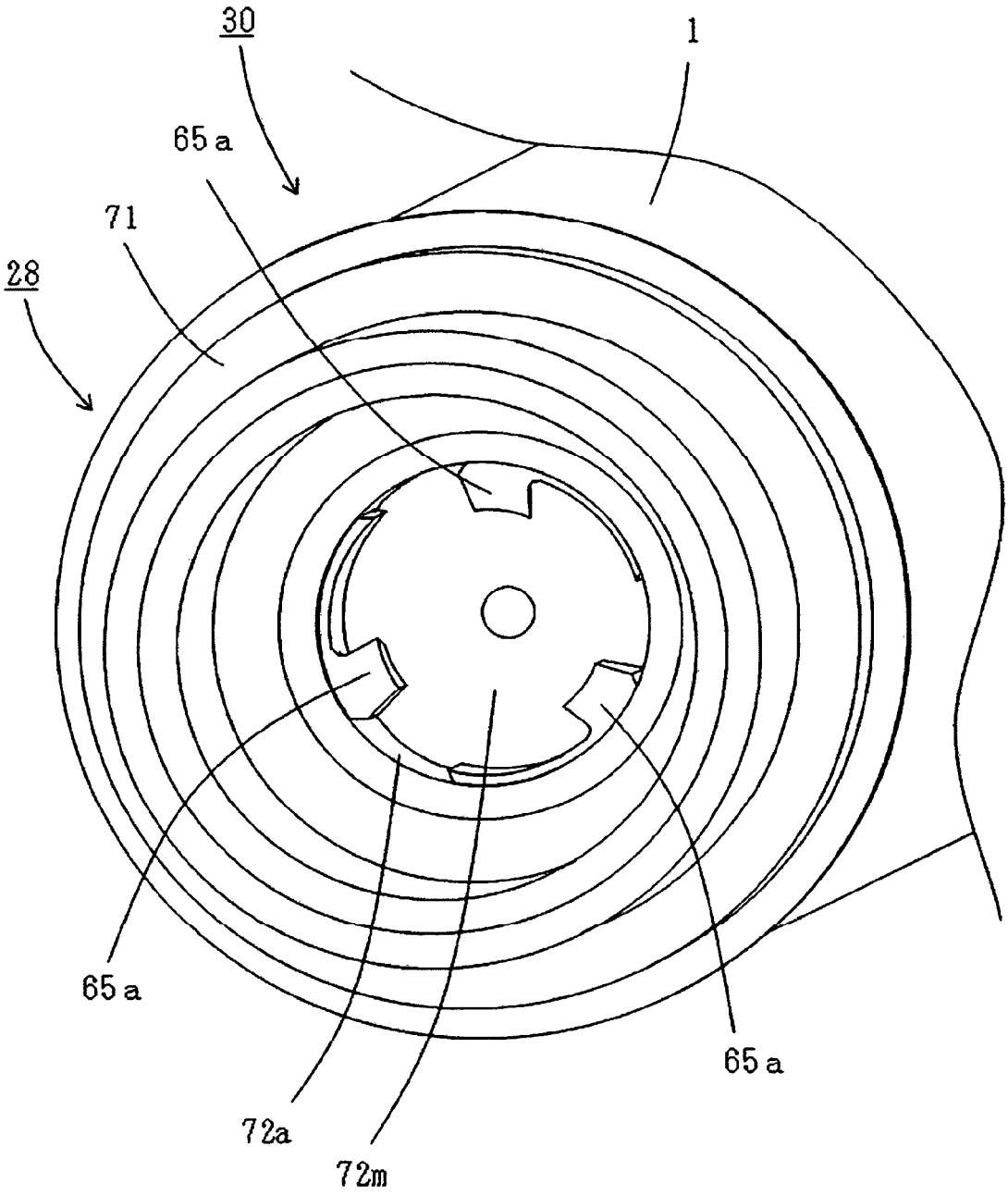
FIG. 11 is a perspective view of a driving side of the drum unit 30.

FIG. 11 is a driving side perspective view of the drum unit 30, in which the coupling unit 28 is mounted to the photosensitive drum 1.

Figure 12:
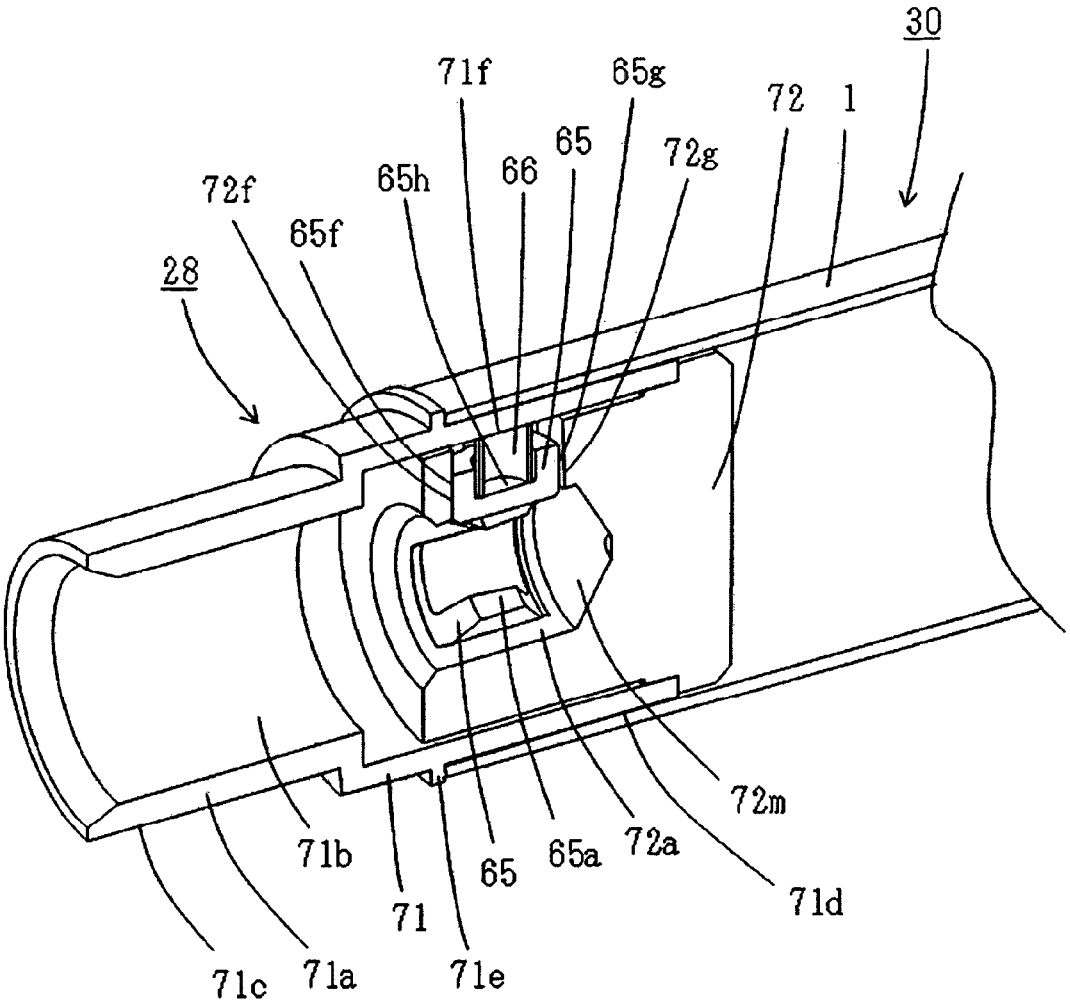
FIG. 12 is a sectional view of the driving side of the drum unit 30.

FIG. 12 is a drive-side cross-sectional view of the drum unit 30.

FIG. 13 is a perspective view of the engaging member 65, wherein part (a) of FIG. 13 is a perspective view as viewed from the upper left, and part (b) of FIG. 13 is a perspective view as viewed from the upper right.

FIG. 14 is a perspective view of members constituting the coupling unit 28.

FIG. 15 is a cross-sectional view of the coupling unit 28.

As shown in FIG. 11, the coupling unit 28 is provided with three engagement portions 65*a* engageable with the main driving shaft 101. As shown in FIG. 10, the engaging portion 65*a* enters the groove portion 101*a* of the main assembly driving shaft 101 so that the driving force receiving surface 65*b* of the engaging portion 65*a* and the drive transmission surface 101*b* of the main assembly driving shaft 101 come into contact with each other, and the driving force is transmitted from the main assembly driving shaft 101 to the coupling unit 28.

FIG. 12 is a sectional view of the state in which the coupling unit 28 is mounted to the photosensitive drum 1. The engaging member 65 including the engaging portion 65*a* is supported in a state of being urged by the urging member 66 toward the inner side in the radial direction of the coupling unit 28, in the coupling unit 28.

In the following, the structure of the coupling unit 28 will be specifically described. As shown in the sectional view of FIG. 12 and the perspective view of FIG. 14, the coupling unit 28 includes the flange member 71, a flange cap member 72, the engaging member 65, and the urging member 66.

The flange member 71 is mounted to the inner periphery of the photosensitive drum 1 and fixed to the photosensitive drum 1. The flange member 71 has a substantially cylindrical shape and is provided with a hollow portion. The flange member 71 is opened outward in the axial direction of the drum unit.

The flange cap member 72 is mounted to the inner surface of the hollow portion of the flange member 71. The flange cap member 72 closes the inside (bottom side) of the flange member 71 in the axial direction of the drum unit.

The flange cap member 72 is fixed to the photosensitive drum 1 by way of the flange member 71.

The structure is such that the engaging member 65 is held movably (slidably) on the flange cap member 72 and is movable (slidable) with respect to the flange cap member 72. The urging member 66 is an elastic member (spring member), and the structure is such that it urges the engaging member 65 inwardly at least in the radial direction of the drum unit.

In this embodiment, the flange member 71, the flange cap member 72, the engaging member 65, and the urging member 66 are formed as separate bodies (separate members). In this example, the engaging member 65 is constituted to be movable along the radial direction of the coupling unit (substantially parallel to the radial direction). In addition, the engaging member 65 and the urging member 66 are arranged along the radial direction. That is, the structure is such that both the engaging member 65 and the urging member 66 are disposed on an imaginary line parallel to the radial direction of the coupling unit.

As shown in FIG. 11, three engaging members 65 are disposed at even intervals in the circumferential direction of the coupling unit 28 (at 120 degree intervals, substantially equally spaced). In addition, as shown in FIG. 13, the engaging member 65 has an engaging portion 65*a* projecting inward in the radial direction and a driving force receiving surface 65*b* formed in the engaging portion 65*a*. The engaging member 65 also has a driving shaft abutment surface (driving shaft abutment portion) 65*c* which is formed adjacent to the driving force receiving surface 65*b* and which is formed in an arc shape so as to be in contact with the outer circumferential surface 101*f* of the main assembly driving shaft. The driving force receiving surface 65*b* is a driving force receiving portion which receives the driving force from the main assembly driving shaft 101 by contacting the driving groove 101*a*. The engaging portion 65*a* is a projecting portion (projecting portion) projecting (projecting) from the surface of the engaging member 65.

The engaging member 65 is a driving force receiving member provided with a driving force receiving portion (driving force receiving surface 65*b*), and is also a supporting member for supporting the driving force receiving surface 65*b*.

The engaging member 65 is provided with a first guided surface (surface to be guided) 65*d* and a second guided surface (surface to be guided) 65*e* for being guided (guided) in the radial direction in the coupling unit. The first guided surface 65*d* is a position regulating portion for regulating the position of the engaging member 65 in the circumferential direction, and is disposed on the side closer to the engaging portion 65*a*. The second guided surface 65*e* is a position regulating portion for regulating the position of the engaging member 65 in the circumferential direction and is disposed on a side far from the engaging portion 65*a*.

The first guided surface 65*d* and the second guided surface 65*e* are guided portions guided by a flange cap member 72, which will be described hereinafter. The first guided surface 65*d* and the second guided surface 65*e* are restricted portions, positions of which are regulated by the flange cap member 72, in the rotational direction (circumferential direction) of the drum unit. The first guided surface 65*d* is an upstream side guided portion (the upstream side restricted portion) located on a downstream side of the engaging member 65 in the rotational direction of the coupling unit. The second guided surface 65*e* is a downstream guided portion (the downstream regulated portion) positioned on the upstream side of the engaging member 65 in the rotational direction.

The first guided surface 65*d* and the second guided surface 65*e* are substantially parallel to each other.

In addition, a third guided surface 65*f* and a fourth guiding surface 65*g* for regulating the position of the engaging member 65 in the axial direction are provided. The third guided surface 65*f* and the fourth guiding surface 65*g* are guided portions to be guided by the flange cap member 72 which will be described hereinafter hereinafter. The third guided surface 65*f* and the second guided surface 65*g* are regulated portions, the positions of which are regulated by the flange cap member 72 in the axial direction (longitudinal direction) of the drum unit. The third guided surface 65*f* is the outer guided portion (and the outer restricted portion) located outside the engaging member 65 in the axial direction of the drum unit. The fourth guide surface 65*g* is a downstream guided portion (and a downstream regulated portion) located on the downstream side of the engaging member 65 in the axial direction.

The third guided surface 65*f* and the fourth guide surface 65*g* are substantially parallel to each other.

Furthermore, the engaging member 65 is provided with a contact surface (an urged portion, urged surface) 65*h* (FIG. 10) for receiving an urging force by the urging member 66. The engaging member 65 also is provided with a position regulating projection 65*i* for restricting the position of the engaging member 65 by abutting against the flange cap member 72 by the urging force of the urging member 66. In particular, the structure is such that the urging force position regulating surface (engaged portion) 65*j* formed on the position restricting projection is brought into contact with the flange cap member 72. The position regulating projection 65*i* is provided on both sides of the engaging member 65 with an contact surface 65*h* relative to the urging member 66 interposed therebetween.

The engaging member 65 has an insertion tapered surface 65*k* on the outer side (the Z1 direction side) of the photosensitive drum unit 30 in the Z direction. The insertion taper surface 65*k* is an inclined portion facing outward in the axial direction. The insertion tapered surface 65*k* is a mounting force receiving portion which receives a force for retracting the engaging member 65 in the radial direction when the cartridge is mounted. In addition, the engaging member 65 has a tapered portion 65*l* as a dismounting force receiving portion on the inner side (the Z2 direction side) of the photosensitive drum unit 30 in the Z direction. The removal tapered surface 65*l* is a dismounting force receiving portion which receives a force for retracting the engaging member 65 in the radial direction when the cartridge is dismounted.

The flange cap member 72 is provided with a coupling hole portion 72*a* for allowing the main assembly driving shaft 101 to pass therethrough and a mounting hole portion 72*b* for supporting the engaging member 65 so as to be movable in the radial direction. The engaging portion 65*a* of the engaging member 65 is exposed through the coupling hole portion 72*a* in order to engage the engaging member with the main assembly driving shaft. The mounting hole 72*b* is provided with a first guide surface 72*d* abutting on the first guided surface 65*d* which is the surface for regulating the position of the engaging member 65 in the circumferential direction, and is provided with a second guide surface 72*e* which is in contact with the second guided surface 65*e*. In addition, the mounting hole 72*b* is provided with a third guide surface 72*f* which contacts the third guided surface 65*f* which is a surface restricting the position of the engaging member 65 in the axial direction, and is provided with a fourth guide surface 72*g* contacting the fourth guide surface 65*g* which is a surface opposed to the third guided surface.

The first guide surface 72*d*, the second guide surface 72*e*, the third guide surface 72*f*, and the fourth guide surface 72*g* are guide portions for guiding the engaging member 65, and is also restricting portions (position restricting portions) for restricting the position of the engaging member.

The first guide surface 72*d* is an upstream guide (upstream restriction portion) which guides the upstream side of the engaging member 65 in the rotational direction of the drum unit and regulates the position. Similarly, the second guide surface 72*e* is a downstream guide (downstream regulating portion) that guides the downstream side of the engaging member 65.

The engaging member 65 and the urging member 66 are disposed in a space between the first guide surface 72*d* and the second guide surface 72*e*.

In addition, the third guide surface 72*f* is an outer guide portion (outer regulating portion) which guides the outside of the engaging member 65 in the axial direction of the drum unit and regulates the position. Similarly, the fourth guide surface 72 *g* is an inner guide portion (inner restriction portion) which guides the inside of the engaging member 65 in the axial direction and regulates the position.

The flange cap member 72 is a guide member which guides the engaging member 65 by using these guide portions (the first guide surface 72*d*, the second guide surface 72*e*, the third guide surface 72*f*, and the fourth guide surface 72*g*). The flange cap member 72 is a holding member which holds the engaging member 65 movably (guidably).

The first guide surface 72*d* and the second guide surface 72*e* are substantially parallel to each other. The third guide surface 72*f* and the fourth guide surface 72 *g* are substantially parallel to each other.

The engaging member 65 is a moving member which is movably held by the flange cap member 72 and is also a sliding member which is slidable with respect to the flange cap member 72.

In addition, in order to regulate the position of the engaging member 65 against the urging force of the urging member 66, the flange cap member 72 is provided with the restricting surface (engaging portion) 72*j*.

The restricting surface (engaging portion) 72*j* restricts the engaging member 65 from moving inward in the radial direction by making contact with the urging force position regulating surface (radially-projecting portion) 65*j*. That is, the restricting surface (locking portion) 72*j* locks a locking member 65 against the urging force of the urging member 66. In a state in which the cartridge 7 is not mounted to the apparatus main assembly (a spontaneous state in which no external force is applied to the cartridge 7), the locking member 65 is urged toward the restricting surface 72*j* by the urging force of the urging member 66.

In addition, the flange cap member 72 is provided with a fitting surface 72*k* to be fitted with the inner peripheral surface of the flange member 71 and a position regulating groove 721 for regulating the position in the rotational direction with respect to the flange member 71. Furthermore, the flange cap member 72 is in contact with the semispherical shape 101*c* of the main assembly driving shaft 101 including the conical surface 72*m* so as to position the main assembly driving shaft 101 with respect to the flange cap member 72.

Here, the positioning portion need not be a conical recess like the conical surface 72*m*. If the position of the photosensitive drum unit 30 with respect to the main driving shaft 101 can be determined when the radial positioning portion and the longitudinal positioning portion are brought into contact with the free end (semi-closed shape 101*c*) of the main driving shaft 101, the shape may be any. For example, a recess portion (recess portion) including a narrowed portion is preferable as it goes toward the bottom portion. As an example of such a shape, a cone shape which is not a polygonal cone such as a pyramid (a square pyramid etc.) can also be used. However, as long as the conical shape is symmetrical with respect to the axis of the coupling unit 28 like the conical shape portion 72*m* of this embodiment, the position of the coupling unit 28 can be maintained with particularly high accuracy.

Here, the conical shape portion 72*m* may have a region for contact with the main assembly driving shaft 101, and therefore, the region not contacted thereby may have any shape. For example, the bottom portion of the conical shape portion 72*m* is not necessarily contacted by the main assembly driving shaft 101, and therefore, the conical shape portion 72*m* may not have a bottom surface.

The flange member 71 is provided with a fitting portion 71*d* relative to the photosensitive drum, and a flange portion 71*e* formed at the axial end portion of the fitting portion. Furthermore, the flange member 71 includes a cylindrical portion 71*a* extending further in the axial direction from the flange portion 71*e*. The cylindrical portion 71*a* is formed with an inner peripheral surface 71*b* through which the main assembly driving shaft 101 passes, and with a borne portion 71*c* supported by the bearing member. As shown in FIG. 14, the flange portion 71*e* has a shape projecting outward from the fitting portion 71*d* in the radial direction. When assembling the photosensitive drum 1 of the coupling unit 28, the end surface of the photosensitive drum 1 is brought into abutment with the end surface of the flange portion 71*e*, thereby determining the positions of the photosensitive drum 1 and the coupling unit 28 in the Z direction.

As shown in FIG. 12, the fitting portion 71*d* of the flange member 71 is press-fitted into the inner diameter portion of the cylinder of the photosensitive drum 1. By advancing the flange member 71 in the axial direction until the flange portion 71*e* of the flange member 71 abuts against the end surface of the photosensitive drum and pressing the fitting portion 71*d* into the photosensitive drum 1, the coupling unit 28 is accurately positioned with respect to the photosensitive drum 1. More specifically, the cylinder inner diameter of the photosensitive drum 1 and the outer shape of the fitting portion 71*d* are dimensioned so as to be in a tight fitting relation.

As described above, after mounting the flange member 71 to the photosensitive drum 1, the flange member 71 and the photosensitive drum 1 are fixed by a clamping fixing method. More specifically, a portion where the cylinder end portion of the photosensitive drum 1 is plastically deformed is inserted into a groove (not shown) formed in the fitting portion 71*d* of the flange member 71 to firmly couple the photosensitive drum 1 and the flange member 71. Here, the clamping refers to joining a plurality of parts with each other by partial plastic deformation.

Here, the fixing method by clamping is an example of a means for firmly fixing the flange member 71 to the photosensitive drum 1, and another fixing means such as fixing the inner diameter of the cylinder and the fitting portion 71*d* by adhesion may be used.

As described above, the cylindrical portion 71*a* of the flange member 71 is provided with the borne portion 71*c* on the free end side (the Z1 direction side) of the outer peripheral surface thereof (FIGS. 4 and 9). In other words, the coupling unit has a borne portion 71*c* having a cylindrical outer shape on the Z1 direction side (outer side in the axial direction) with respect to the engaging member. By employing such a shape, the engaging portion 65*a* is not exposed at the outer surface of the cartridge 7. For this reason, the engaging portion 65*a* of the engaging member 65 can be protected by the drum unit bearing member 39R and the borne portion 71*c*. By this, it is possible to prevent the user from unintentionally touching the engaging portion 65*a* or to prevent something from hitting the engaging portion 65*a* directly when the cartridge 7 falls. In addition, as shown in FIG. 14, the inner peripheral surface 71*b* of the cylindrical portion 71 is provided with a tapered shape 71*g* at the front end (Z1 direction) free end. The tapered shape 71*g* is an inclined portion (inclined surface) for guiding the main assembly driving shaft 101 inserted into the cylindrical portion 71.

The urging member 66 is an elastically expandable compression coil spring, and applies a reaction force in a direction in which the compression spring extends, against the external force in the compression direction of the compression spring. Here, the urging member 66 may apply an urging force to the engaging member 65 radially inward, and therefore, in addition to the compression coil spring as in this embodiment, a leaf spring or an urging member (elastic member, spring member) such as a torsion coil spring may be used, for example.

It is also possible to make the urging member 66 integral with the engaging member 65 or the flange cap member 72. In this example, however, the urging member 66 is formed separately from the engaging member 65 and the flange cap member 72. By doing so, the latitude of selection of the urging member 66 is increased, and an appropriate urging member 66 can be easily selected. For example, it is easier to select the urging member 66 providing an appropriate urging force (elastic force) for urging the engaging member 65.

With respect to the coupling unit 28 constituted as described above, the supporting structure of the engaging member 65 will be described in detail. FIG. 15 is a sectional view taken along perpendicular to the axial direction of the coupling unit.

The first guided surface 65*d* and the second guided surface 65*e* of the engaging member 65 contact and guide the first guide surface 72*d* and the second guide surface 72*e* of the flange cap member 72, respectively. And, as shown in FIG. 12, the third guided surface 65*f* and the fourth guiding surface 65 *g* of the engaging member 65 come into contact with the third guide surface 72*f* and the fourth guide surface 72 *g* of the flange cap member 72, respectively. By the abutment of these guide surfaces, the engaging member 65 is guided and supported so as to be movable at least in the radial direction with respect to the flange cap member 72. That is, a vector along the direction in which the engaging member 65 moves has at least a component in the radial direction of the drum unit. In this embodiment, the engaging member 65 is movable in parallel with a substantially radial direction.

The engaging member 65 is urged inward in the radial direction of the coupling unit 28 by the urging member 66. The urging member 66 is compressed in a state of being sandwiched between the contact surface 65*h* of the engaging member 65 and the inner peripheral surface of the flange member 71, and therefore, exerts an urging force in a direction in which the urging member 66 expands, thereby urging the engaging member 65.

The position of the engaging member 65 is restricted by the contact between the position restricting surface 65*j* and the restricting surface 72*j* of the flange cap member 72 against the urging force.

The engaging member 65 is supported by the flange cap member 72 in a state that the engaging portion 65*a* thereof is exposed through the hole 72*a* of the flange cap member 72. In addition, similarly, the driving shaft abutment surface 65*c* formed in an arc shape on the engaging member 65 is exposed through the hole 72*a* of the flange cap member 72. The engaging portion 65*a* of the engaging member 65 projects inward in the radial direction from the inner peripheral surface of the hole portion 72*a* of the flange cap member 72.

The amount by which the engaging portion 65*a* projects with respect to the driving shaft abutment surface 65*c* of the engaging member 65 is enough for the engaging portion 65*a* to assuredly enter the groove 101*a* of the driving shaft. This amount of projection is enough for the driving force receiving surface 65*b* formed in the engaging portion 65*a* to have the strength corresponding to the load torque of the photosensitive drum unit 30 which is the member to be rotated. That is, it will suffice if the driving force receiving surface 65*b* of the engaging portion 65*a* can stably transmit the driving force from the main assembly driving shaft 101. In the case of this embodiment, the projection amount of the engaging portion 65*a* is selected such that the distance measured from the inner surface of the flange cap member 72 to the free end of the engaging portion 65*a* along the radial direction of the coupling unit is 1 mm to 3 mm.

In addition, similarly, the driving shaft abutment surface 65*c* of the engaging member 65 also projects inward in the radial direction from the inner peripheral surface of the hole portion (hollow portion) 72*a* of the flange cap member 72. The projection amount (exposure amount) by which the driving shaft abutment surface 65*c* projects from the inner peripheral surface of the hole portion 72*a* is such that the driving shaft abutment surface 65*c* assuredly projects from the inner peripheral surface of the hole portion 72*a* even when the dimensions of the respective parts vary. In the case of this embodiment, the amount of projection of the driving shaft abutment surface 65*c* projecting from the inner peripheral surface of the hole 72*a* is preferably 0.3 mm to 1 mm. That is, the distance from the inner surface of the flange cap member 72 to the driving shaft abutment surface 65*c* measured along the radial direction of the coupling unit is 0.3 mm to 1 mm.

As described above, the engaging portion 65*a* and the driving shaft abutment surface 65*c* of the engaging member 65 are exposed through the hole 72*a* and can engage with and abut to the main assembly driving shaft 101. The structure in which the engaging member 65 is engaged with the main driving shaft 101 and the drive transmission is performed will be described hereinafter.

[Mounting of Cartridge to Image Forming Apparatus Main assembly]

With reference to FIGS. 16, 17, 18 and 19, mounting and dismounting of the process cartridge 7 relative to the image forming apparatus main assembly will be described.

FIG. 16 is a perspective view illustrating the mounting of the cartridge 7 to the image forming apparatus main assembly 100A.

FIGS. 17, 18 and 19 are cross-sectional views illustrating the mounting operation of the cartridge 7 to the image forming apparatus main assembly 100A.

The image forming apparatus main assembly 100A of this embodiment employs a structure capable of mounting the cartridge in a substantially horizontal direction. Specifically, the image forming apparatus main assembly 100A has an inside space in which a cartridge can be mounted. The image forming apparatus main assembly has a cartridge door 104 (front door) for inserting the cartridge into the space, at the front side of the main assembly 100A (the side near the user standing in use).

As shown in FIG. 16, the cartridge door 104 of the image forming apparatus main assembly 100A is provided so as to be opened and closed. When the cartridge door 104 is opened, the lower cartridge guide rail 105 for guiding the cartridge 7 is provided on the bottom surface defining the space, and the upper cartridge guide rail 106 is provided on the upper surface. The cartridge 7 is guided to the mounting position by the upper and lower guide rails (105, 106) provided above and below the space. The cartridge 7 is inserted into the mounting position substantially along the axis of the photosensitive drum unit 30.

Referring to FIGS. 17, 18 and 19, the mounting and dismounting operations of the cartridge to the image forming apparatus main assembly 100A will be described below.

As shown in FIG. 17, the drum unit bearing member 39R or the photosensitive drum 1 does not contact the intermediary transfer belt 5 at the start of insertion of the cartridge 7. In other words, the size relationship is such that the photosensitive drum 1 and the intermediary transfer belt 5 do not contact with each other in a state in which the end portion on the rear side with respect to the inserting direction of the cartridge 7 is supported by the lower cartridge guide rail 105.

As shown in FIG. 18, the image forming apparatus main assembly 100A includes a rear side lower cartridge guide 107 projecting upward with respect to the direction of gravity from the lower cartridge guide rail 105 toward the rear side in the inserting direction of the lower cartridge guide rail 105. The rear side lower cartridge guide 107 is provided with a tapered surface 107*a* on the front side with respect to the inserting direction of the cartridge 7. Along with the insertion, the cartridge 7 rides on the tapered surface 107*a* and is guided to the mounting position.

The position and the shape of the rear side lower cartridge guide 107 may be any if a part of the cartridge does not rub the image forming area 5A of the intermediary transfer belt 5 when the cartridge is inserted into the apparatus main assembly 100A. Here, the image forming area 5A is a region where a toner image to be transferred onto the recording material 12 is carried on the intermediary transfer belt 5. Further, in this embodiment, of parts of the cartridges in the mounting attitude, the unit bearing member 39R provided on the rear side with respect to the inserting direction of the cartridge 7 most protrudes upward with respect to the direction of gravity. Therefore, it will suffice if the arrangement and the shape of each element are appropriately selected so that the trace (hereinafter referred to as insertion trace) of the end of the drum unit bearing member 39R farthest in the inserting direction at the time of the insertion Of the cartridge does not interfere with the image forming area 5A.

Thereafter, the cartridge 7 is further inserted to the rear side of the image forming apparatus main assembly 100A from the state in which it is on the rear side lower cartridge guide 107. Then, the drum unit bearing member 39R abuts to the rear cartridge positioning portion 108 provided in the image forming apparatus main assembly 100A. At this time, the cartridge 7 (the photosensitive drum unit 30) is inclined by about 0.5 to 2 degrees relative to the state in which the cartridge 7 (photosensitive drum unit 30) is completely mounted in the image forming apparatus main assembly 100A (part (d) of FIG. 17). That is, in the inserting direction of the cartridge 7, the downstream side of the cartridge 7 (photosensitive drum unit 30) is at an upper level than the upstream side.

FIG. 19 is an illustration of the state of the apparatus main assembly and the cartridge when the cartridge door 104 is closed. The image forming apparatus 100A has a front side lower cartridge guide 109 on the front side, with respect to the inserting direction, of the lower cartridge guide rail 105. The front side cartridge lower guide 109 is configured to move up and down in interrelation with the opening and closing of the cartridge door (front door) 104.

When the cartridge door 104 is closed by the user, the front side cartridge lower guide 109 is raised. Then, the drum unit bearing member 39L and the near side cartridge positioning portion 110 of the image forming apparatus main assembly 100A are brought into contact to each other, so that the cartridge 7 is positioned relative to the image forming apparatus main assembly 100A.

With the above-described operation, the mounting of the cartridge 7 to the image forming apparatus main assembly 100A is completed.

In addition, dismounting of the cartridge 7 from the image forming apparatus main assembly 100A is performed in the reverse order of the above-described inserting operation. Because the oblique mounting structure is employed as described above, it is possible to suppress the rubbing between the photosensitive drum and the intermediary transfer belt when the cartridge 7 is mounted on the apparatus main assembly 100A. For this reason, it is possible to suppress the occurrence of minute scratches (scratches) on the surface of the photosensitive drum or the surface of the intermediary transfer belt.

Further, the structure of this embodiment can simplify the structure of the image forming apparatus main assembly 100A as compared with the structure in which the entire cartridge is lifted up after the cartridge is horizontally moved and mounted to the apparatus main assembly.

[Engaging Process of Coupling Member with Main Drive Shaft]

Referring to FIGS. 20, 21, 22, 23, 24, 25 and 26, the engagement process of the coupling unit 28 and the main assembly driving shaft 101 will be described in detail.

FIGS. 20, 21 and 22 are cross-sectional views illustrating a mounting operation of the coupling unit 28 to the main assembly driving shaft 101.

FIGS. 23 and 24 are sectional views illustrating the mounting operation of the coupling unit 28 to the main assembly driving shaft 101 when the main assembly driving shaft 101 rotates from a state in which the phases of the main assembly drive transmission groove 101*a* and the engaging portion 65 (the drive force receiving surface 65*b*) are not aligned, to the state in which the phases are aligned.

FIG. 25 is a cross-sectional view illustrating the relationship of forces acting on the engaging member.

FIG. 26 is an axial cross-sectional view illustrating drive transmission engagement surfaces of the engaging member and the main assembly driving shaft.

In addition, FIGS. 21 and 23 illustrate a state in which the phases of the main assembly drive transmission groove 101*a* and the engaging portion 65 (driving force receiving surface 65*b*) are not aligned.

The cartridge 7 is inserted into the apparatus main assembly 100A as described above. Then, along with the mounting operation of the cartridge, the coupling unit abuts to the semispherical shape 101*c* formed at the free end of main assembly driving shaft 101 and an inclined surface formed at the end of the rough guide portion 101*g* of the main assembly driving shaft. By this main assembly driving shaft 101 is guided to the inner surface 71*b* of the flange member 71 of the coupling unit.

FIG. 20 shows a state in which the main assembly driving shaft 101 thus guided is in contact with the engaging member 65 of the coupling unit. The semispherical shape 101*c* of the main driving shaft abuts against the insertion tapered surface 65*k* formed on the engaging member 65.

From this state, a force is further applied in a direction to mount the cartridge 7 further. Then, the force in the cartridge mounting direction acts in a direction in which the engaging member 65 is retracted to the outside in the radial direction by the insertion tapered surface 65*k*. Therefore, with the free end of the main assembly driving shaft 101 in contact with the insertion tapered surface 65*k*, it is possible to further move the cartridge 7 to the rear side of the apparatus main assembly.

FIGS. 21 and 23 show a state in which the cartridge 7 is moved to the rear side in this manner and the mounting of the cartridge 7 to the apparatus main assembly 100A is completed. In this state, the semispherical shape 101*c* of the main assembly driving shaft abuts against the conical surface 72*m* of the coupling unit, and the main assembly driving shaft 101 is positioned in the axial direction and the radial direction with respect to the coupling unit 28.

As aforementioned, the engaging member 65 is guided by the first, second, third and fourth guide surfaces of the flange cap member 72 on the first, second, third, and fourth guided surfaces of the engaging member 65, so that it retracts in the radial direction until the free end of the engaging portion comes into contact with the outer peripheral surface of the shaft portion 101*f* of the main assembly driving shaft. At this time, as shown in FIG. 23, the restricting surface 65*j* against the urging force of the engaging member 65 is separated from the restricting surface 72*j* of the flange cap member. In addition, the urging member 66 is further compressed and contracted as compared with the state shown in FIG. 15 in which the main assembly driving shaft 101 is not inserted into the coupling unit 28.

Thereafter, at the time of starting up the image forming apparatus main assembly or at the start of the image forming operation, the main assembly driving shaft 101 rotates. Then, as shown in FIG. 22 and FIG. 24, the engaging portion 65*a* of the engaging member enters the groove 101*a* of the main assembly driving shaft. By this, the engaging member 65 moves radially inward until the driving shaft abutment surface 65*c* of the engaging member comes into contact with the outer peripheral surface of the shaft portion 101*f* of the main assembly driving shaft. Here, in FIG. 24, the position restricting surface 65*j* of the engaging member is also in contact with the restricting surface 72*j* of the flange cap member.

However, in order to bring the driving shaft abutment surface 65*c* of the engaging member more reliably into contact with the outer peripheral surface of the shaft portion 101*f* of the main assembly driving shaft, it is desirable to select a dimensional relationship such that a predetermined clearance is always formed between the position restricting surface 65*j* and the restricting surface 72*j*. That is, in order that a clearance is positively generated between the position restricting surface 65*j* and the restricting surface 72*j* in a state where the driving shaft abutment surface 65*c* of the engaging member is in contact with the outer circumferential surface of the shaft portion 101*f* of the main assembly driving shaft, even when dimensional variation occurs.

Furthermore, as the main assembly driving shaft 101 rotates from the state of FIG. 24, the drive transmission surface 101*b* of the main assembly driving shaft and the drive force receiving surface 65*b* of the engagement portion are brought into contact with each other so that the drive transmission to the photosensitive drum 1 is enabled, as shown in FIG. 25. As described above, the engaging portion 65*a* of the engaging member engages with the main assembly driving shaft 101.

In FIG. 22, the engaging portion 65*a* is disposed such that in the Z direction, the distance L1 from the front end surface of the cylindrical portion 71 to the front end surface of the engaging portion 65*a* and the length L2 of the driving force receiving surface 65*b* satisfy which L1>L2.

As shown in FIG. 22, a conical shape portion 72*m* is arranged such that the center 101*h* of the semispherical shape 101*c* falls within the range L2 of the driving force receiving surface 65*b* of the engaging member 65 in the Z direction. If the engaging portion 65*a* and the center 101*h* are projected on the axis of the drum unit 30, the center 101*h* is disposed inside the projection region L2 of the driving force receiving surface 65*b* of the engaging portion 65*a*. By establishing such an arrangement relationship, the following effects can be provided.

As shown in FIG. 4, FIG. 5, and FIG. 19, the drum unit bearing member 39R and the drum unit bearing member 39L abut against the rear side cartridge positioning portion 108 and the rear side cartridge positioning portion 110, respectively. By this, the position of the cartridge 7 with respect to the image forming apparatus main assembly 100A is determined. Here, the relative position between the main assembly driving shaft 101 and the coupling unit 28 is affected by part tolerances. More specifically, the position shifts due to the influence of the component tolerances from the drum unit bearing member 39R to the coupling unit 28 and the component tolerances from the rear side cartridge positioning unit 108 to the main assembly driving shaft 101.

As shown in FIG. 6 and FIG. 22, the semispherical shape 101*c* of the main assembly driving shaft 101 abuts against the inverted conical shape 533*a*, and the borne portion 101*d* and the semispherical shape 101*c* establish the both-end supported structure. That is, as viewed from the coupling unit 28, the main assembly driving shaft 101 is inclined about the center 101*h* of the semispherical shape 101*c*. The same position as the center 101*h* in the Z axis direction is the position that is least affected by this inclination. The driving force receiving surface 65*b* is arranged at the same position as the center 101*h* in the Z axis direction, so that the influence of the positional shift can be minimized. That is, the position at which the photosensitive drum 1 can be stably driven is determined.

Here, in this embodiment, a projection for receiving a driving force is provided on the engaging member 65 side, but it is possible that a groove for receiving drive by engaging members is provided, and a movable projection which can engage with the groove by moving in the radial direction on the main assembly driving shaft 101 side is provided. However, as compared with the cartridge 7, the image forming apparatus main assembly 100A is required to have higher durability. From the stand point of enhancing the durability of the image forming apparatus main assembly 100A, it is preferable to provide the movable portion (the engaging portion 65) which moves in the radial direction, on the coupling unit 28 side of the cartridge 7 as in this embodiment.

[Driving of Coupling Unit by Main Assembly Driving Shaft]

Referring to FIG. 25 and FIG. 26, a structure for transmitting the rotational driving force to the coupling unit 28 will be described.

First, the supporting structure for the engaging member 65 during coupling drive will be described in detail. As shown in FIG. 25, when the main assembly driving shaft 101 is rotationally driven in the arrow R direction, the drive transmission surface 101*b* formed in the groove 101*a* of the main assembly driving shaft abuts against the driving force receiving surface 65*b* formed on the engaging portion 65*a* of the engagement member to give a force F in the normal direction of the drive force receiving surface 65*b*. When the driving force F acts on the driving force receiving surface, the first guided surface 65*d* of the engaging member and the first guide surface 72*d* of the flange cap are brought into contact with each other, by this force. In addition, more preferably, the driving shaft abutment surface 65*c* of the engaging member abuts against the outer peripheral surface of the shaft portion 101*f* of the main assembly driving shaft. By this, the engaging member 65 is strongly supported between the flange cap member 72 and the main assembly driving shaft 101.

Next, the force produced to the engaging member 65 and the supporting structure of the engaging member 65 using this force will be described.

The driving force receiving surface 65*b* is inclined with respect to the moving direction S of the engaging member 65 so as to face. outside at least in the radial direction. That is, the normal vector of the driving force receiving surface 65*b* (a vector extending perpendicularly to the driving force receiving surface 65*b* toward the side where the driving force receiving surface 65*b* faces) is a component outward in the radial direction of the coupling unit.

In other words, the radially inner side of the driving force receiving surface 65*b* (the free end side of the engaging portion 65*a*) is in the upstream side of the driving force receiving surface 65*b* in the radial direction (the rear end side of the engaging portion 65*a*) in the rotational direction of the drum unit.

When the driving force F is vertically applied to the driving force receiving surface 65*b* of the engaging portion, the direction in which the driving force F is produced is inclined inwardly in the radial direction with respect to the circumferential direction (circumferential direction) of the coupling unit. That is, when drawing an imaginary circle passing through the driving force receiving surface 65*b* concentrically with the coupling unit, the driving force F is inclined so as to be directed radially inward with respect to the tangent of this imaginary circle.

Therefore, the driving force F is divided into a force F1 which is a tangential component along the tangent of the imaginary circle (circumferential direction component, rotational direction component) and a force F2 which is a radial direction component directed inward in the radial direction.

The driving force receiving surface 65*b* of the engaging member is urged radially inward by the force F2 applied on the driving force receiving surface 65*b*. It is possible to prevent the driving force receiving surface 65*b* from moving radially outward, and therefore, it is also possible to prevent the drive force receiving surface 65*b* from disestablishing the contact state with the drive transmission surface 101*b* of the main assembly driving shaft.

In addition, the direction of movement S in which the engaging member is movably guided radially inwardly to the flange cap member is inclined by an angle θ relative to the direction of the force F acting in the normal direction of the driving force receiving surface. By this, as shown in part (b) of FIG. 25, the force F acting on the driving force receiving surface has a component FS acting in the moving direction S of the engaging member. This force FS prevents the movement of the engaging member 65 to the opposite side in the moving direction S, and therefore, it is possible to prevent the driving force receiving surface 65*b* of the engaging member from being disengaged from the drive transmission surface 101*b* of the main assembly driving shaft to the outside. To put it simply in a different way, the direction of the driving force receiving surface 65*b* is inclined toward a direction in which the driving force receiving surface 65*b* bites into the drive transmission surface 101*b* of the main assembly driving shaft, relative to the moving direction of the engaging member 65.

In addition, more preferably, the driving shaft abutment surface 65*c* of the engaging member may be brought into contact with the outer peripheral surface of the shaft portion 101*f* of the main assembly driving shaft.

As shown in FIG. 25, the driving shaft abutment surface 65*c* is provided on the side opposite to the direction of the driving force F with respect to the driving force receiving surface 65*b*. By this, the rotational moment M produced in the engaging member 65 is supported by the driving shaft abutment surface 65*c* by the force F acting on the driving force receiving surface, so that the engaging member 65 can be more firmly supported. The driving shaft abutment surface 65*c* of the engaging member projects radially inwardly of the hole inner circumferential surface 72*a* of the flange cap member. By this, even when there are variations in dimensions and assembly accuracy of each portion, the driving shaft abutment surface 65*c* can be reliably brought into contact with the outer peripheral surface of the driving shaft 101*f*. That is, it is preferable that at least a portion of the driving shaft abutment surface 65*c* is disposed on the upstream side of the driving force receiving surface 65*b* in the rotational direction of the drum unit.

In this manner, the engaging member 65 is strongly supported between the flange cap member 72 and the main assembly driving shaft 101. By this, it is possible to prevent disengagement of the engaging member 65 out of the main assembly driving shaft 101 and to stably transmit the driving force from the main assembly driving shaft 101 to the engaging member 65. And, it is possible to improve the driving stability of the photosensitive drum 1 and to improve the image quality.

Next, the inclination of the engaging portion in the axial direction of the driving force receiving surface 65*b* will be described. FIG. 26 is a cross-sectional view of the engaging portion 65*a* of the engaging member taken along a plane extending in the normal direction of the driving force receiving surface 65*b*. That is, FIG. 25 is a cross-sectional view taken along the direction of the arrow of force F in FIG. 25. Here, the main assembly drive transmission surface 101*b* formed in the drive transmission groove 101*a* of the main assembly driving shaft 101 and the drive force receiving surface 65*b* formed on the engaging portion 65*a* of the engagement member come into contact with each other, and the driving force of the main assembly driving shaft 101 is transmitted to the engaging member 65.

As described in the foregoing, the main assembly drive transmission surface 101*b* has a shape twisted about the axis of the coupling unit 28, and on FIG. 26, the main assembly drive transmission surface 101*b* is inclined with respect to the rotation axis of the main assembly driving shaft 101. The driving force receiving surface 65*b* of the engaging portion also has the same twisted shape in order to contact with the main assembly drive transmission surface 101*b*, and therefore, the driving force receiving surface 65*b* is inclined with respect to the rotational axis of the main assembly driving shaft 101. More particularly, the outer side of the driving force receiving surface 65*b* in the axial direction of the drum unit is disposed on the upstream side in the rotational direction of the drum unit than the inner side.

Therefore, the force F in the normal direction applied from the main assembly drive transmission surface 101*b* to the driving force receiving surface 65*b* has a force F3 as a component in the rotational axis direction. That is, the force F3 for urging the engaging member 65 and the coupling unit 28 outward in the longitudinal direction of the photosensitive drum is generated. By this, it is possible to prevent a force from being applied to the main driving shaft 101 in a direction in which the coupling unit 28 is dismounted in the axial direction. And, as shown in FIG. 21, a force is produced to urge the semispherical shape 101*c* formed at the free end of the main assembly driving shaft in a direction to abut against the conical shape portion 72*m* formed on the flange cap member. By this, the semispherical shape 101*c* of the main assembly driving shaft assuredly abuts against the conical shape portion 72*m* of the flange cap member, and it becomes possible to more accurately position the main assembly driving shaft 101 with respect to the coupling unit 28.

The driving force received by the driving force receiving surface 65*b* is transmitted from the engaging member 65 to the flange cap member 72. That is, the driving force is transmitted from the first guided surface 65*d* of the engaging member 65 to the first guide surface 72*d* of the flange cap member 72. The first guide surface 72*d* is the transmitted portion to which the driving force is transmitted, and the flange cap member 72 is the transmitted member. In addition, the first guide surface 72*d* is also a backup portion for suppressing the engaging portion 65*a* from moving to the downstream side in the rotational direction of the drum unit when a driving force is applied to the engaging member 65. In addition, the first guided surface 65*d* is a transmitting portion for transmitting the driving force to the flange cap member 72.

The first guide surface 72*d* is inclined with respect to the driving force receiving surface 65*b*. Therefore, the driving force F applied perpendicularly to the driving force receiving surface 65*d* has a component directed inward in the radial direction along the first guide surface 72*d*.

Due to the component of the driving force F, the engaging portion 65*a* is guided along the first guide surface 72*d* toward the radially inner side of the coupling unit 28. That is, the first guide surface 72*d* urges the engaging portion 65*a* and the driving force receiving surface 65*b* toward the inside in the radial direction (that is, the rear side of the drive transmission groove 101*a*) when the driving force F is transmitted.

In FIG. 25, the structure is such that when the tangent of the first guide surface 72*d* and the tangent of the drive receiving surface 65*d* are extended, the two tangent lines intersect with each other at the outside in the radial direction than the first guide surface 72*d* and the drive receiving surface 65*d*.

In addition, in the rotational direction R of the drum unit, the radially inner side of the first guide surface 72*d* is arranged on the downstream side of the radially outer side (FIG. 25).

The driving force transmitted from the engaging member 65 to the flange cap member 72 is transmitted to the photosensitive drum 1 by way of the flange member 71. As a result, the photosensitive drum 1 rotates together with the coupling unit 28.

That is, as shown in FIG. 14, the flange cap member 72 is provided with position regulating grooves 721 (engaging portions, recessed portions) for engaging with projections provided on the flange member 71. In addition, it is also provided with an fitting surface 72*k* to be engaged with the inner periphery of the flange member 71. The driving force is transmitted to the flange member 71 by way of these faces 72*k* and the position regulating groove 721. The flange member 71 is mounted to the photosensitive drum 1, and therefore, the driving force is finally transmitted from the flange member 71 to the photosensitive drum 1

Here, a projection is provided on the flange member 71, and a recessed portion (position restricting groove 721) for engaging with the flange cap member 72 is provided, but, it is not limited to such a structure. For example, a recess may be provided in the flange member 71, and the flange cap member 72 is provided with a projection engaging with the flange cap member 72 so that the driving force can be transmitted from the flange cap member 72 to the flange member 71.

Here, as described above, since the driving force receiving surface 65*b* is a twisted surface, when the driving force F is applied to the driving force receiving surface 65*b*, the drum unit 30 is urged outward in the axial direction. That is, the structure is such that when a driving force is applied from the main assembly driving shaft 101 to the driving force receiving surface 65*b*, the drum unit 30 and the main assembly driving shaft 101 are attracted to each other. Here, the driving force receiving surface 65*b* may not necessarily have a twisted shape as long as it has the same function as the twisted surface. The driving force receiving surface 65*b* may be a surface inclined in a direction to produce the urging force Fc2 when receiving the driving force F described above, and the surface shape may be a flat surface or a curved surface, for example.

In addition, as shown in FIGS. 10 and 12, the flange member 71 is provided with the contact surface contacting with the urging member (urging member abutting portion) 71*f*, which receives, when the engaging member 65 receives a radially inward urging force from the urging member 66, a reaction force, that is, a radially outer force. The contact surface 71*f* is a pressing force receiving portion (urging force receiving portion) pressed and urged by the urging member. It is an urging member supporting portion for supporting the urging member.

As shown in FIG. 12, the contact surface 71*f* of the flange member 71 is disposed at a position such that in the longitudinal direction of the photosensitive drum 1, at least a portion of the contact surface 71*f* overlaps a portion of the photosensitive drum 1 in the longitudinal direction. That is, when the contact surface 71*f* and the photosensitive drum 1 are projected perpendicularly to the axis of the photosensitive drum, at least parts of their mutual projection areas overlap with each other. In other words, at least a portion of the contact surface 71*f* is provided inside the photosensitive drum 1. In particular, in this embodiment, the entire contact surface 71*f* is inside the photosensitive drum 1. This is for the following reasons.

The contact surface 71*f* of the flange member 71 is disposed in a thin-walled portion of the flange member, because of the requirement by the space in the radial direction. The urging force radially outward from the urging member 66 applied on the contact surface 71*f* is received by the photosensitive drum 1 made of an aluminum alloy which is generally higher in strength than the flange member, so that the deformation of the flange member 71 in the neighborhood of the contact surface 71*f* can be suppressed. By suppressing the deformation of this flange member 71, the deformation of the borne portion 71*c* formed on the flange member 71 for rotatably supporting the photosensitive drum 1 is suppressed, so that the photosensitive drum 1 can be rotatably supported with high accuracy.

At least a portion of the urging member 66 is disposed inside the photosensitive drum 1 in order to place at least a portion of the contact surface 71*f* inside the photosensitive drum 1.

More strictly, at least a portion of a contact portion (urging portion) of the urging member 66 which is in contact with the contact surface 71*f* is inside the photosensitive drum 1. In particular, in this embodiment, the whole of the urging member 66 is inside the photosensitive drum 1.

In addition, at least a part of the engaging member 65, the engaging portion 65*a*, and the driving force receiving surface 65*b* is also inside the photosensitive drum 1. That is, especially in this embodiment, the entire engaging member 65 is inside the photosensitive drum 1.

A movable engaging member 65 and an elastically deformable urging member 66 are inside the photosensitive drum 1, so that user's hands are hard to touch them. It is also suitable for protecting the engaging member 65 and the urging member 66.

In addition, by placing at least a part of the engaging member 65 inside the photosensitive drum, the following effects are also provided.

That is, if the engaging member 65 is inside the photosensitive drum 1, the shaft portion 101*f* on which the drive transmission groove 101*a* is formed also enters the inside of the photosensitive drum 1, when the cartridge 7 is mounted in the apparatus main assembly (FIGS. 8 and 9). And, the drive transmission shaft 101 is supported at two places, and therefore, the length between the borne portion 101*d* and a shaft portion 101*f* is preferably to suppress the inclination of the drive transmission shaft 101 with respect to the drum unit. By moving the shaft portion 101*f* into the inside of the photosensitive drum 1, it is easy to ensure the distance between the bearing portion 101*d* and the shaft portion 101*f* while keeping the device main assembly small.

[Removal of Coupling Unit from Main assembly Drive Shaft]

Referring to FIG. 10, FIG. 20, FIG. 21, and FIG. 22, the removal operation of the coupling unit 28 from the main driving shaft 101 will be described.

As shown in FIG. 10, at the time when the rotation drive of the main assembly driving shaft 101 is stopped, the driving force receiving surface 65*b* and the main assembly driving force transmitting surface 101*b* are in contact with each other. In this state, the engaging portion 65*a* enters the main assembly drive transmission groove 101*a*.

When removal of the cartridge 7 from the image forming apparatus main assembly 100A is started, the removal tapered surface 65*l* of the engaging portion 65*a* abuts against the main assembly side removed taper 101*i*, as shown in FIG. 22. The removal tapered surface 65*l* abuts to the main assembly side removal taper 101*i*, so that the urging member 66 starts to contract, and the engaging member 65 moves outward in the radial direction along with the main assembly side removal taper 101*i*.

Furthermore, when the coupling unit 28 is pulled out from the main driving shaft 101, the state is the same as in FIG. 21, and the urging member 66 is contracted, so that the engaging portion 65*a* moves to the outer diameter of the shaft portion 101*f* of the main assembly driving shaft 101. As the engaging portion 65*a* moves to the outer diameter of the shaft portion 101*f*, the coupling unit 28 can be removed from the main assembly driving shaft 101.

Furthermore, when the coupling unit 28 is withdrawn from the main driving shaft 101, the engaging member 65 returns to the position where the restriction portion 65*j* of the engagement member and the restriction portion 72*j* of the flange cap member are in contact with each other in which the position in the urging direction is restricted, as shown in FIG. 20, FIG. 15.

With the above operation, the coupling unit 28 is removed from the main assembly driving shaft 101.

Here, as aforementioned, the driving force receiving surface 65*b* has a shape twisted around the rotation axis of the flange member 71. The torsional direction is such that the outside (z1 direction side) of the driving force receiving surface 65*b* is on the upstream side of the inner side (Z2 direction side) with respect to the rotational direction of the photosensitive drum 1.

In this state, when attempting to remove the coupling unit 28 from the main assembly driving shaft 101, a driving force receiving surface 65*b* is formed in a direction hindering this removal operation. That is, as shown in FIG. 26, the outside (z1 direction side) of the driving force receiving surface 65*b* is on the upstream side the inside (Z2 direction side) with respect to the rotational direction, and therefore, if the coupling unit 28 is pulled out of the main assembly driving shaft 101 in the removal operation, the removal load is larger than the insertion load.

On the contrary, the main assembly driving shaft 101 may be reversely rotated from the time when the rotation driving of the main assembly driving shaft 101 is stopped and the removal of the cartridge 7 from the image forming apparatus main assembly 100A is started. By this, after the state where the driving force receiving surface 65*b* is in contact with the drive transmission surface 101*b* is released, the cartridge 7 is removed from the image forming apparatus main assembly 100A, and therefore, the removal load can be reduced.

As a reverse rotation method, in interrelation with the opening operation of the cartridge door 104, the main driving shaft 101 may be reversely rotated by a link mechanism or the like or the motor of the drive source of the main assembly driving shaft 101 may be reversely rotated.

In the embodiment described above, the operation and the effect of the present invention will be summarized.

In this embodiment, an engaging member 65 which is movable in the radial direction within the coupling unit 28 is provided, and therefore, it is possible to satisfactorily mount and dismount the cartridge 7 and transmit the drive by the coupling unit 28 without using a mechanism for retracting the main assembly driving shaft 101 in the axial direction.

The engaging portion 65*a* formed in the engaging member 65 projects radially inward from the hole portion 72*a* of the coupling unit 28. By this, it is possible to protect the engaging portion 65*a* in the cartridge 7 constituted to be dismountable from the apparatus main assembly 100A.

In addition, the driving force receiving surface 65*b* formed in the engaging portion extends radially inward. Therefore, after the engagement portion has entered the groove portion 101*a* of the main assembly driving shaft, the driving force receiving surface 65*b* and the drive transmission surface 101*b* formed in the groove portion 101*a* are brought into contact with each other, thereby enabling satisfactory drive transmission.

In addition, the direction of the driving force F which the driving force receiving surface 65*b* receives in the normal direction during driving of the coupling unit 28 is inclined inward in the radial direction of the photosensitive drum 1 with respect to the tangential direction of the virtual circle centered on the rotation axis of the photosensitive drum 1. Furthermore, the direction of the driving force F is inclined with respect to the direction in which the engaging member 65 is movably guided, and the angle formed by it is an acute angle. Therefore, after the engagement portion has entered the groove portion 101*a* of the main assembly driving shaft, the driving force receiving surface 65*b* and the drive transmission surface 101*b* formed in the groove portion 101*a* are brought into contact with each other, thereby enabling satisfactory drive transmission.

In addition, the direction of the driving force F which the driving force receiving surface 65*b* receives in the normal direction during driving of the coupling unit 28 is inclined inward in the radial direction of the photosensitive drum 1 with respect to the tangential direction of the virtual circle centered on the rotation axis of the photosensitive drum 1. Furthermore, the direction of the driving force F is inclined with respect to the direction in which the engaging member 65 is movably guided, and the angle formed therebetween is an acute angle. This prevents a force from being exerted radially outwardly on the engaging member 65, thereby preventing the driving force receiving surface 65*b* from disengaging from the drive transmission surface 101*b*, and in addition, the driving force from the main assembly driving shaft 101 can be stably transmitted to the engaging member 65. Accordingly, the driving stability of the photosensitive drum 1 is improved, and therefore, image quality is improved.

In addition, the engaging member 65 is provided with a driving shaft abutment surface 65*c* abutting against the outer peripheral surface of the shaft portion 101*f* of the main assembly driving shaft. By this, the rotational moment M produced in the engaging member 65 is supported by the driving shaft abutment surface 65*c* so that the engaging member 65 is more firmly supported, and the driving stability can be improved.

In addition, the direction of the driving force F received by the driving force receiving surface 65*b* in the normal direction is inclined toward the outside in the longitudinal direction of the photosensitive drum 1 with respect to the direction of the rotation axis of the photosensitive drum 1. By this, it is possible to prevent a force from being applied to the main driving shaft 101 in a direction in which the coupling unit 28 is dismounted in the axial direction.

In addition, in the engaging portion 65*a*, an insertion tapered surface 65*k* is provided at one end on the outer side in the longitudinal direction of the photosensitive drum 1, and on the other end on the opposite side, a removal tapered surface 65*l* is provided. By this, when the cartridge is mounted or dismounted, by bring the insertion tapered surface 65*k* or the removal tapered surface 65*l* into contact with the groove portion 101*a* of the main assembly driving shaft, the cartridge 7 can be smoothly mounted and dismounted without clogging.

In addition, at least a portion of the contact surface 71*f* with the urging member provided on the flange member 71 is disposed at a position overlapping the photosensitive drum 1 in the longitudinal direction. The engaging member 65 receives a radially inward urging force from the urging member 66, and on the other hand, the contact portion 71*f* receives a force, in the radial direction, which is a reaction force of the urging force. By disposing such an contact surface 71*f* inside the photosensitive drum 1, deformation of the borne portion 71*c* formed on the flange member 71 is suppressed, and the photosensitive drum 1 can be rotatably supported with high accuracy.

Embodiment 2

Referring to FIGS. 27 to 47, Embodiment 2 will be described. The elements corresponding to those in the previous embodiment are denoted by the same names, and the description of the same points as those described above may be omitted in some cases. The description will be made mainly about the points different from the above-mentioned elements.

The coupling unit disclosed in each of the foregoing embodiments is a member to which a driving force for rotating the photosensitive drum 1 is transmitted. However, it is possible to use the above-described the coupling unit to rotate a member other than the photosensitive drum 1.

As an example of such a case, in this embodiment, a coupling unit 4028 receives the driving force for rotating the developing roller and the toner supplying roller.

The photosensitive drum 1, the developing roller 4017, and the toner supplying roller 4020 are all rotatable members configured to rotate in a state in which a developer (toner) is carried on the surface thereof

[General Arrangement of Electrophotographic Image Forming Apparatus]

Referring first to FIG. 27, the overall structure of an embodiment of an electrophotographic image forming apparatus (image forming apparatus) according to this embodiment will be described.

FIG. 27 is a schematic sectional view of the image forming apparatus 4100A of this embodiment.

As shown in FIG. 27, the image forming apparatus 4100A includes, as a plurality of image forming sections, first, second, third and fourth image forming units SY, SM, SC and SK for forming images of respective colors, namely yellow (Y), magenta (M), cyan (C) and black (K). In this embodiment, the first to fourth image forming portions SY, SM, SC, and SK are arranged in a line in a substantially horizontal direction.

In this embodiment, the structures and operations of the drum cartridges 4013 (4013Y, 4013M, 4013C and 4013K) are substantially the same as those of the drum cartridges 4013, except that the colors of the images to be formed on different from each other. The structures and operations of the developing cartridges 4004 (4004Y, 4004M, 4004C, and 4004K) are substantially the same as those of the drum cartridges 4004, except that the colors of the images to be formed on different from each other. Therefore, hereinafter, Y, M, C, and K will be omitted and explanation will be commonly applied unless otherwise stated.

In this embodiment, the image forming apparatus 4100A has cylinders (hereinafter referred to as photosensitive drums) 1 each having a photosensitive layer, the cylinders being arranged side by side along a direction inclined slightly with respect to a vertical direction as a plurality of image bearing members. A scanner unit (exposure device) 4013 is disposed below the drum cartridge 3 and the developing cartridge 4004 with respect to the direction of gravitational force. In addition, around the photoconductive drum 1, a charging roller 2 or the like functioning as process means (process device, process member) acting on the photosensitive layer are arranged.

The charging roller 2 is charging means (charging device, charging member) for uniformly charging the surface of the photosensitive drum 1. The scanner unit (exposure device) 3 is exposure means (exposure device, exposure member) for forming an electrostatic image (electrostatic latent image) on the photosensitive drum 1 by exposing to a laser on the basis of image information. Around the photosensitive drum 1, a cleaning blade 6 as cleaning means (cleaning device, cleaning member) and a developing cartridge 4004 are provided.

Further, an intermediary transfer belt 5 as an intermediary transfer member for transferring the toner image from the photosensitive drum 1 onto the recording material (sheet, recording medium) 12 is provided so as to face the four photosensitive drums 1.

In the developing cartridge 4004 of this embodiment, a contact developing method in which a non-magnetic one-component developer (hereinafter referred to as toner) is used as a developer and a developing roller 4017 as a developer carrying member contacts the photosensitive drum 1 is employed.

With the above-described structure, the toner image formed on the photosensitive drum 1 is transferred onto the sheet (paper) 12, and the toner image transferred onto the sheet is fixed. As process means actable on the photosensitive drum 1, the drum cartridge 4013 is provided with the charging roller 2 for charging the photosensitive drum 1, the cleaning blade 6 for removing the toner remaining without being transferred onto the photosensitive drum 1. The untransferred residual toner remaining on the photosensitive drum 1 not having been transferred onto the sheet 12 is collected by the cleaning blade 6. Further, the residual toner collected by the cleaning blade 6 is accommodated in a removed developer accommodating portion (hereinafter referred to as a waste toner accommodating portion) 4014*a* from the opening 4014*b*. The waste toner container 4014*a* and the cleaning blade 6 are integrated into a drum cartridge (photosensitive member unit, drum unit, image bearing member unit) 4013.

The image forming apparatus 4100A is provided on the main assembly frame with guides (positioning means) such as a mounting guide and a positioning member (not shown). The developing cartridge 4004 and the drum cartridge 4013 are guided by the above-described guides and are mountable to and dismountable from the image forming apparatus main assembly 4100A.

Toners of respective colors of yellow (Y), magenta (M), cyan (C), and black (K) are accommodated in the developing cartridges 4004 for the respective colors.

The intermediary transfer belt 5 contacts the photosensitive drum 1 of each drum cartridge 4013 and rotates (moves) in the direction of arrow B in FIG. 1. The intermediary transfer belt 5 is wound around a plurality of support members (a drive roller 51, a secondary transfer opposing roller 52, a driven roller 53). On the inner peripheral surface side of the intermediary transfer belt 5, four primary transfer rollers 8 as primary transfer means are juxtaposed so as to face each photosensitive drum 1. A secondary transfer roller 9 as a secondary transfer means is disposed at a position facing the secondary transfer opposing roller 52 on the outer peripheral surface side of the intermediary transfer belt 5.

At the time of image formation, the surface of the photosensitive drum 1 is first uniformly charged by the charging roller 2. Then, the surface of the thus charged photosensitive drum 1 is scanned by and exposed to laser beam corresponding to image information emitted from the scanner unit 3. By this, an electrostatic latent image corresponding to image information is formed on the photosensitive drum 1. The electrostatic latent image formed on the photosensitive drum 1 is developed into a toner image by the developing cartridge 4004. The toner image formed on the photosensitive drum 1 is transferred (primary transfer) onto the intermediary transfer belt 5 by the operation of the primary transfer roller 8.

For example, when a full-color image is formed, the above-described process is sequentially performed in the four drum cartridges 4013 (4013Y, 4013M, 4013C, 4013K) and the four developing cartridges 4004 (4004Y, 4004M, 4004C, 4004K). The toner images of the respective colors formed on the photosensitive drums 1 of the respective drum cartridges 4013 are sequentially primarily transferred so as to be superimposed on the intermediary transfer belt 5. Thereafter, in synchronism with the movement of the intermediary transfer belt 5, the recording material 12 is conveyed to the secondary transfer portion. The four color toner images on the intermediary transfer belt 5 are altogether transferred onto the recording material 12 conveyed to the secondary transfer portion constituted by the intermediary transfer belt 5 and the secondary transfer roller 9.

The recording material 12 to which the toner image has been transferred is conveyed to a fixing device 10 as fixing means. By applying heat and pressure to the recording material 12 in the fixing device 10, the toner image is fixed on the recording material 12. Further, the primary transfer residual toner remaining on the photosensitive drum 1 after the primary transferring process is removed by the cleaning blade 6 and collected as waste toner. Further, the secondary transfer residual toner remaining on the intermediary transfer belt 5 after the secondary transfer step is removed by the intermediary transfer belt cleaning device 11.

The image forming apparatus 4100A is also capable of forming monochrome or multicolor images using desired single or some (not all) image forming units.

[General Arrangement of Process Cartridge]

Referring to FIGS. 28, 29, 30 and 31, the description will be made as to the general arrangements of the drum cartridges 4013 (4013Y, 4013M, 4013C, 4013K) and the developing cartridges 4004 (4004Y, 4004M, 4004C, 4004K) mountable to the image forming apparatus main assembly 4100A of this embodiment.

The drum cartridge 4013Y, the drum cartridge 4013M, the drum cartridge 4013C, and the drum cartridge 4013K have the same structures. In addition, the developing cartridge 4004Y containing the yellow toner, the developing cartridge 4004M containing the magenta toner, the developing cartridge 4004C containing the cyan toner and the developing cartridge 4004K containing the black toner have the same structures. Therefore, in the following description, each of the drum cartridges 4013Y, 4013M, 4013C, and 4013K will be commonly referred to as a drum cartridge 4013, and each developing cartridge 4004Y, 4004M, 4004C, and 4004K will be commonly referred to as a developing cartridge 4004. The respective cartridge components will also be commonly described in the same manner.

FIG. 28 is an external perspective view of the drum cartridge 4013. Here, as shown in FIG. 28, the direction of the rotation axis of the photosensitive drum 1 is defined as a Z direction (arrow Z1, arrow Z2), the horizontal direction in FIG. 27 as X direction (arrow X1, arrow X2), the vertical direction is a Y direction (arrow Y1, arrow Y2) in FIG. 27.

The drum unit bearing members 4039R and 4039L are mounted to the sides of the cleaning frame 4014, respectively, and support the photosensitive drum unit 4030. By this, the photosensitive drum unit 4030 is supported so as to be rotatable relative to the cleaning frame 4014. Rotation.

In addition, a charging roller 2 and a cleaning blade 6 are mounted to the cleaning frame 4014, and they are arranged so as to be in contact with the surface of the photosensitive drum 1. A charging roller bearing 15 is mounted to the cleaning frame 4014. The charging roller bearing 15 is a bearing for supporting the shaft of the charging roller 2.

Here, the charging roller bearings 15 (15R, 15L) are mounted so as to be movable in the direction of the arrow C shown in FIG. 29. A rotating shaft 2*a* of the charging roller 2 is rotatably mounted to the charging roller bearing 15 (15R, 15L). The charging roller bearing 15 is urged toward the photosensitive drum 1 by a pressing spring 16 as an urging means. As a result, the charging roller 2 abuts against the photosensitive drum 1 and is rotated by the photosensitive drum 1.

The cleaning frame 4014 is provided with a cleaning blade 6 as a cleaning means for removing the toner remaining on the surface of the photosensitive drum 1. The cleaning blade 6 is formed by unitizing a blade-shaped rubber (elastic member) 6*a* that abuts against the photosensitive drum 1 to remove toner on the photosensitive drum 1 and a supporting metal plate 6*b* that supports the blade-like rubber (elastic member) 6*a*. In this embodiment, the supporting metal plate 6*b* is fixed to the cleaning frame 4014 with screws.

As described in the foregoing, the cleaning frame 4014 has an opening 4014*b* for collecting the transfer residual toner collected by the cleaning blade 6. The opening 4014*b* is provided with a blowing prevention sheet 26 which is in contact with the photosensitive drum 1 and seals between the photosensitive drum 1 and the opening 4014*b* to prevent toner leakage in the upper portion of the opening 4014*b*.

FIG. 30 is an external perspective view of the developing cartridge 4004.

The developing cartridge 4004 includes a developing frame 4018 for supporting various elements. In the developing cartridge 4004, there is provided a developing roller 4017 as a developer carrying member which rotates in the direction of arrow D (counterclockwise direction) shown in FIG. 31 in contact with the photosensitive drum 1. The developing roller 4017 is rotatably supported by the developing frame 4018 through development bearings 4019 (4019R, 4019L) at both end portions with respect to the longitudinal direction (rotational axis direction) thereof. Here, the development bearings 4019 (4019R, 4019L) are mounted to respective side portions of the developing frame 4018, respectively.

Further, as shown in FIG. 31, the developing cartridge 4004 includes a developer accommodating chamber (hereinafter referred to as a toner accommodating chamber) 4018*a* and a developing chamber 4018*b* in which the developing roller 4017 is provided.

In the developing chamber 4018*b*, there are provided a toner supplying roller 4020 as a developer supply member which contacts the developing roller 4017 and rotates in the direction of arrow E, and a developing blade 21 as a developer regulating member for regulating the toner layer of the developing roller 4017. The developing blade 21 is fixed and integrated to the fixing member 22 by welding or the like.

A stirring member 23 for stirring the contained toner and for conveying the toner to the toner supplying roller 4020 is provided in the toner accommodating chamber 4018*a* of the developing frame 4018.

[Structure of Main Assembly Driving Shaft]

Referring to FIGS. 32 and 33, the structure of the main assembly driving shaft 4101 will be described.

FIG. 32 is an external view of the main assembly driving shaft 4101.

FIG. 33 is a cross-sectional view taken along the rotation axis (rotation axis) of the main assembly driving shaft 4101 mounted to the image forming apparatus main assembly.

As shown in FIG. 32, the main assembly driving shaft 4101 comprises a gear member 4101*e*, an intermediate member 4101*p*, an output member 4101*q*, and a drive transmission member 4101*r*.

A motor (not shown) as a drive source is provided in the image forming apparatus main assembly 4100A. From this motor, the gear member 4101*e* is supplied with a rotational driving force, and the driving force is transmitted in the order of the intermediate member 4101*p*, the output member 4101*q*, and the drive transmission member 4101*r*, so that the main assembly driving shaft 4101 rotates. The gear member 4101*e*, the intermediate member 4101*p* and the output member 4101*q* constitute a mechanism of the Oldham coupling, in which movement is possible in the X direction and Y direction within a certain distance range. Therefore, the drive transmission member 4101*r* provided through the Oldham coupling on the cartridge side of the main assembly driving shaft 4101 can also move within a certain distance range in the X direction and Y direction. The drive transmission member 4101*r* is provided with a rotatable shaft portion 4101*f*, and the rotational driving force received from the motor is transmitted to the developing cartridge 4004 side by the way of a groove-shaped drive transmission groove 4101*a* (a recessed portion, a drive passing portion) provided in the shaft portion 4101*f*. Furthermore, the shaft portion 4101*f* has a conical shape portion 4101*c* at the free end thereof.

The main assembly drive transmission groove 4101*a* has such a shape that a part of an engaging portion 4065*a* which will be described hereinafter can enter. Specifically, it is provided with a main assembly drive transmission surface 4101*b* as a surface that contacts the driving force receiving surface (driving force receiving portion) 4065*b* of the coupling unit 4028 to transmit the driving force.

Further, as shown in FIG. 32, the main assembly drive transmission surface 4101*b* is not a flat surface but a shape twisted about the rotational axis of the main assembly driving shaft 4101. The twisting direction is such that the downstream side in the Z1 direction of the main assembly driving shaft 4101 is upstream of the downstream side in the Z2 direction thereof, with respect to the rotational direction of the main assembly driving shaft 4101. In this embodiment, the amount of twisting along the rotational axis direction of the cylinder of the engaging portion 4065*a* is set to about 1 degree per 1 mm. The reason why the main assembly drive transmission surface 4101*b* is twisted will be described hereinafter.

Also, a main assembly side dismounting taper 4101*i* is provided on a downstream side surface with respect to the Z2 direction of the main assembly drive transmission groove 4101*a*. The main assembly side dismounting taper portion 4101*i* has a taper (inclined surface, inclined portion) for assisting the engaging portion 4065*a* to be disengaged from the drive transmission groove 4101*a* when dismounting the developing cartridge 4004 from the apparatus main assembly 4100A.

As shown in FIG. 33, a supported portion 4101*d* provided on the gear member 4101*e* is rotatably supported (axially supported) by a bearing member 4102 provided in the image forming apparatus main assembly 4100A. The output member 4101*q* is rotatably supported by a coupling holder 4101*s*. In addition, the drive transmission member 4101*r* is supported by the output member 4101*q* so as to be movable in the Z direction, and is urged toward the developing cartridge 4004 (the Z2 direction) by the spring member 4103. However, the movable amount (play) of the drive transmission member 4101*q* in the Z direction is about 1 mm, which is sufficiently smaller than the width of a driving force receiving surface which will be described hereinafter, in the Z direction.

Further, the coupling holder 4101*s* is urged in the substantially Y2 direction by the urging spring 4101*t*. Therefore, as will be described hereinafter, when mounting the developing cartridge 4004, the drive transmission member 4101*r* is in a position shifted in the substantially Y2 direction relative to the axis line of the gear member 4101*e*.

As described above, the drive transmission member 4101*r* is provided with the main assembly drive transmission groove 4101*a*, and the coupling unit 4028 is provided with the engagement portion (projection, protrusion) 4065*a*, so that the drive is transmitted from the apparatus main assembly 4100A to the developing cartridge 4004.

As will be described hereinafter in detail, the engaging portion 4065*a* is formed on the engaging member (sliding member, moving member, driving force receiving member) 4065 which is movable in the state of being urged by the urging member. Therefore, the engaging portion 4065*a* is configured to be movable outward in at least the radial direction when the developing cartridge 4004 is mounted to the apparatus main body 4100A. By this, as the developing cartridge 4004 is inserted into the apparatus main body 4100A, the engaging portion 4065*a* enters the drive transmission groove 4101*a*, and the engaging portion 4065*a* and the main assembly drive transmission groove 4101*a* can engage with each other.

[Structure of Coupling Unit]

Next, referring to FIGS. 34, 35, 36, 37, 38, and 39, the coupling unit 4028 of the present embodiment will be described in detail. FIG. 34 is a perspective view in which the coupling unit 4028 is attached to the toner supplying roller 4020.

FIG. 35 is a perspective view of the engaging member 4065, part (a) of FIG. 35 is a perspective view as viewed from the upper left, and part (b) of FIG. 35 is a perspective view as viewed from the upper right.

FIG. 36 is a perspective view of members constituting the coupling unit 4028.

FIG. 37 is a perspective view of the coupling unit 4028 and the toner supplying roller 4020.

FIG. 38 is a cross-sectional view illustrating a state in which the coupling unit 4028 is engaged with the drive transmission member 4101*r*.

FIG. 39 is a sectional view of the developing cartridge 4004.

The coupling unit 4028 of this embodiment is different from the coupling unit 28 of Embodiment 1 in that the member to be driven is the toner supplying roller 4020, but except for that, it has similar structures.

As shown in FIG. 34, the coupling unit 4028 is provided with three engagement portions 4065*a* which engage with the drive transmission member 4101*r*. The engaging portion 4065*a* fits into the groove portion 4101*a* of the drive transmission member 4101*r* as shown in FIG. 38, and drive transmission is performed.

In the following, the structure of the coupling unit (coupling member) 4028 will be specifically described. As shown in the perspective view of FIG. 36 and the sectional view of FIG. 38, the coupling unit 4028 includes a coupling cover member 4071, a coupling holder member 4072, an engaging member 4065, and an urging member 4066.

The coupling cover member 4071 is a cylindrical member including a hollow portion, and the coupling holder member 4072 is disposed in the internal space of the coupling cover member 4071.

The coupling holder member 4072 is a holding member which holds the engaging member 4065 so as to be slidable.

As shown in FIG. 38, the engaging member 4065 including an engaging portion 4065*a* is supported within the coupling unit 4028, in the state of being urged by the urging member 4066 in a radially inward direction of the coupling unit 4028.

As shown in FIG. 35, the engaging member 4065 is provided with a first guided surface 4065*d* and a second guided surface 4065*e* so as to be guided radially movably in the coupling unit. In addition, a third guided surface 4065*f* and a fourth guiding surface 4065*g* are provided in order to regulate the position of the engaging member 4065 in the axial direction.

As in Embodiment 1, the first to fourth guided surfaces (4065*d*, 4065*e*, 4065*f*, 4065*g*) are the guided portions guided by the coupling holder member 4072 and the position restricted portion (portion to be restricted in position). The coupling holder member 4072 has the first to fourth guide surfaces corresponding to the first to fourth guided surfaces as in Embodiment 1.

The engaging member 4065 has a contact surface (an urged portion, a pressed portion) 4065*h* for receiving the urging force by the urging member 4066. Also, the engaging member 4065 has a position restricting projection 4065*i* for restricting the position of the engaging member 4065 by being contacted by the coupling holder member 4072 by the urging force of the urging member 4066, and it includes an urging force position restricting surface 4065*j* formed in the position restricting projection. As in Embodiment 1, the urging force position restricting surface 4065*j* is an engaged portion which is restrained and locked in the radial inward movement by the coupling holder member 4072.

The engaging member 4065 also has an insertion tapered surface 4065*k*.

The coupling holder member 4072 is provided with a coupling hole portion 4072*a* for passing the drive transmission member 4101*r* and a mounting hole portion 4072*b* for supporting the engaging member 4065 movably in the radial direction.

As shown in FIG. 36, the coupling cover member 4071 has a cylindrical shape, and it is mounted to the outer peripheral surface 4072*k* of the coupling holder member 4072.

The urging member 4066 is an elastically expandable and contractible elastic member (compression coil spring), which applies a reaction force in a direction in which the compression spring expands, against an external force in a direction in which the compression spring contracts.

The engaging member 4065 is urged at least toward the inner side (radially inward) of the coupling unit 4028 by the urging member 4066. The urging member 4066 is compressed in a state of being sandwiched between the contact surface 4065*h* of the engaging member 4065 and the inner peripheral surface of the coupling cover member 4071, and therefore, by applying an urging force in a direction in which the urging member 4066 expands, it urges the engaging member 65.

The engaging member 4065 is supported by the coupling holder member 4072 in a state that the engaging portion 4065*a* of the engaging member 4065 is exposed through the hole portion 4072*a* of the coupling holder member 4072. In addition, similarly, the driving shaft contact surface 4065*c* formed in an arc shape on the engaging member 4065 is exposed through the hole portion 4072*a* of the coupling holder member 4072.

The engaging portion 4065*a* of the engaging member 4065 projects inward in the radial direction from the inner peripheral surface of the hole portion 4072*a* of the coupling holder member 4072. The projection amount is an amount sufficient for the engaging portion 4065*a* to reliably enter the groove 4101*a* of the driving shaft. This amount of projection is an amount suitable for the driving force receiving surface 4065*b* formed in the engaging portion 4065*a* to have the strength corresponding to the load torque of the toner supplying roller 4020 which is the member to be rotated. This amount of projection only needs to be such that the engaging portion 4065*a* can stably transmit the driving force from the main assembly driving shaft 4101.

In the case of this embodiment, the projecting amount of the engaging portion 4065*a* is preferably 1 mm to 3 mm. That is, the distance from the inner surface of the coupling holder member 4072 to the free end of the engaging portion 4065*a* measured along the radial direction of the coupling member is 1 mm to 3 mm.

In addition, similarly, the driving shaft contact surface 4065*c* of the engaging member 4065 projects further inward in the radial direction beyond the inner circumferential surface of the hole portion 4072*a* of the flange cap member 4072. In the case of this embodiment, the projection amount is preferably 0.3 mm to 1 mm so that the driving shaft contact surface 4065*c* assuredly projects from the inner peripheral surface of the hole portion 4072*a* even when the dimensions of each portions varies.

In addition, as shown in FIG. 37, the coupling holder member 4072 is provided with a hole portion 4072*h* for passing the shaft portion (shaft) 4020*a* of the toner supplying roller 4020. The toner supplying roller 4020 and the coupling unit 4028 rotate integrally due to the rotation stopping shaped formed on the hole portion 4072*h* and the shaft portion 4020*a*. That is, in this embodiment, unlike Embodiment 1, the coupling unit 4028 is fixed to the shaft (shaft portion 4020*a*) of the rotatable member (toner supply roller). The coupling unit 4028 is placed coaxially with the toner supplying roller 4020.

Here, the distance from the axis (center) of the coupling unit 4028 to the driving force receiving portion (driving force receiving surface 4065*b*) is longer than the radius of the shaft portion 4020*a*. By doing so, the force applied to the driving force receiving surface 4065*b* can be reduced as compared with the load torque required to rotate the shaft portion 4020*a* of the toner supplying roller 4020.

As shown in FIG. 39, the toner supplying roller 4020 has a gear 4098 on the opposite side (non-drive side) to the drive side to which the coupling unit 4028 is mounted. This gear meshes with the gear 4099 mounted on the shaft of the developing roller 4017.

When the toner supplying roller 4020 is rotated by the driving force transmitted from the coupling unit 4028, the developing roller 4017 also rotates by the two gears.

[Mounting of Cartridge to Image Forming Apparatus Main Assembly]

Referring to FIGS. 40-43, the mounting and dismounting of the developing cartridge 4004 relative to the main assembly of the image forming apparatus will be described.

FIG. 40 is a perspective view illustrating mounting of the developing cartridge 4004 to the image forming apparatus main assembly 4100A.

FIGS. 41, 42 and 43 are cross-sectional views illustrating the mounting operation of the developing cartridge 4004 to the image forming apparatus main assembly 4100A.

The image forming apparatus main assembly 4100A of this embodiment employs a structure in which the developing cartridge 4004 and the drum cartridge 4013 can be mounted in the horizontal direction. Specifically, the image forming apparatus main assembly 4100A includes therein a space in which the developing cartridge 4004 and the drum cartridge 4013 can be mounted. The cartridge door 4104 (front door) for a permitting insertion of the developing cartridge 4004 and the drum cartridge 4013 into the space is provided on the front side of the image forming apparatus main assembly 4100A (the side to which the user stands for use).

As shown in FIG. 40, the cartridge door 4104 of the image forming apparatus main assembly 4100A is provided so as to be opened and closed. When the cartridge door 4104 is opened, the lower cartridge guide rail 4105 for guiding the developing cartridge 4004 is provided on the bottom of the space, and the upper cartridge guide rail 4106 is disposed on the upper surface. The developing cartridge 4004 is guided to the mounting position by the upper and lower guide rails (4105, 4106) provided above and below the space. The developing cartridge 4004 is inserted into the mounting position substantially along the axis of the developing roller 4020.

Referring to FIGS. 41, 42 and 43, the mounting and dismounting operations of the developing cartridge 4004 to the image forming apparatus main assembly 4100A will be described below.

As shown in FIG. 41, the developing cartridge 4004 is inserted in the state that the lower part of the end portion on the rear side in the inserting direction is supported and guided by the lower cartridge guide rail 4105, and the upper side of the end portion thereof on the rear side in the inserting direction is guided by the upper cartridge guide rail 4016. There is a dimensional relationship such that the intermediary transfer belt 5 does not contact with the developing frame 4018 or the development bearing 4019.

As shown in FIG. 42, the developing cartridge 4004 is horizontally inserted while being supported by the lower cartridge guide rail 4105, and is inserted until it the abuts to the rear cartridge positioning portion 4108 provided in the image forming apparatus main assembly 4100A.

When the developing cartridge 4004 is mounted in this manner, the drive transmission member 4101*r* of the image forming apparatus main assembly 4100A is engaged with the coupling unit 4028 while being urged substantially in the Y2 direction.

FIG. 43 is an illustration of the state of the image forming apparatus main assembly 4100A and the developing cartridge 4004 in a state in which the cartridge door 4104 is closed. The lower cartridge guide rail 4105 of the image forming apparatus main assembly 4100A is configured to move up and down in interrelation with the opening and closing of the cartridge door (front door) 4104.

When the user closes the cartridge door 4104, the lower cartridge guide rail 4105 is raised. Then, both end portions of the developing cartridge 4004 contacts to the cartridge positioning portions (4108, 4110) of the image forming apparatus main assembly 4100A, and the developing cartridge 4004 is positioned relative to the image forming apparatus main assembly 4100A. Further, the drive transmission member 4101*r* of the image forming apparatus main assembly 4100A also follows the developing cartridge 4004 so as to move upward.

By the above-described operation, the mounting of the developing cartridge 4004 to the image forming apparatus main assembly 4100A is completed.

Further, the dismounting operation of the developing cartridge 4004 from the image forming apparatus main assembly 4100A is performed in the reverse order of the above-described inserting operation.

[Engaging Process of Coupling Unit to Main Assembly Drive Shaft]

Referring to FIGS. 44, 45, 46 and 47, the engagement process of the coupling member 4028 and the main assembly driving shaft 4101 will be described in detail.

FIGS. 44, 45, 46 and 47 are sectional views illustrating the operation of mounting the coupling member 4028 on the main assembly driving shaft 4101.

FIG. 44 in an illustration of a state in which the coupling member 4028 starts engaging with the drive transmission member 4101*r*. In addition, FIG. 47 shows a state in which the developing cartridge 4004 is mounted to the image forming apparatus main assembly 4100A. Particularly, FIG. 47 shows a state in which the lower cartridge guide rail 4105 is raised as the cartridge door 4104 closes, and the developing cartridge 4004 is positioned with respect to the image forming apparatus main assembly 4100A.

Here, FIGS. 45 and 46 are illustrations of the mounting process of the coupling unit 4028 and the drive transmission member 4101*r* between the positions of shown in FIG. 44 and FIG. 47. The drive transmission member 4101*r* is urged substantially in the direction Y2 by the urging spring 4101*t* and the axis of the drive transmission member 4101*r* is urged to a position shifted substantially in the Y2 direction from the axis of the coupling unit 4028.

As has been described referring to FIG. 40, the developing cartridge 4004 is horizontally inserted while being supported by the lower cartridge guide rail 4105 of the image forming apparatus main assembly 4100A.

FIG. 44 is an illustration of a state before the drive transmission member 4101*r* is engaged with the coupling unit 4028. As described above, in this state, the axis of the drive transmission member 4101*r* and the axis of the coupling unit 4028 are deviated from each other. Therefore, the conical shape portion 4101*c* of the drive transmission member 4101*r* is brought into contact with the tapered surface 4072*p* formed at an entrance to the hole portion 4072*a* of the coupling the holder member 4072 of the coupling unit 4028.

As shown in FIG. 45, the coupling unit 4028 is further inserted toward the back side of the drive transmission member 4101*r* from the position of FIG. 44. Then, the insertion tapered surface 4065*k* of the engaging member 4065 guides the conical shape portion 4101*c* of the drive transmission member 4101*r*, so that the axis of the coupling unit 4028 and the axis of the drive transmission member 4101*r* become substantially aligned.

As shown in FIG. 46, the coupling unit 4028 is further inserted toward the back side of the drive transmission member 4101*r* from the position of FIG. 45. Then, the coupling unit 4028 is inserted to the drive transmission member 4101*r* until the dismounting tapered surface 4065*l* of the engaging member 4065 comes to the back side in the Z direction beyond the main assembly side dismounting taper 4101*i* of the drive transmission member 4101*r*.

The coupling unit 4028 is further inserted to the drive transmission member 4101*r*. Then, the conical recess 4072*m*, which is a positioning portion formed in the coupling holder member 4072 of the coupling unit 4028, and the conical shape portion 4101*c* of the drive transmission member 4101*r* are brought into contact to each other.

Thereafter, as described above, the developing cartridge 4004 is lifted up by the lower cartridge guide rail 4105, so that the developing cartridge 4004 is positioned in place relative to the image forming apparatus main assembly 4100A (shown in FIG. 43). At this time, as shown in FIG. 47, the drive transmission member 4101*r* also rises as the developing cartridge 4004 moves up.

As described above, as the developing cartridge 4004 is mounted to the apparatus main assembly 4100A, the main assembly drive transmission groove 4101*a* and the engaging portion 4065*a* can be engaged with each other. Therefore, there is no need to move the main assembly driving shaft 4101 to engage with the coupling unit 4028. That is, there is no need to provide a mechanism for moving the main assembly driving shaft 4101 so as to engage with the coupling unit 4028, in the apparatus main assembly 4100A of the image forming apparatus.

That is, it is not necessary to provide a mechanism for moving the main assembly driving shaft 4101 so as to engage with the coupling unit 4028 after mounting the developing cartridge 4004 to the image forming apparatus main assembly 4100A.

When the developing cartridge 4004 is mounted to the apparatus main assembly 4100A, the engaging portion 4065 of the coupling unit 4028 contacts to the main assembly driving shaft 4101 to retreat radially outward. The engaging portion 4073 is configured to engage with the groove (main assembly drive transmission groove 4101*a*) of the main assembly driving shaft 4101 by moving radially inward.

Here, it is also possible to provide a groove for receiving the drive on the coupling member, and a movable portion engageable with the groove by moving in the radial direction is provided on the main assembly driving shaft 4101 side. However, as compared with the developing cartridge 4004, the image forming apparatus main assembly 4100A is required to have higher durability. It is preferable to provide the movable portion (the engaging portion 4065) which moves in the radial direction as in this embodiment on the coupling unit 4028 side of the developing cartridge 4004 from the standpoint of enhancing the durability of the image forming apparatus main assembly 4100A.

The engaging member 4065 provided in the coupling unit 4028 of the present embodiment has substantially the same configuration as that provided in the coupling unit 28 described in Embodiment 1. That is, the coupling unit 4028 of the present embodiment is a modification of the configuration in which the coupling unit 28 described in Embodiment 1 is applied to the developing cartridge (developing apparatus) 4004. Therefore, the coupling unit 4028 in this embodiment also has the same operations and effects as the coupling unit 28 described in Embodiment 1 according to the present invention. The structure of the coupling unit shown in this embodiment may be used as a coupling unit for rotating the photosensitive drum 1.

Here, the structure of the coupling unit shown in this embodiment may be used as a coupling unit for rotating the photosensitive drum 1.

Embodiment 3

Referring to FIGS. 48 to 50, Embodiment 3 will be described. In this example, as compared with the previous embodiment, the shape of the engaging portion of the engaging member is different. The explanation will be made mainly as to the shape of this engaging portion.

Here, as in Embodiment 1, the coupling unit provided in the drum cartridge will be described as an example, but, it can also be used for a coupling unit provided in a developing cartridge.

[Engagement Portion of Engaging Member]

Part (a) of FIG. 48 and Part (b) of FIG. 48 are perspective views of the engaging member 5065 in this embodiment, and part (c) of FIG. 48 is a front view thereof. FIG. 49 is a sectional view of the coupling unit. FIG. 49 is a view illustrating a state in which a driving force is applied from the main assembly driving shaft 101 to the coupling unit 5028, and it is a partial enlarged sectional view of the coupling unit 5028. More particularly, FIG. 49 is a sectional view taken along a plane perpendicular to the axis of the coupling unit 5028 (axis of the drum unit).

As shown in FIGS. 48 and 49, as in the case of Embodiment 1, the engaging member 5065 is provided with an engaging portion 5065*a* projecting inward in the radial direction of the photosensitive drum 1. The free end side of this engaging portion 5065*a* is rounded and bulges (projects) toward the upstream side in the rotational direction of the drum unit.

More particularly, the engaging portion 5065*a* is provided with a projection (bulging portion) 5065*m* having a semicircular shape projecting in the circumferential direction toward the side where the driving shaft abutment surface 5065*c* is formed, and, a recess 5065*n* is provided at the portion of the engaging portion 5065*a* with respect to the projection 5065*m*. That is, the projection 5065*m* is a portion which projects (bulges) toward the upstream side in the rotational direction of the drum unit with respect to the recess 5065*n*. On the contrary, the recess 5065*n* is a portion which is recessed toward the downstream side in the rotational direction with respect to the projection 5065*m*.

FIG. 49 shows a state in which a driving force F is applied from the drive transmission surface 101*b* of the main assembly driving shaft 101 to the engaging portion 5065*a* having such a shape. A recess 5065*n* is formed at the base portion of the engaging portion 5065*a* projecting from the engaging member 5065, and therefore, the entrance side corner portion 101*j* on the drive transmission surface 101*b* side can enter the recess 5065*n* in the groove 101*a* of the main assembly driving shaft 101. By this, the engaging portion 5065*a* receives a driving force F which acts in a direction normal to the drive transmission surface 101*b*, and drive transmission is carried out.

That is, the driving force receiving portion 5065*r* for receiving the driving force from the drive transmission surface 101*b* faces at least radially outwardly of the coupling unit. Therefore, the driving force F received by the driving force receiving portion 5065*r* from the drive transmission surface 101*b* is applied toward the inner side in the radial direction of the coupling unit. The engaging portion 5065*a* and the driving force receiving portion 5065*r* are urged toward the inside at least in the radial direction (that is, the back side of the drive transmission groove 101*a*).

As a result, the engaging portion 5065*a* and the driving force receiving portion 5065*r* can stably engage with the drive transmission groove 101*a*.

The shape of the engaging portion 5065*a* will be described in more detail. As shown in FIG. 49, when a tangent line T parallel to the moving direction S of the engaging member 5065 is drawn to the projection 5065*m*, the tangent line T and the projection 5065*m* have an apex 5065*p* as a contact point. The apex 5065*p* projects from the base portion 5065*q* of the engaging portion 5065*a* and a position apart by a distance L3 along the moving direction S of the engaging member 5065.

Between apex 5065*p* and the base portion 5065*q*, a recess 5065*n* recessed from the tangent line T is formed. As the corner portion 101*j* of the driving shaft enters the recess 5065*n*, the engaging portion 5065*a* can receive the driving force F at the contact portion (driving force receiving portion 5065*r*) with the drive transmission surface 101*b* disposed in the recessed portion 5065*n*.

The surface on which the driving force receiving portion 5065*r* is provided (the curved surface between the apex 5065*p* and the base portion 5065*q*) is inclined relative to the moving direction of the engaging member 5065 and faces outside at least in the radial direction of the coupling unit. That is, the normal vector of the driving force receiving portion 5065*r* (a vector extending perpendicularly to the driving force receiving portion 5065*r* in the direction in which the driving force receiving portion 5065*r* faces) has a radially outward component. And, as shown in parts (a) and (b) of FIG. 49, the driving force F is a force acting perpendicularly to the drive transmission surface 101*b* and the driving force receiving portion 5065*r*. Therefore, the driving force F has a component directed inward in the radial direction.

Further, the driving force F is a force which is applied in a direction inclined by an angle θ relative to the moving direction S of the engaging member 5065. Therefore, as shown in part (b) of FIG. 49, the driving force F has a force FS as a component of the moving direction S of the engaging member. This force FS prevents the engaging member 5065 from moving toward the opposite side in the moving direction S and prevents the driving force receiving portion 5065*r* of the engaging member from being disengaged from the drive transmission surface 101*b* of the main assembly driving shaft to the outside.

Here, in FIG. 49, as one example of the shape of the projection (bulging portion) 5065*m*, a circular shape has been shown, but the shape of the projection is not limited to this, and it suffices that the engaging portion 5065*a* is formed so as to produce the force FS from the driving force F. That is, it will suffice if with respect to the tangent line T, an apex 5065*p* serving as a contact point is formed at a position projecting from the base portion 5065*q* of the engaging portion, and a recessed portion 5065*n* recessed from the tangential line T is formed between the apex 5065*p* and the base portion 5065*q*.

It will suffice if the cross-sectional shape of the projection (bulging portion) 5065*m* is engaged with the drive transmission groove 101*a*. For example, a substantially circular polygon (such as a pentagon) can also be used as the bulging portion. The shape of the cross portion may be elliptical or the like. Such an example will be explained in FIG. 55 of Embodiment 4.

Here, as mentioned above, in this embodiment, it is desirable that a contact portion (driving force receiving portion) 5065*r* for contacting with the drive transmission surface 101*b* is disposed between an apex 5065*p* and a base portion 5065*q* of the projection (bulging portion) 5065*m*.

As described above, in order for the drive transmission surface 101*b* to reliably contact the contact portion 5065*r*, it is preferable that at least the engaging member 5065 can move by more than the distance from the center to the surface in the cross-sectional shae of the projection 5065*m*. That is, it is preferable that the engaging member 5065 is movable beyond the radius of the cross-sectional shape of the projection 5065*m*. Further preferably, it can move with a margin beyond the width of the projection 5065*m* (that is, larger than the diameter).

Here, if the amount of movement of the engaging member 5065 is small, the projection 5065*m* comes into contact with the drive transmission groove 101*a* at a more free end side of the projection 5065*m* than the apex 5065*p*. In this case, when projection 5065*m* receives driving force, there is a possibility that a force in a direction away from the drive transmission groove 101*a* is applied to the engaging member 5065. Therefore, in order to ensure the engagement state between the engaging member 5065 and the drive transmission groove 101*a*, it is preferable that the urging force of the urging member for urging the engaging member 5065 is increased or the frictional force generated between the projection 5065*m* and the drive transmission groove 101*a* is increased. By taking these measures, it is difficult for the engaging member 6065 to retract from the drive transmission groove 101*a*.

Next, referring to FIG. 50 and FIG. 51, a modified example of Embodiment 3 will be described. As shown in FIG. 50, the entire engaging portion 6065*a* is a bulging portion formed in a substantially circular shape. It is formed with such a simple shape so that it is possible to easily manage the dimensional accuracy of the engaging portion 6065*a*.

The engaging portion 6065*a* also has an apex 6065*p* as a contact point with a tangential line T parallel to the moving direction S of the engaging member 6065. In addition, the apex 6065*p* projects from the base portion 6065*q* of the engaging portion at a position separated by the distance L4 along the moving direction S. And, between the apex 6065*p* and the base portion 6065*q* of the engaging portion, a recessed portion 6065*n* recessed from the tangent line T is provided. Between the apex 6065*p* and the base portion 6065*q* of the engaging portion, a contact portion (a driving force receiving portion 6065*r*) for contacting with the drive transmission surface 101*b* is also provided. This contact portion (driving force receiving portion) 6065*r* faces in such a direction as to generate a force FS as a component produced in the direction opposite to the moving direction S of the engaging member with respect to the driving force F. As a result, it is possible to prevent the engaging member 6065 from being disengaged from the drive transmission surface 101*b* of the main assembly driving shaft to the outside.

The surface (the curved surface between the apex 6065*p* and the base portion 6065*q* of the engaging portion) on which the abutting portion (driving force receiving portion) 6065*r* is provided is inclined with respect to the moving direction S of the engaging member 6065. To be more specific, the tangent of the driving force receiving portion 6065*r* is inclined with respect to the moving direction S.

And, the driving force receiving portion 6065*r* faces outwardly at least in the radial direction of the coupling unit. That is, the normal vector of the driving force receiving portion 6065*r* facing the side where the driving force receiving portion 6065*r* faces has at least a radially outward component of the coupling unit.

Here, the shape of the cross-section of the engaging portion (bulging portion) projection 6065*a* is not necessarily rounded, but may be a bulge suitable for engaging with the drive transmission groove 101*a*. For example, a substantially circular polygon (such as a pentagon) is also suitable as a bulging portion. The shape of the cross-section may be elliptical or the like.

Further, in order for the abutting portion (driving force receiving portion) 6065*r* disposed between the apex 6065*p* and the base portion 6065*q* to assuredly come into contact with the drive transmission surface 101*b*, it is preferable that the moving amount of the engaging member 6065 satisfies the following condition. That is, it is preferable that the engaging member 6065 is movable beyond the distance from the center to the surface in the cross-section of the engaging portion 6065*a*. That is, it is preferable that the engaging member 6065 (engaging portion 6065*a*) is movable beyond the radius of the cross-sectional shape of the engaging portion 6065*a*.

More preferably, the engaging portion 6065*a* is movable beyond the width (that is, the diameter) of the cross-sectional shape of the engaging member engaging portion 6065*a*.

Embodiment 4

Referring to FIGS. 52 to 57, Embodiment 4 will be described. In this embodiment, the structures corresponding to the engaging member and the urging member are integrated and formed with the resin. Here, in the same manner as in Embodiment 1 and Embodiment 3, the coupling unit provided in the drum cartridge will be described as an example, but, it can also be used for a coupling unit provided in a developing cartridge.

Parts (a) and (b) of FIG. 52 are sectional views of the drum unit. Part (a) of FIG. 52 shows a state in which the engaging portion 565*a* is engaged with the drive transmission groove 101*a* to receive a driving force. Part (b) of FIG. 52 shows a state before the engagement portion 565*a* and the drive transmission groove 101*a* are engaged.

Like Embodiment 1 and Embodiment 3, a flange member 571 is mounted inside the photosensitive drum 1. This flange member 571 is a coupling unit (coupling member) in this embodiment.

A support portion 565 for movably supporting the driving force receiving portion 565*r* is formed integrally with the flange member 571 on the flange member 571. Three support portions 565 are provided on the flange member 571. Each of these supports 565 is provided with extensions 565*t*, a bulging portion (engaging portion 565*a*) provided at the free end of the extending portion; a connecting portion 565*s* for connecting the extending portion 565*t* and the engaging portion 565*a* with each other.

The extending portion 565*t* is connected to the inner periphery of the flange member 571. That is, the fixed end 565*t*1 of the extending portion 565*t* is provided on the inner periphery of the flange member 571. And, the extending portion 565*t*1 extends from the fixed end 565*t*1 toward the inside of the hollow portion of the flange member 571. Details will be described hereinafter, but the extending portion 565*t*1 is an elastic portion capable of being elastically deformed.

Further, the free end side (that is, the side where the connecting portion 565*s* is provided) of the extending portion 565*t* is located on a more downstream side in the rotational direction R of the drum unit (coupling unit) than the fixed end 565*t*1 of the extending portion 575*t*. That is, the extending portion 565*t* extends from the fixed end 565*t*1 toward the free end at least in the downstream side in the rotational direction R. The free end of the extending portion 575*t* (that is, the connecting portion 565*s* and the engaging portion 565*a*) is located radially inward of the fixed end 565*t*1 of the extending portion 575*t*.

The engaging portion 565*a* is a bulging portion provided at the end of the extending portion 565*t* and is a portion for entering into the drive transmission groove 101*a* of the main assembly driving shaft 101. The engaging portion 565*a* is connected by a connecting portion 575*s* provided at the free end of the extending portion 575*t*. The connecting portion 575*s* is a portion formed by bending the free end side of the extending portion 565*t*. The engaging portion 565*a* and the connecting portion 565*s* are projections (projections) projecting in a direction crossing the extending direction of the extending portion 565*t*.

The engaging portion 565*a* is provided with a driving force receiving portion 565*r*. As shown in part (a) of FIG. 52, the driving force receiving portion 565*r* contacts the drive transmission groove 101*a* to receive the driving force. When the driving force receiving portion 565*r* receives the driving force, this driving force is transmitted to the flange member 571 by way of the fixed end 565*t*1 of the support portion 565. The flange member 571 is fixed to the photosensitive drum 1, and therefore, the flange member 571 and the photosensitive drum 1 are integrally rotated.

The extending portion 575*t* and the engaging portion 565*a* are integrally formed with the flange member 570. The extending portion 575*t* and the engaging portion 565*a* are portions of the support portion 565 which movably supports the driving force receiving portion 565*r*.

As described in the foregoing, the extending portion 565*t* can be elastically deformed. That is, as shown in part (b) of FIG. 52, during the process of inserting the cartridge 7 into the main assembly of the apparatus, the engaging portion 565*a* contacts the outer circumferential surface of the main assembly driving shaft 101. Then, the extending portion

565*a* is elastically deformed so that the engaging portion 565*a* moves outwardly at least in the radial direction of the coupling unit.

Here, the extending portion 565*t* is deformed so as to incline with its own fixed end 565*t* as a fulcrum. As a result, the engaging portion 565*a* moves in a direction intersecting the extending direction of the extending portion 565*t*.

After the cartridge 7 is inserted into the apparatus main assembly, when the main assembly driving shaft 101 is rotationally driven, the engagement portion 565*a* enters the inside of the drive transmission groove 101*a*, at the time when the phases of the engagement portion 565*a* and the drive transmission groove 101*a* match each other.

That is, by elastically deforming at least a portion of the extending portion 565*t*, the engaging portion 565*a* is urged inside the drive transmission groove 101*a*. The extending portion 565*t* can be regarded as an urging portion for urging the engaging portion 565*a* inward at least in the radial direction.

That is, the engagement portion 565*a* is urged toward the inside of the drive transmission groove 101*a* by the elastic force (urging force) of the extending portion 565*t*. The extending portion 565*t* has a function corresponding to the urging member 72 in Embodiment 1. That is, the support portion 565 is a portion serving also as the urging member 72 and the function of the engaging member 65 of Embodiment 1.

At least a portion of the support portion 565 and at least a portion of the driving force receiving portion 565*r* provided on the support portion 565 are disposed inside the photosensitive drum 1 (FIG. 52). This is the same as the urging member 72 and the engaging member 65 in Embodiment 1.

Here, inside the photosensitive drum 1, the flange member 571 is held on the photosensitive drum 1, and therefore, the flange member 571 is not easily deformed. Particularly, if at least a portion of the fixed end 565*t*1 of the support portion 565 is disposed inside the photosensitive drum 1, such a structure is preferable from the stand point of suppressing the deformation of the flange member 571, even if a driving force is transmitted to the flange member 571 by way of the fixed end 565*t*1.

Here, the extending portion is made of resin, but, elastic force or strength of the extending portion may be increased by inserting an elastic metal (for example, leaf spring) in the resin constituting the extending portion.

When the engaging portion 565*a* enters the inside of the drive transmission groove 101*a*, the driving force receiving portion 565*r* provided in the engaging portion 565*a* receives a force from the inside of the drive transmission groove 101*a*. Here, in order to ensure the engagement state between the drive transmission shaft 101*a* and the engagement portion 565*a* when the drive transmission shaft 101*a* is driven, it is preferable that more than half of the engaging portion 565*a* enters the inside of the drive transmission shaft with the engaging portion 565*a*.

Therefore, it is preferable that the engaging portion 565*a* is movable beyond the radius of the cross-section of the engaging portion 565*a* (the distance from the center of the engaging portion to the surface). Further preferably, the engaging portion 565*a* can move over the diameter of the cross-section of the engaging portion 565*a* (not less than the width of the cross-section of the engaging portion 565*a*, not less than twice the distance from the center of the engaging portion to the surface).

Here, FIG. 53 shows a state in which the driving force receiving portion 565*r* receives the driving force F. A straight line LN1 is drawn in the normal direction of the driving force receiving portion 565*r*. The straight line LN1 extends toward the side where the driving force receiving portion 565*r* faces and is also a straight line along the vector indicating the driving force F.

And, the fixed end 565*t*1 of the extending portion 565*t* is disposed further upstream in the rotational direction R than the straight line LN1. That is, a support portion 565 is provided across a straight line LN1.

In this case, when the driving force receiving portion 565*r* receives the driving force F, a moment M1 in the same direction as the rotational direction of the drum unit (counterclockwise direction in the drawing) is produced in the extending portion 565*t* with the fixed end 565*t* as a fulcrum. This moment M1 acts so that the support portion 565 approaches the main assembly driving shaft 101. That is, the moment M1 acts to urge the engaging portion 565*a* toward the back of the drive transmission groove 101*a*. By this, it is possible to stabilize the engagement state between the engagement portion 565*a* and the drive transmission groove 101*a*. In this embodiment, the support portion 565 can be molded as a portion of the flange member 571 using a mold, and therefore, the manufacture of the flange member 571 including the support portion 565 is facilitated.

In the following, referring to FIGS. 54 to 57, a modified example of Embodiment 4 will be described. FIGS. 54 to 57 are sectional views of the coupling unit (flange member).

First, in the modification shown in FIG. 54, the extended portions (665*t*, 665*s*) are bent and have the first extending portion 665*s* and the second extending portion 665*t* extending in different directions. The boundary between the first extending portion 665*ts* the second extending portion 665*t* is a bent portion. The first extending portion 665*s* in this modified example corresponds to the connecting portion 565*s* shown in FIG. 52. That is, the extended portion of the connecting portion 565*s* (FIG. 52) is the first extending portion 665*s* (FIG. 54), and the first extending portion 665*s* is also the connecting portion connecting the second extending portion 665*t* and the engaging portion 665*a*. On the contrary, it is also possible to regard the connecting portion 565*s* shown in FIG. 52 as the first extending portion and the extending portion 565*t* as the second extending portion.

The engaging portion 665*a* shown in FIG. 54 is a bulging portion provided at the free end of the extending portion (the first extending portion 665*s*). The first extending portion 665*s* and the engaging portion 665*a* can be regarded as projecting portions (projecting portions) projecting in a direction crossing with the second extending portion 665*t*.

The first extending portion 665*s* of this modification is longer than the connecting portion 565*s* shown in FIG. 52. Correspondingly, therefore, the flange member 671 of the present modification becomes thinner (the thickness becomes smaller).

Next, FIG. 55 shows another modified example. As shown in FIG. 55, the shape of the bulging portion (engaging portion) is different. As described in Embodiment 3, the bulging portion may be a polygonal shape or the like. In FIG. 55, the cross-sectional shape of the engaging portion 765*a* is substantially hexagonal. Such a cross sectional shape can also be regarded as a substantially circular shape. Here, also in the modified examples (FIGS. 56 and 57) shown below, the cross-sectional shape of the engaging portion (bulging portion) may be polygonal.

Another modification is shown in FIG. 56. In the structure shown in FIG. 56, the extending portion 865*t* is not been but is directly connecting to the bulging portion (the engaging portion 865*a*). However, the center of the engaging portion

865*a* is offset from the extended line of the extending portion 865*t*, and the engaging portion 865*a* is a projecting portion projecting in the direction intersecting with the extending portion 865*t*. In this modification, the position of the fixed end 856*t*1 of the extending portion 865*t* is different from the strall of the structure shown in FIG. 52. That is, the fixed end 865*t*1 is on the downstream side in the rotational direction R with respect to the straight line L1 extending in the normal direction of the driving force receiving portion 865*r*.

With such a structure, when the support portion 865 receives the driving force, a moment in the clockwise direction in the Figure may be applied to the support portion 865 with the fixed end 865*t*1 as a fulcrum. This moment acts to move the engaging portion 865*a* away from the drive transmission groove 101*a*.

In this case, in order to prevent the engagement between the engaging portion 865*a* and the drive transmission groove 101*a* from being broken, it is desirable to increase the elastic force of the extending portion 865*t* (that is, making the extending portion 865*t* hard to deform). Or, it is preferable that a large frictional force is produced between the engaging portion 865*a* and the drive transmission groove 101*a*.

Referring to FIG. 57, a further modification will be described. With the structure of FIG. 56 described above, the engaging portion is disposed at a position offset from the extended line of the extending portion. On the contrary, in this modified example shown in FIG. 57, the center of the engaging portion 965*a* is disposed on an extended line of the extending portion 965*t*.

The engaging portion 965*a* is a projecting portion provided at the free end of the extending portion 965*t* and projects (raised) toward the entire circumferential direction of the extending portion 965*t*.

In this modified example shown in FIG. 57, the fixed end 965*t*1 of the support portion 965 is disposed on a further downstream side in the rotational direction R as compared with the above-described structure shown in FIG. 56. Therefore, when the driving force receiving portion of the engaging portion 965*a* receives the driving force, a moment may be applied to the support portion 965 in a direction tending to separate the engaging portion 965*a* from the drive transmission groove 101*a*.

Therefore, in order to ensure the engagement state between the engaging portion 965*a* and the drive transmission groove 101*a*, it is preferable that as described above, measures are taken to further increase the elastic force of the extending portion 965*t* or to increase the friction coefficient of the surface of the engaging portion 965*a*.

However, when the elastic force of the extending portion 965*t* is increased with the result that the extending portion 965*t* does not easily bend, the force required for mounting the cartridge 7 in the apparatus main assembly is increased. That is, in order to mount the cartridge 7, it is necessary to deflect the extending portion 965*t*, and the load for that is added. Therefore, in consideration of the mountability of the cartridge 7, it is preferable that a necessary and sufficient elastic force is selected for the extending portion 965*t*.

INDUSTRIAL APPLICABILITY

According to the present invention, a drum unit mountable to and dismountable from a main assembly of an electrophotographic image forming apparatus is provided.

The invention claimed is:

1. A drum unit for a cartridge, the drum unit comprising:
a photosensitive drum; and
a coupling operatively connected to the photosensitive drum, the coupling including:
a slidable member,
a holding member including a guide configured to guide the slidable member such that the slidable member is slidable relative to the holding member between a first position and a second position,
a stopper configured to stop movement of the slidable member when the slidable member is in the first position; and
a spring configured to urge the slidable member towards the stopper,
wherein a tip of the slidable member is positioned closer to an axis of the coupling when the slidable member is positioned in the first position than when the slidable member is positioned is in the second position, and
wherein an open space is formed in the coupling between the tip of the slidable member and the axis of the coupling when the slidable member is in the first position.

2. A drum unit according to claim 1, wherein the slidable member is provided with a projection at the tip thereof, the projection projecting inwardly in a radial direction of the coupling.

3. A drum unit according to claim 1, wherein at least a part of the slidable member is positioned inside of the photosensitive drum.

4. A drum unit according to claim 1, wherein the guide includes (i) an upstream guide portion configured to guide an upstream side of the slidable member in a rotational direction of the coupling, and (ii) a downstream guide portion configured to guide an downstream side of the slidable member in the rotational direction of the coupling.

5. A drum unit according to claim 4, wherein the upstream guide portion and the downstream guide portion are substantially parallel to each other.

6. A drum unit according to claim 1, wherein the slidable member is slidable in a direction substantially parallel to a radial direction of the coupling.

7. A drum unit according to claim 1, wherein the coupling includes:
a plurality of slidable members, and
a plurality of guides.

8. A drum unit according to claim 1, wherein at least a part of the spring is positioned inside of the photosensitive drum.

9. A drum unit according to claim 1, wherein the holding member is fixed to the photosensitive drum.

10. A cartridge comprising:
a casing;
a rotatable member configured to bear toner on an outer peripheral surface thereof, the rotatable member being rotatably supported by the casing; and
a coupling operatively connected to the rotatable member, the coupling including:
a slidable member,
a holding member including a guide configured to guide the slidable member such that the slidable member is slidable relative to the holding member between a first position and a second position,
a stopper configured to stop movement of the slidable member when the slidable member is in the first position; and
a spring configured to urge the slidable member towards the stopper,
wherein a tip of the slidable member is positioned closer to an axis of the coupling when the slidable member is positioned in the first position than when the slidable member is positioned is in the second position, and wherein an open space is formed in the coupling between the tip of the slidable member and the axis of the coupling when the slidable member is in the first position.

11. A cartridge according to claim 10, wherein the slidable member is provided with a projection at the tip thereof, the projection projecting inwardly in a radial direction of the coupling.

12. A cartridge according to claim 10, wherein the guide is configured to guide a side of the slidable member in a circumferential direction of coupling.

13. A cartridge according to claim 10, wherein the guide includes (i) an upstream guide portion configured to guide an upstream side of the slidable member in a rotational direction of the coupling, and (ii) a downstream guide portion configured to guide a downstream side of the slidable member in the rotational direction of the coupling.

14. A cartridge according to claim 10, wherein the upstream guide portion and the downstream guide portion are substantially parallel to each other.

15. A cartridge according to claim 10, wherein the slidable member is slidable in a direction substantially parallel to a radial direction of the coupling.

16. A cartridge according to claim 10, wherein the coupling includes:

a plurality of slidable members, and a plurality of guides.

17. A cartridge according to claim 10, further comprising gears, wherein the coupling is operatively connected to the rotatable member through the gears.

18. A cartridge according to claim 10 wherein the rotatable member is a photosensitive drum.

19. A cartridge according to claim 18, wherein at least a part of the slidable member is positioned inside of the photosensitive drum.

20. A cartridge according to claim 18, wherein at least a part of the spring is positioned inside of the photosensitive drum.

21. A cartridge according to claim 10, wherein the rotatable member is a developing roller.

22. A cartridge according to claim 21, further comprising a toner supplying roller configured to supply toner to the developing roller, wherein the coupling is operatively connected to the developing roller and the toner supplying roller.

* * * * *